US006368780B1

(12) United States Patent
Takeuchi et al.

(10) Patent No.: US 6,368,780 B1
(45) Date of Patent: Apr. 9, 2002

(54) SILVER HALIDE PHOTOGRAPHIC MATERIAL AND IMAGE FORMATION METHOD

(75) Inventors: Kiyoshi Takeuchi; Taiji Katsumata; Satoshi Sano; Yuki Mizukawa, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/628,652

(22) Filed: Jul. 28, 2000

(30) Foreign Application Priority Data

Jul. 30, 1999 (JP) ..... 11-217821
Mar. 22, 2000 (JP) ..... 2000-080646

(51) Int. Cl.[7] ..... G03C 1/08; G03C 7/26; G03C 7/32

(52) U.S. Cl. ..... 430/553; 430/385; 430/380; 430/566; 430/467; 430/484

(58) Field of Search ..... 430/553, 385, 430/264, 598, 404, 467, 566, 380

(56) References Cited

U.S. PATENT DOCUMENTS 4,469,773 A 9/1984 Adin et al.
5,976,756 A 11/1999 Nakamura et al.
6,013,421 A * 1/2000 Nakamura et al. ..... 430/553
6,183,932 B1 * 2/2001 Asami et al. ..... 430/553

FOREIGN PATENT DOCUMENTS

JP A9152705 6/1997
JP 2001-42487 * 2/2001

* cited by examiner

*Primary Examiner*—Geraldine Letscher
(74) *Attorney, Agent, or Firm*—Birch, Stewart, Kolasch & Birch, LLP

(57) ABSTRACT

A silver halide photographic material excellent in color generation, color reproduction and image fastness, which comprises at least one coupler represented by the following formula:

wherein $R^1$ represents an alkyl group which may be optionally substituted, with the proviso that an alkyl group substituted by a halogen atom alone and an alkyl group substituted by a halogen atom and an aryl group are excluded from $R^1$; $R^2$ and $R^3$, which may be the same or different, each represents a hydrogen atom or a substituent; and $X^1$ represents a group which can leave by coupling with an oxidation product of a color developing agent; and an image formation method using the same.

9 Claims, No Drawings

SILVER HALIDE PHOTOGRAPHIC MATERIAL AND IMAGE FORMATION METHOD

FIELD OF THE INVENTION

The present invention relates to a silver halide photographic material and an image formation method using the same, and particularly to a heat developable silver halide photographic material (silver halide photothermographic material) and an image formation method using the same.

BACKGROUND OF THE INVENTION

In the field of silver halide photographic materials, the so-called color diffusion transfer process is known in which diffusible dyes are formed imagewise and fixed to image receiving materials, thereby forming color images. With respect to this process, many proposals have been made.

In this process, the diffusible dyes are generally produced as a function of development of silver halides from compounds obtained by making previously colored image formation dyes (preformed dyes) diffusion-resistant (such compounds are hereinafter referred to as "coloring materials). Accordingly, the addition of the coloring materials to layers having silver halide emulsions causes an undesirable reduction in sensitivity to exposure because of the filter effect due to dye moieties. For avoiding this problem, the coloring materials for image formation are generally added to layers apart from exposure faces of silver halide emulsion layers. This process can avoid the reduction in sensitivity caused by the filter effect, but has the disadvantage that an increase in the distance between the silver halide emulsions and the coloring materials producing the diffusible dyes causes inefficient transfer of development information from the silver halide emulsion to the coloring materials.

For improving these disadvantages, a so-called coupling system has been proposed in which dye formation is carried out by the coupling reaction of oxidation products of developing agents with couplers. This system can advantageously overcome the disadvantages of the system using the preformed dyes, because both the developing agents and the couplers are colorless. This system is therefore more preferred than the use of the coloring materials utilizing the preformed dyes. This process is described, for example, in U.S. Pat. No. 4,469,773 and JP-B-63-36487 (the term "JP-B" as used herein means an "examined Japanese patent publication").

However, when the photographic materials contain the color developing agents for the above-mentioned coupling system, the sufficient keeping stability is insufficiently compatible with the activity of the coupling reaction.

Recently, a technique of forming diffusible dyes using color developing agents of the hydrazine family has been developed, and is described in JP-A-9-152705 (the term "JP-A" as used herein means an "unexamined published Japanese patent application"). However, compounds described herein have the problem that they are low in the color generation of cyan or magenta, or that the dyes produced are low in light fastness.

SUMMARY OF THE INVENTION

An object of the invention is to provide a silver halide photographic material excellent in color generation in development.

Another object of the invention is to provide a silver halide photographic material excellent in color reproducibility.

A further object of the invention is to provide a silver halide photographic material excellent in color image fastness, particularly, in light fastness.

A still further object of the invention is to provide a silver halide photographic material excellent in color image fastness, particularly, in light fastness at low density areas.

A still further object of the invention is to provide an image formation method using a silver halide photographic material excellent in the above-mentioned characteristics.

According to the invention, there are provided silver halide photographic materials and image formation methods having the following constitution, thereby attaining the above-mentioned objects.

(1) A silver halide photographic material comprising at least one coupler represented by the following formula (Ia):

(Ia)

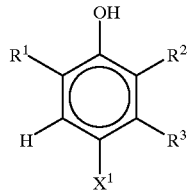

wherein $R^1$ represents an alkyl group which may be optionally substituted, with the proviso that an alkyl group substituted by a halogen atom alone and an alkyl group substituted by a halogen atom and an aryl group are excluded from $R^1$; $R^2$ and $R^3$, which may be the same or different, each represents a hydrogen atom or a substituent; and $X^1$ represents a group which can leave by coupling with an oxidation product of a color developing agent;

(2) The silver halide photographic material described in (1), wherein $R^1$ of formula (Ia) is a tertiary alkyl group;

(3) The silver halide photographic material described in (1) or (2), wherein $R^2$ of formula (Ia) is an acylamino group, an alkoxycarbonylamino group or an ureido group;

(4) A silver halide photographic material comprising at least one coupler represented by the following formula (II):

(II)

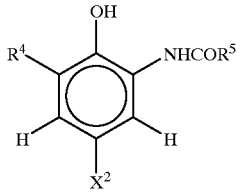

wherein $R^4$ represents a tertiary alkyl group; $R^5$ represents a substituent; and $X^2$ represents a group leaving by coupling (a coupling-off group) which is linked by an oxygen atom to a mother nucleus of a phenol coupler and has a formula weight of 200 or more;

(5) The silver halide photographic material described in (4), wherein at least one of $R^4$ and $R^5$ of formula (II) is a group having a dissociative group with a pKa of 1 to 12;

(6) A silver halide photographic material comprising a support having provided thereon at least one hydrophilic colloidal layer containing at least one coupler represented by the following formula (Ib) and at least one color developing agent represented by the following formula (III):

(Ib)

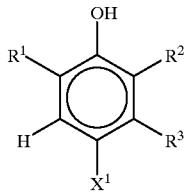

wherein $R^1$ represents an alkyl group which may be optionally substituted; $R^2$ and $R^3$, which may be the same or different, each represents a hydrogen atom or a substituent; and $X^1$ represents a group which can leave by coupling with an oxidation product of a color developing agent, (III)

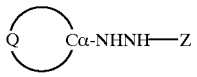

wherein Cα represents a carbon atom; Z represents a carbamoyl group, an acyl group, an alkoxycarbonyl group or an aryloxycarbonyl group; and Q represents an atomic group forming an unsaturated ring together with Cα;

(7) A heat developable silver halide photographic material (a silver halide photothermographic material) comprising at least one coupler represented by the following formula (IV):

(IV)

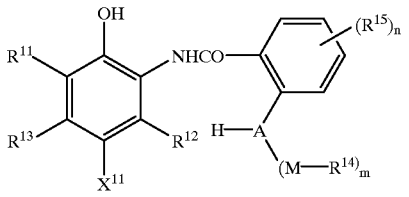

wherein $R^{11}$ represents an acylamino group or an alkyl group; $R^{12}$ and $R^{13}$ each independently represents a hydrogen atom or a substituent; A represents a nitrogen atom or an oxygen atom; when A is an oxygen atom, m represents 0; when A is a nitrogen atom, M represents a —CO— group or an $—SO_2—$ group; $R^{14}$ represents an alkyl group, an aryl group, an alkoxyl group or an amino group, and m represents 1; $—A(H)—(M—R^{14})_m$ may be cyclocondensed with a benzene ring to form a 5-, 6- or 7-membered ring; $R^{15}$ represents a substituent, and n represents an integer of 0 to 4; and $X^{11}$ represents a group which can leave by coupling with an oxidation product of a color developing agent;

(8) The heat developable silver halide photographic material described in (7), wherein $R^{11}$ of formula (IV) is a tertiary alkyl group;

(9) The heat developable silver halide photographic material described in (7) or (8), wherein $R^{11}$ of formula (IV) is a tertiary alkyl group, $R^{12}$ is a hydrogen atom, and $R^{13}$ is a hydrogen atom, a halogen atom, an alkoxy group, an acylamino group, an alkoxycarbonylamino group or a carbamoylamino group;

(10) The heat developable silver halide photographic material described in (7) or (8), wherein $R^{11}$ of formula (IV) represents a tertiary alkyl group, A represents a nitrogen atom, M represents a —CO— group or an $—SO_2—$ group, $R^{14}$ represents an alkyl group or an aryl group, m represents 1, $R^{12}$ and $R^{13}$ each represents a hydrogen atom, $R^{15}$ represents a substituent, n represents an integer of 0 to 4, and $X^{11}$ represents a group leaving by coupling which is linked by an oxygen atom to a mother nucleus of a phenol coupler and has a formula weight of 200 or more;

(11) A heat developable silver halide photographic material comprising a support having provided thereon at least one hydrophilic colloidal layer containing at least one coupler represented by formula (IV) and at least one color developing agent represented by the following formula (III):

(III)

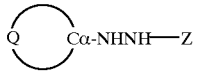

wherein Cα represents a carbon atom; Z represents a carbamoyl group, an acyl group, an alkoxycarbonyl group or an aryloxycarbonyl group; and Q represents an atomic group forming an unsaturated ring together with Cα;

(12) An image formation method comprising heat developing the silver halide photographic material described in (1) or (7); and

(13) An image formation method comprising developing the silver halide photographic material described in (1) or (7) by developing an alkali processing solution.

DETAILED DESCRIPTION OF THE INVENTION

The couplers represented by formulas (Ia) and (Ib) (formulas (Ia) and (Ib) are both described as formula (I) in the following description), which are used in the invention, will be illustrated in detail below.

In formula (I), $R^1$ represents an alkyl group. The alkyl group is a straight-chain, branched or cyclic alkyl group having from 1 to 50 carbon atoms (e.g., methyl, ethyl, isopropyl, t-butyl, t-pentyl, cyclopropyl, cyclohexyl, 2-ethylhexyl or dodecyl). The alkyl group is preferably a secondary or tertiary alkyl group, more preferably a tertiary alkyl group, and most preferably a t-butyl group. The number of carbon atoms thereof is preferably from 1 to 8, more preferably from 1 to 5, and most preferably from 1 to 4.

$R^1$ may have a substituent other than a halogen atom. Examples of the substituents include straight-chain, branched or cyclic alkyl groups each having from 1 to 50 carbon atoms (e.g., trifluoromethyl, methyl, ethyl, propyl, heptafluoro-propyl, isopropyl, butyl, t-butyl, t-pentyl, cyclopentyl, cyclohexyl, octyl, 2-ethylhexyl and dodecyl), straight-chain, branched or cyclic alkenyl groups each having from 2 to 50 carbon atoms (e.g., vinyl, 1-methylvinyl and cyclohexene-1-yl), alkynyl groups each having a total carbon number of 2 to 50 (e.g., ethynyl and 1-propynyl), aryl groups each having from 6 to 50 carbon atoms (e.g, phenyl, naphthyl and anthryl), acyloxy groups each having from 1 to 50 carbon atoms (e.g., acetoxy, tetradecanoyloxy and benzoyloxy), carbamoyloxy groups each having from 1 to 50 carbon atoms (e.g., N,N-dimethylcarbamoyloxy), carbonamido groups each having from 1 to 50 carbon atoms (e.g., formamido, N-methylacetamido, acetamido, N-methylformamido and benzamido), sulfonamido groups each having from 1 to 50 carbon atoms (e.g, methanesulfonamido, dodecanesulfonamido, benzenesulfonamido and p-toluenesulfonamido), carbamoyl groups each having from 1 to 50 carbon atoms (e.g, N-methylcarbamoyl, N,N-diethylcarbamoyl and N-mesylcarbamoyl, sulfamoyl groups each having from 0 to 50 carbon atoms (e.g., N-butyl-sulfamoyl, N,N-diethylsulfamoyl and N-methyl-N-(4-methoxyphenyl) sulfamoyl), alkoxy groups each having from 1 to 50 carbon atoms (e.g, methoxy, propoxy, isopropoxy, octyloxy, t-octyloxy, dodecyloxy and 2-(2,4-di-t-pentylphenoxy) ethoxy), aryloxy groups each having from 6 to 50 carbon atoms (e.g., phenoxy, 4-methoxyphenoxy and naphthoxy), aryloxycarbonyl groups each having from 7 to 50 carbon atoms (e.g., phenoxycarbonyl and naphthoxycarbonyl), alkoxycarbonyl groups each having from 2 to 50 carbon atoms (e.g., methoxycarbonyl and t-butoxycarbonyl), N-acylsulfamoyl groups each having from 1 to 50 carbon atoms (e.g., N-tetradecanoylsulfamoyl and N-benzoylsulfamoyl), alkylsulfonyl groups each having from 1 to 50 carbon atoms (e.g., methane-sulfonyl, octylsulfonyl, 2-methoxyethylsulfonyl and 2-hexyldecylsulfonyl), arylsulfonyl groups each having from 6 to 50 carbon atoms (e.g., benzenesulfonyl, p-toluenesulfonyl and 4-phenylsulfonyl), alkoxycarbonylamino groups each having from 2 to 50 carbon atoms (e.g., ethoxycarbonylamino), aryloxycarbonylamino groups each having from 7 to 50 carbon atoms (e.g., phenoxycarbonylamino and naphthoxycarbonyl-amino), amino groups each having from 0 to 50 carbon atoms (e.g., amino, methylamino, diethylamino, diisopropylamino, anilino and morpholino), a cyano group, a nitro group, a carboxyl group, a hydroxyl group, a sulfo group, a mercapto group, alkylsulfinyl groups each having from 1 to 50 carbon atoms (e.g., methanesulfinyl and octanesulfinyl), aryl-sulfinyl groups each having from 6 to 50 carbon atoms (e.g., benzenesulfinyl, 4-chlorophenylsulfinyl and p-toluenesulfinyl), alkylthio groups each having from 1 to 50 carbon atoms (e.g., methylthio, octylthio and cyclohexylthio), arylthio groups each having from 6 to 50 carbon atoms (e.g., phenylthio and naphthylthio), ureido groups each having from 1 to 50 carbon atoms (e.g., 3-methylureido, 3,3-dimethyl-ureido and 1,3-diphenylureido), heterocyclic groups each having from 2 to 50 carbon atoms (3- to 12-membered monocyclic or condensed rings each containing, for example, at least one atom, preferably from 1 to 9 atoms, of nitrogen, oxygen and sulfur atoms as heteroatoms, for example, 2-furyl, 2-pyranyl, 2-pyridyl, 2-thienyl, 2-imidazolyl, morpholino, 2-quinolyl, 2-benzimidazolyl, 2-benzothiazolyl and 2-benzoxazolyl), acyl groups each having from 1 to 50 carbon atoms (e.g., acetyl, benzoyl and trifluoroacetyl), sulfamoyl-amino groups each having from 0 to 50 carbon atoms (e.g., N-butylsulfamoylamino and N-phenylsulfamoylamino), silyl groups each having from 3 to 50 carbon atoms (e.g., trimethylsilyl, dimethyl-t-butylsilyl and triphenylsilyl). The above-mentioned substituents may further have substituents, and examples of the substituents include the substituents mentioned above.

In formula (I), $R^2$ is a hydrogen atom or a substituent. Examples of the substituents include halogen atoms and ones mentioned above as the examples of the substituents which $R^1$ may have.

$R^2$ is preferably a hydrogen atom, a halogen atom, an acylamino group, an alkoxycarbonylamino group, an aryloxycarbonylamino group or an ureido group, and more preferably an acylamino group, an alkoxycarbonylamino group or an ureido group.

In formula (I), $R^3$ is a hydrogen atom or a substituent. Examples of the substituents include halogen atoms and ones mentioned above as the examples of the substituents which $R^1$ may have. $R^3$ is preferably a hydrogen atom.

In formula (I), it is preferred that at least one of $R^1$, $R^2$ and $R^3$ has a dissociative group with a pKa of 1 to 12. It is more preferred that $R^2$ has the dissociative group. The pKa of the dissociative group is more preferably from 3 to 12, and most preferably from 5 to 11.

Preferred examples of the dissociative groups include an —$NHSO_2$— group, phenolic hydroxyl groups, a —CONHCO— group, a —$CONHSO_2$— group and groups containing —CON(R)—OH (wherein R represents a hydrogen atom or a substituent, and is preferably an alkyl group, an aryl group or a heterocyclic group), —COOH or —$SO_2NHSO_2$—. The —$NHSO_2$— group, the phenolic hydroxyl groups, the —CONHCO— group, the —$CONHSO_2$— group and the —$SO_2NHSO_2$— group are more preferred.

In formula (I), $X^1$ represents a group which can leave by a coupling reaction with an oxidation product of a developing agent. $X^1$ is, for example, a heterocyclic group (a saturated or unsaturated, 5-, 6- or 7-membered monocyclic or condensed ring containing at least one atom of nitrogen, oxygen and sulfur as a heteroatom). Examples thereof include succinimide, maleinimide, phthalimide, diglycollimide, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2,4-dione, imidazolidine-2-one, oxazoline-2-one, thiazoline-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, 2-imino-1,3,4-thiazolidine-4-one, halogen atoms (e.g., chlorine and bromine), aryloxy groups (e.g., phenoxy and 1-naphthoxy), heterocyclic oxy groups (e.g., pyridyloxy and pyrazolyloxy), acyloxy groups (e.g., cyclohexylcarbonyloxy and benzoyloxy), alkoxy groups (e.g., methoxy, ethoxy and dodecyloxy), carbamoyloxy groups (e.g., N,N-didodecyl-carbamoyloxy and morpholinocarbonyloxy), aryloxycarbonyloxy groups (e.g., phenoxycarbonyloxy), alkoxycarbonyloxy groups (e.g., methoxycarbonyloxy and hexadecylcarbonyloxy), arylthio groups (e.g., phenylthio and naphthylthio), heterocyclic thio groups (e.g., tetrazolylthio, 1,3,4-thiadiazolylthio, 1,3,4-oxadiazolylthio and benzimidazolylthio), alkylthio groups (e.g., methylthio, octylthio and hexadecylthio), alkylsulfonyloxy groups, arylsulfonyloxy groups (e.g., benzenesulfonyloxy and toluenesulfonyloxy), carbonamido groups (e.g., undecylcarbonylamino and phenylcarbonylamino), sulfonamido groups (e.g., dodecylsulfonamido and benzenesulfonamido), alkylsulfonyl groups, arylslufonyl groups (e.g., benzenesulfonyl), alkylsulfinyl groups (e.g., octylsulfinyl), arylsulfinyl groups (e.g., benzenesulfinyl) and carbamoylamino groups (e.g., N-hexadecylcarbamoylamino).

Of these, preferred are the aryloxy groups, the heterocyclic oxy groups, the acyloxy groups, the alkoxy-carbonyloxy groups, the carbamoyloxy groups, the aryloxy-carbonyloxy groups, the arylthio groups, the heterocyclic thio groups, the alkylsulfonyloxy groups and the aryl-sulfonyloxy groups, and more preferred are the aryloxy groups, the heterocyclic oxy groups, the acyloxy groups, the aryloxycarbonyloxy groups, the alkoxycarbonyloxy groups and the carbamoyloxy groups.

$X^1$ may be substituted by a substituent. Examples of the substituents for $X^1$ include halogen atoms and ones mentioned above as the examples of the substituents which $R^1$ may have.

The formula weight of $X^1$ is preferably 200 or more, and more preferably 250 or more.

In formula (II), $R^4$ is a straight-chain or cyclic tertiary alkyl group having from 4 to 50 carbon atoms, and preferably a t-butyl group. $R^4$ may be substituted by a substituent. Examples of the substituents include halogen atoms and ones mentioned above as the examples of the substituents which $R^1$ may have. $R^4$ has preferably from 4 to 8 carbon atoms, and more preferably 4 or 5 carbon atoms.

In formula (II), $R^5$ represents a hydrogen atom or a substituent. Examples of the substituents include halogen atoms and ones mentioned above as the examples of the substituents which $R^1$ may have. $R^5$ is preferably an alkyl group, an aryl group, a heterocyclic group, an alkoxy group, an aryloxy group, an amino group or an anilino group.

In formula (II), it is preferred that at least one of $R^4$ and $R^5$ has a dissociative group with a pKa of 1 to 12. It is more preferred that $R^2$ has the dissociative group.

The pKa of the dissociative group is more preferably from 3 to 12, and most preferably from 5 to 11.

Preferred examples of the dissociative groups include an —$NHSO_2$— group, phenolic hydroxyl groups, a —CONHCO— group, a —$CONHSO_2$— group and groups containing —CON(R)—OH (wherein R represents a hydrogen atom or a substituent, and is preferably an alkyl group, an aryl group or a heterocyclic group), —COOH or —$SO_2NHSO_2$—. The —$NHSO_2$— group, the phenolic hydroxyl groups, the —CONHCO— group, the —$CONHSO_2$— group and the —$SO_2NHSO_2$— group are more preferred.

In formula (II), $X^2$ represents a group which is linked by an oxygen atom to a mother nucleus of a phenol coupler, and which can leave by a coupling reaction with an oxidation product of a color developing agent.

The formula weight of $X^2$ is 200 or more, and preferably 250 or more.

$X^2$ is preferably an acyloxy group having from 1 to 50 carbon atoms, an alkoxy group having from 1 to 50 carbon atoms, an aryloxy group having from 6 to 50 carbon atoms, a heterocyclic oxy group having from 1 to 50 carbon atoms, an alkoxycarbonyloxy group having from 2 to 50 carbon atoms, an aryloxycarbonyloxy group having from 7 to 50 carbon atoms, a carbamoyloxy group having from 1 to 50 carbon atoms or a heterocyclic carbonyloxy group having from 2 to 50 carbon atoms. More preferably, $X^2$ is the carbamoyloxy group or the alkoxycarbonyloxy group. $X^2$ may have a substituent, and examples of the substituents include halogen atoms and ones mentioned above as the examples of the substituents which $R^1$ may have.

Specific examples of the couplers represented by formula (I) or (II) are shown below, but the scope of the invention is not limited to these specific examples.

(1)

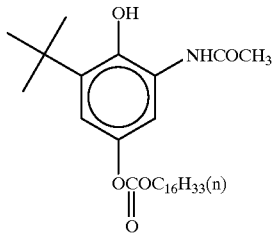

(2)

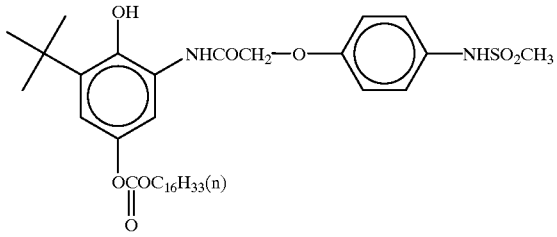

(3)

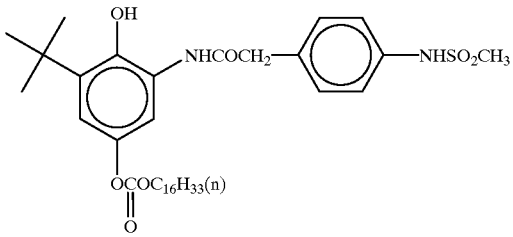

(4)

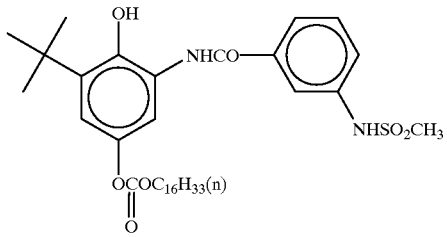

(5)

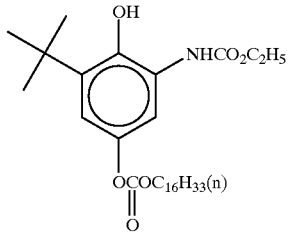

-continued
(6)
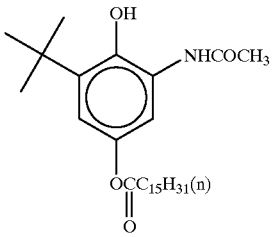
(7)
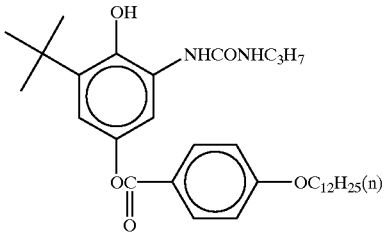
(8)
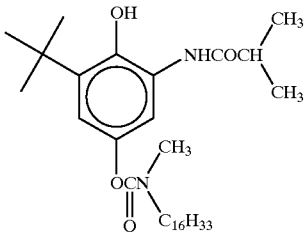
(9)
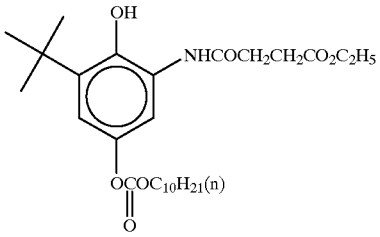
(10)
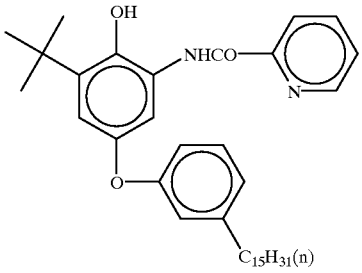
(11)
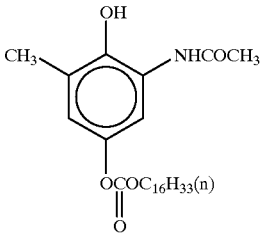
-continued
(12)
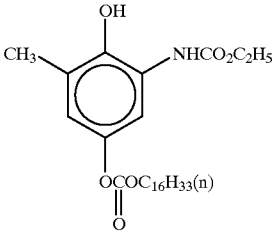
(13)
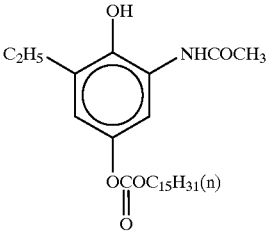
(14)
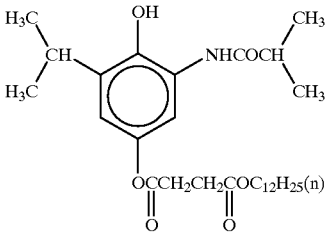
(15)
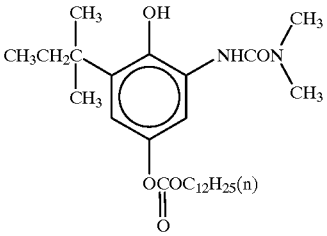
(16)
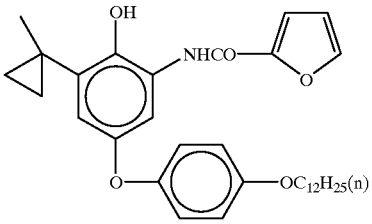
(17)
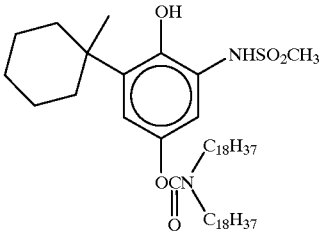

-continued
(18)
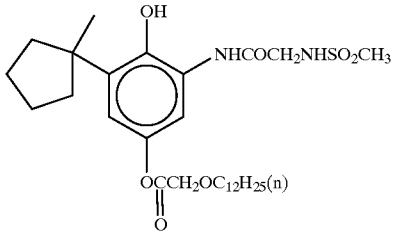
(19)
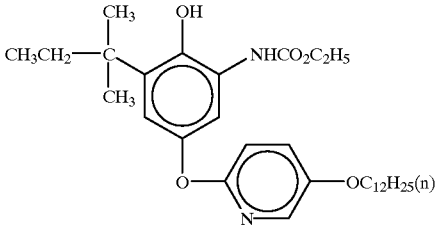
(20)
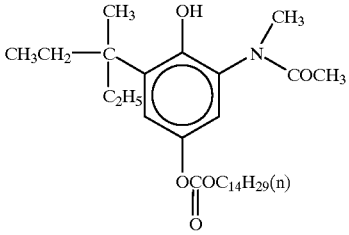
(21)
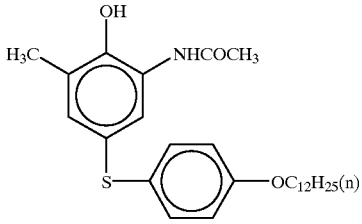
(22)
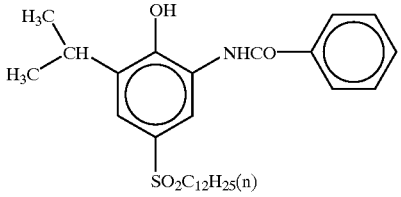
(23)
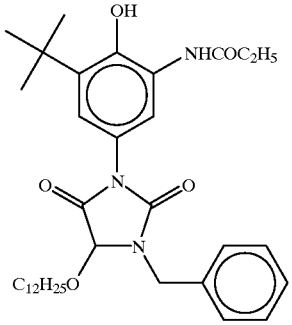
-continued
(24)
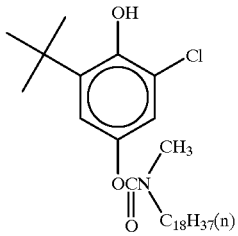
(25)
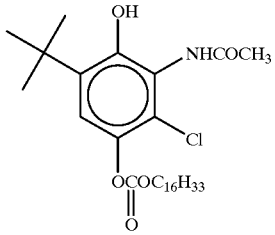
(26)
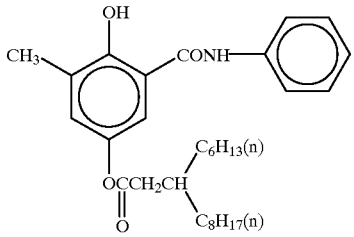
(27)
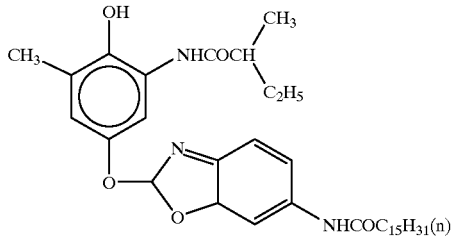
(28)
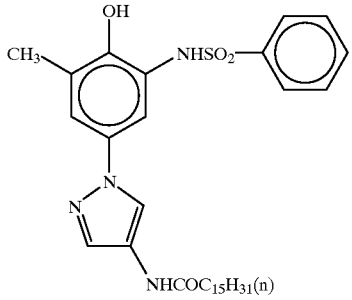
(29)
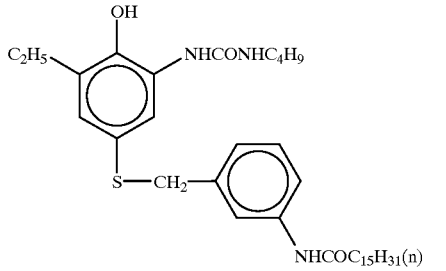

-continued
(30)
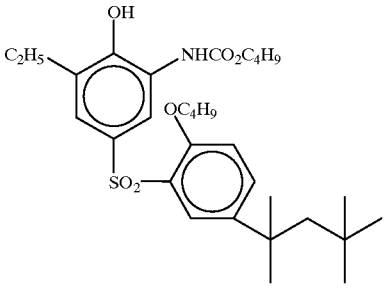
(31)
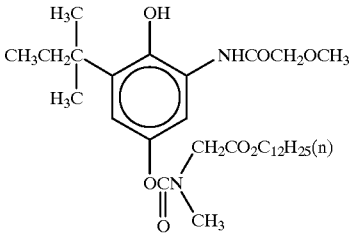
(32)
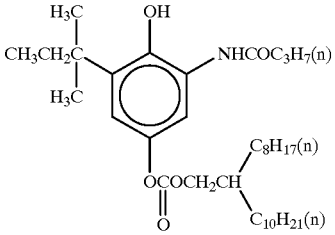
(33)
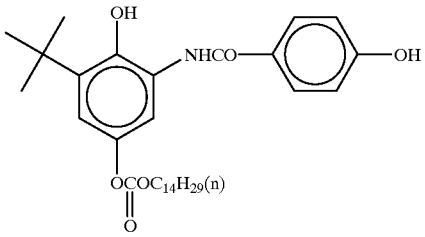
(34)
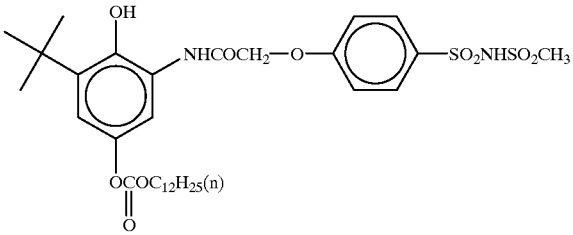
(35)
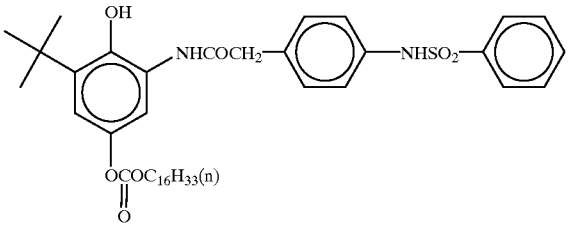
-continued
(36)
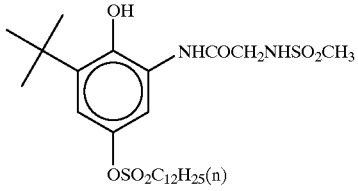
(37)
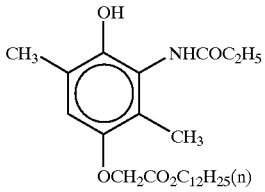
(38)
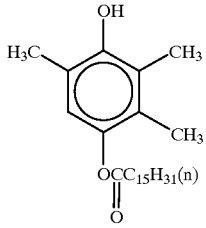
(39)
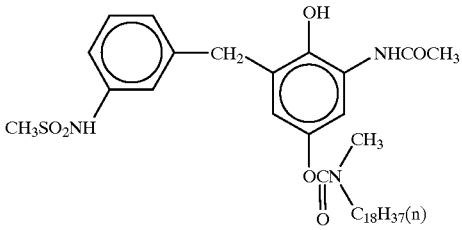
(40)
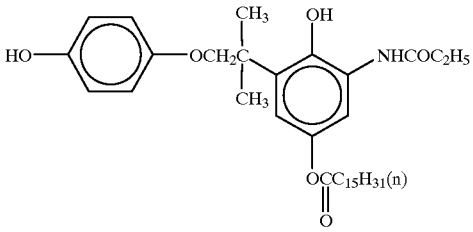
(41)
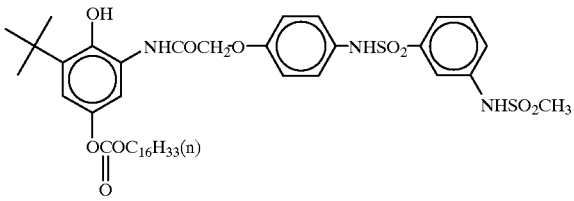

-continued
(42)
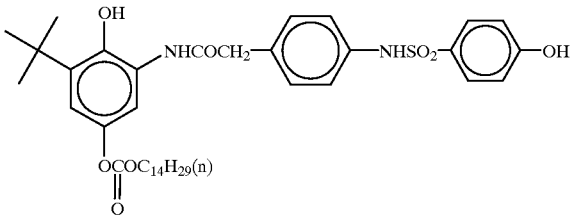
(43)
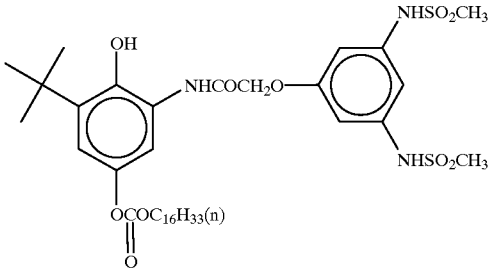
(44)
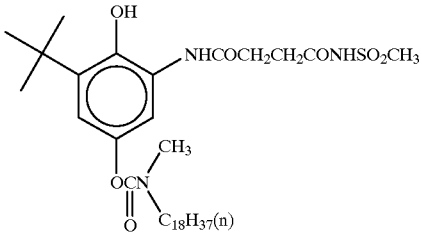
(45)
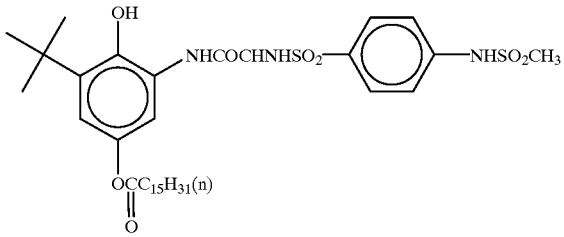
(46)
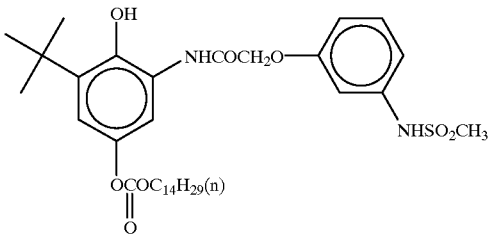
(47)
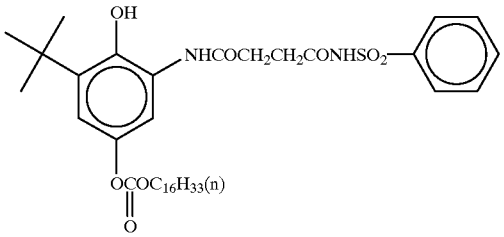
-continued
(48)
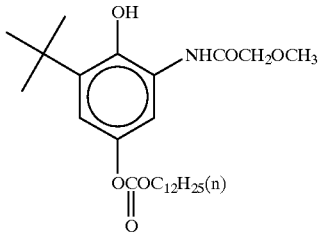
(49)
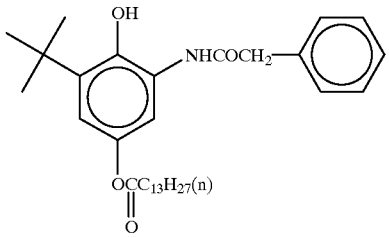
(50)
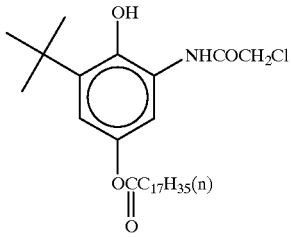
Typical synthesis examples of the compounds represented by formula (I), which are used in the invention, are shown below. Other compounds can also be synthesized in a manner similar to that of the following examples.
SYNTHESIS EXAMPLE 1
Synthesis of Example Compound (1)
Example compound (1) was synthesized by the following synthesis route:
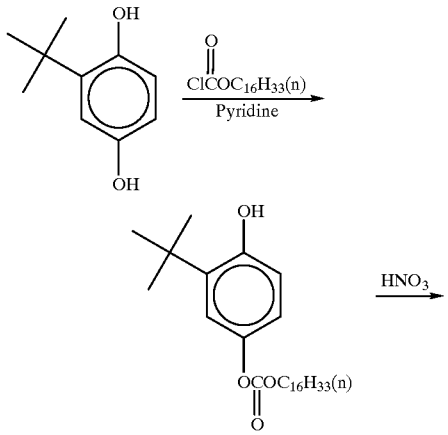
(A-1)

-continued

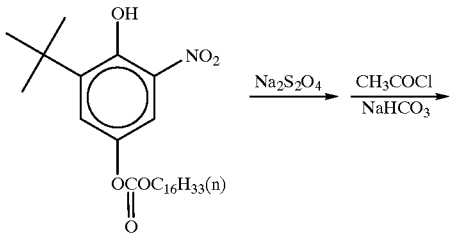

(A-2)

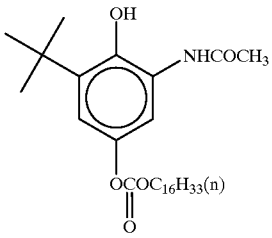

Example Compound (1)

Synthesis of Compound (A-1)

In 250 ml of acetonitrile, 66.5 g (0.40 mol) of t-butylhydroquinone and 12.8 ml (0.16 mol) of pyridine were dissolved, and 24.4 g (0.080 mol) of hexadecyl chloroformate was added dropwise thereto at room temperature. The resulting solution was stirred at room temperature for 2 hours, and 200 ml of water was added dropwise. Precipitated crystals were separated by filtration, and washed with acetonitrile, followed by drying to obtain 33.4 g (0.0768 mol) of compound (A-1) as white crystals. The yield was 96.0%.

Synthesis of Compound (A-2)

In 150 ml of methylene chloride, 32.6 g (75 mmol) of compound (A-1) was dissolved, and 5 g of silica gel was added thereto. Then, 5.9 ml (79 mmol) of concentrated nitric acid (specific gravity: 1.38) was added dropwise under water cooling for 20 minutes. After stirring at 10° C. for 1 hour, the silica gel was filtered, and the filtrate was washed with water. After drying on anhydrous magnesium sulfate, the solvent was removed by distillation under reduced pressure, and the residue was crystallized from a mixed solvent of ethyl acetate and methanol to obtain 27.1 g (56.5 mmol) of compound (A-2) as yellow crystals. The yield was 75.3%.

Synthesis of Example Compound (1)

In 50 ml of methanol and 50 ml of ethyl acetate, 9.59 g (20 mmol) of compound (A-2) was dissolved, and a solution obtained by dissolving 10.4 g (60 mmol) of sodium hydrosulfite in 30 ml of water was added thereto, followed by stirring at 60° C. for 30 minutes. A solution obtained by dissolving 10.4 g (60 mmol) of sodium hydrosulfite in 20 ml of water was further added thereto, followed by stirring at 60° C. for 30 minutes. Then, 50 ml of ethyl acetate and 100 ml of water were added to the reaction mixture, and extraction and separation were carried out. The resulting organic layer was washed with water. Then, 6.7 g of sodium bicarbonate and 50 ml of water were added thereto, and 3.2 g (40 mmol) of acetyl chloride was added dropwise at room temperature for 20 minutes. After stirring for 30 minutes, separation was conducted, and the organic layer was washed with an aqueous solution of sodium bicarbonate and saturated brine, followed by drying on anhydrous magnesium sulfate. Then, the solvent was removed by distillation under reduced pressure. The residue was purified by column chromatography using an acetone/hexane (1/3) mixed solvent as an eluent, and thereafter recrystallized from a mixed solvent of ethyl acetate and hexane to obtain 6.3 g (12.8 mmol) of example compound (1) as white crystals. The yield was 64.1%.

$^1$H-NMR (200 MHz, $CDCl_3$) 8.53 (s, 1H), 7.66 (s, 1H), 6.96 (d, 1H), 6.65 (d, 1H), 4.24 (t, 2H), 2.18 (s, 3H), 1.75 (tt, 2H), 1.41 (s, 9H), 1.45–1.20 (m, 26H), 0.88 (t, 3H).

SYNTHESIS EXAMPLE 2

Synthesis of Example Compound (12)

Example compound (12) was synthesized by the following synthesis route:

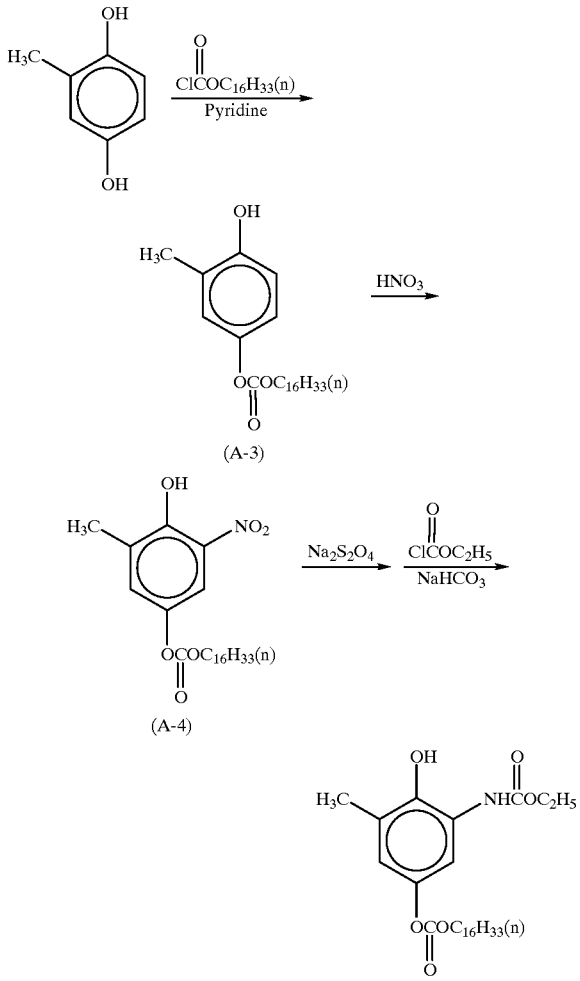

Example Compound 12

Synthesis of Compound (A-3)

In 300 ml of acetonitrile, 74.5 g (0.60 mol) of methylhydroquinone and 19.4 ml (0.24 mol) of pyridine were dissolved, and 36.6 g (0.12 mol) of hexadecyl chloroformate was added dropwise thereto at 5° C. for 30 minutes. After stirring at room temperature for 1 hour, 500 ml of water was added dropwise. Precipitated crystals were separated by filtration, and washed with water, followed by drying. The crystals were purified by column chromatography using an ethyl acetate/hexane (1/6) mixed solvent as an eluent to obtain 15.5 g (0.039 mol) of compound (A-3) as white crystals. The yield was 32.9%.

Synthesis of Compound (A-4)

In 50 ml of methylene chloride, 5.50 g (14 mmol) of compound (A-3) was dissolved, and 1 g of silica gel was added thereto. Then, 1.2 ml (16 mmol) of concentrated nitric acid (specific gravity: 1.38) was added dropwise under water cooling for 20 minutes. After stirring at 10° C. for 1 hour, the silica gel was filtered, and the filtrate was washed with water. After drying on anhydrous magnesium sulfate, the solvent was removed by distillation under reduced pressure, and the residue was crystallized from a mixed solvent of ethyl acetate and methanol to obtain 4.92 g (11.2 mmol) of compound (A-4) as yellow crystals. The yield was 80.3%.

Synthesis of Example Compound (12)

In 25 ml of ethyl acetate and 25 ml of methanol, 4.81 g (11 mmol) of compound (A-4) was dissolved, and a solution obtained by dissolving 5.7 g (33 mmol) of sodium hydrosulfite in 25 ml of water was added thereto. After stirring at 50° C. for 1 hour, 5.7 g (33 mmol) of sodium hydrosulfite was added thereto, followed by further stirring at 50° C. for 1 hour. Then, 25 ml of ethyl acetate and 50 ml of water were added to the reaction mixture, and extraction and separation were carried out. The resulting organic layer was washed with water. Then, 1.9 g of sodium bicarbonate and 50 ml of water were added thereto, and 1.73 g (16 mmol) of ethyl chloroformate was added dropwise at room temperature for 20 minutes. After stirring for 30 minutes, separation was conducted, and the organic layer was washed with an aqueous solution of sodium bicarbonate and saturated brine, followed by drying on anhydrous magnesium sulfate. Then, the solvent was removed by distillation under reduced pressure. The residue was purified by column chromatography using an ethyl acetate/hexane (1/4) mixed solvent as an eluent, and thereafter recrystallized from hexane to obtain 2.50 g (5.2 mmol) of example compound (12) as white crystals. The yield was 47.4%.

$^1$H-NMR (200 MHz, $CDCl_3$) 7.20–7.05 (m, 2H), 6.92 (s, 1H), 6.69 (d, 1H), 4.35–4.15 (m, 4H), 2.20 (s, 3H), 1.73 (tt, 2H), 1.50–1.20 (m, 29H), 0.88 (s, 3H).

The couplers represented by formula (IV), which are used in the invention, will be described in detail below.

In formula (IV), $R^{11}$ represents an acylamino group or an alkyl group. The acylamino group is preferably an acylamino group having from 1 to 50 carbon atoms, e.g., acetylamino, butanoylamino benzoylamino, trifluoroacetylamino or picolinoylamino.

The alkyl group is a straight-chain, branched or cyclic substituted or unsubstituted alkyl group (for example, the unsubstituted alkyl group is preferably an alkyl group having from 1 to 50 carbon atoms, e.g., methyl, ethyl, isopropyl, t-butyl, t-pentyl, cyclopropyl, cyclohexyl, 2-ethylhexyl or dodecyl).

When $R^{11}$ represents a substituted alkyl group, substituents include halogen atoms (e.g., fluorine, chlorine, bromine and iodine), aryl groups (preferably aryl groups each having from 6 to 50 carbon atoms, e.g., phenyl, naphthyl and anthryl), acyloxy groups (preferably acyloxy groups each having from 1 to 50 carbon atoms, e.g., acetoxy, tetradecanoyloxy and benzoyloxy), carbamoyloxy groups (preferably carbamoyloxy groups each having from 1 to 50 carbon atoms, e.g., N,N-dimethyl-carbamoyloxy), carbonamido groups (preferably carbonamido groups each having from 1 to 50 carbon atoms, e.g., formamido, N-methylacetamido, acetamido, N-methylformamido and benzamido) sulfonamido groups (preferably sulfonamido groups each having from 1 to 50 carbon atoms, e.g, methanesulfonamido, dodecanesulfonamido, benzenesulfonamido and p-toluenesulfonamido), carbamoyl groups (preferably carbamoyl groups each having from 1 to 50 carbon atoms, e.g, carbamoyl groups, N-methylcarbamoyl, N,N-diethylcarbamoyl and N-mesylcarbamoyl), sulfamoyl groups (preferably sulfamoyl groups each having from 0 to 50 carbon atoms, e.g., sulfamoyl, N-butylsulfamoyl, N,N-diethylsulfamoyl and N-methyl-N-(4-methoxyphenyl) sulfamoyl), alkoxy groups (preferably alkoxy groups each having from 1 to 50 carbon atoms, e.g, methoxy, propoxy, isopropoxy, octyloxy, t-octyloxy, dodecyloxy and 2-(2,4-di-t-pentylphenoxy)ethoxy), aryloxy groups (preferably aryloxy groups each having from 6 to 50 carbon atoms, e.g., phenoxy, 4-methoxyphenoxy and naphthoxy), aryloxycarbonyl groups (preferably aryloxy-carbonyl groups each having from 7 to 50 carbon atoms, e.g., phenoxycarbonyl and naphthoxycarbonyl), alkoxycarbonyl groups (preferably alkoxycarbonyl groups each having from 2 to 50 carbon atoms, e.g., cyclohexyloxy-carbonyl, methoxycarbonyl, isopropoxycarbonyl and t-butoxycarbonyl), N-acylsulfamoyl groups (preferably N-acylsulfamoyl groups each having from 1 to 50 carbon atoms, e.g., N-tetradecanoylsulfamoyl and N-benzoylsulfamoyl), alkylsulfonyl groups (preferably alkylsulfonyl groups each having from 1 to 50 carbon atoms, e.g., methanesulfonyl, isopropylsulfonyl, cyclohexylsulfonyl, octylsulfonyl, 2-methoxyethylsulfonyl and 2-hexyldecylsulfonyl), arylsulfonyl groups (preferably arylsulfonyl groups each having from 6 to 50 carbon atoms, e.g., benzenesulfonyl, p-toluenesulfonyl and 4-phenylsulfonyl), alkoxycarbonylamino groups (preferably alkoxycarbonylamino groups each having from 2 to 50 carbon atoms, e.g., ethoxycarbonylamino, isopropylcarbonylamino and cyclohexylcarbonylamino), aryloxycarbonylamino groups (preferably aryloxycarbonylamino groups each having from 7 to 50 carbon atoms, e.g., phenylcarbonylamino and naphthoxycarbonylamino), amino groups (preferably amino groups each having from 0 to 50 carbon atoms, e.g., amino, methylamino, diethylamino, diisopropylamino, anilino and morpholino), a cyano group, a nitro group, a carboxyl group, a hydroxyl group, a sulfo group, a mercapto group, alkylsulfinyl groups (preferably alkylsulfinyl groups each having from 1 to 50 carbon atoms, e.g., methanesulfinyl and octanesulfinyl), arylsulfinyl groups (preferably arylsulfinyl groups each having from 6 to 50 carbon atoms, e.g., benzenesulfinyl, 4-chlorophenylsulfinyl and p-toluenesulfinyl), alkylthio groups (preferably alkylthio groups each having from 1 to 50 carbon atoms, e.g., methylthio, octylthio and cyclohexylthio), arylthio groups (preferably arylthio groups each having from 6 to 50 carbon atoms, e.g., phenylthio and naphthylthio), ureido groups (preferably ureido groups each having from 1 to 50 carbon atoms, e.g., 3-methylureido, 3,3-dimethylureido and 1,3-diphenylureido), heterocyclic groups (preferably heterocyclic groups each having from 2 to 50 carbon atoms, each containing, for example, at least one atom of nitrogen, oxygen and sulfur atoms as a heteroatom, and which are 3- to 12-membered monocyclic or condensed rings, e.g., 2-furyl, 2-pyranyl, 2-pyridyl, 2-thienyl, 2-imidazolyl, morpholino, 2-quinolyl, 2-benzimidazolyl, 2-benzothiazolyl and 2-benzoxazolyl), acyl groups (preferably acyl groups each having from 1 to 50 carbon atoms, e.g., formyl, acetyl, pivaloyl, tetradecanoyl, cyclohexylcarbonyl, benzoyl and trifluoroacetyl), sulfamoylamino groups (preferably sulfamoylamino groups each having from 0 to 50 carbon atoms, e.g., N-butylsulfamoylamino and N-phenylsulfamoylamino), silyl groups (preferably silyl groups each having from 3 to 50 carbon atoms, e.g., trimethylsilyl, dimethyl-t-butylsilyl and triphenylsilyl), phosphonyl groups (preferably phosphonyl groups each having from 1 to 50 carbon atoms, e.g., phenoxyphosphonyl, octyloxyphosphonyl and phenylphosphonyl), azo groups (preferably azo groups each having from 1 to 50 carbon atoms, e.g., phenylazo), and imido groups (preferably imido groups each having 10 or less carbon atoms, e.g., N-succinimido and N-phthalimido).

When further substitution of these substituents is possible, they may be substituted by two or more substituents. The substituents by which the above-mentioned substituents are further substituted include the groups described above as the substituents at the time when $R^{11}$ represents a substituted alkyl group. At that time, those substituents may be the same or different.

In formula (IV), $R^{12}$ and $R^{13}$ each independently represents a hydrogen atom or a substituent, and the substituent represents a halogen atom (e.g., fluorine, chlorine, bromine or iodine), an alkyl group or the group having the same meaning as described as the substituent at the time when $R^{11}$ represents a substituted alkyl group.

A, M, m and $R^{14}$ in formula (IV) will be described in detail below. A represents a nitrogen atom or an oxygen atom. When A is an oxygen atom, m represents 0, and when A is a nitrogen atom, M represents a —CO— group or an —$SO_2$— group. $R^{14}$ represents an alkyl group, an aryl group, an alkoxyl group or an amino group, and m represents 1. The alkyl group, aryl group, alkoxyl group and amino group of $R^{14}$ have the same meanings as those described for $R^{11}$. —A(H)—(M—$R^{14}$)$_m$ may be cyclocondensed with a benzene ring to form a 5-, 6- or 7-membered ring.

$R^{15}$ represents a substituent, and n represents an integer of 0 to 4. The substituent of $R^{15}$ at that time represents a halogen atom (e.g., fluorine, chlorine, bromine or iodine), the alkyl group of $R^{11}$ described above and the group having the same meaning as described as the substituent at the time when $R^{11}$ represents a substituted alkyl group.

In formula (IV), $X^{11}$ is a group which can leave by a coupling reaction with an oxidation product of a color developing agent. The group which can leave by a coupling reaction with an oxidation product of a color developing agent represents a halogen atom, an alkoxy group, an aryloxy group, a heterocyclic oxy group, an acyloxy group, an alkoxycarbonyloxy group, a cycloalkyloxycarbonyloxy group, a sulfamoyloxy group, an alkylsulfonyloxy group, an arylsulfonyloxy group, a carbonamido group, a sulfonamido group, a heterocyclic group, an arylazo group, an alkylthio group, an arylthio group, a heterocyclic thio group, an alkylsulfonyl group, an arylsulfonyl group, an alkylsulfinyl group, an arylsulfinyl group, a phosphonyl group or an imido group. Specific examples thereof include leaving groups described in JP-A-56-38044, JP-B-58-10739, JP-B-56-54134, JP-B-56-45135, JP-A-56-126833, U.S. Pat. No. 4,351,897, JP-A-2-160233, European Patents 423,727, 428, 902 and 299,726, U.S. Pat. No. 4,072,525, JP-A-5-34878, JP-A-5-313322, European Patent 514,896, JP-A-6-347960 and Japanese Patent Application No. 5-212194.

These groups represented by $X^{11}$ may be substituted by substituents, which include halogen atoms, alkyl groups and the groups described above as the substituents at the time when $R^{11}$ represents a substituted alkyl group. When they are substituted by two or more substituents, those substituents may be the same or different.

$X^{11}$ has preferably a formula weight of 200 or more, and more preferably a formula weight of 250 or more. There is no particular limitation on the upper limit thereof, as long as the compounds represented by formula (IV) are left in hydrophilic colloidal layers. The formula weight is preferably 2,000.

The preferred range of the couplers represented by formula (IV) will be described below. In formula (IV), $R^{11}$ is preferably a secondary or tertiary alkyl group having preferably from 4 to 8 carbon atoms, more preferably 4 or 5 carbon atoms, more preferably a tertiary alkyl group, and most preferably a t-butyl group. $R^{12}$ and $R^{13}$ are each preferably a hydrogen atom, a halogen atom (e.g., fluorine, chlorine or iodine), an acylamino group, an alkoxycarbonylamino group, an aryloxycarbonylamino group or an ureido group, and more preferably a hydrogen atom. A is a nitrogen atom or an oxygen atom. Of these, preferred is a nitrogen atom. M is a —CO— group or an —$SO_2$— group. Of these, preferred is an —$SO_2$— group. $X^{11}$ is preferably an aryloxy group, a heterocyclic oxy group, an acyloxy group, an alkoxycarbonyloxy group, a carbamoyloxy group, an aryloxy-carbonyloxy group, an arylthio group, a heterocyclic thio group, an alkylsulfonyloxy group or an arylsulfonyloxy group, and more preferably an acyloxy group having a formula weight of 200 or more, an alkoxy group having a formula weight of 200 or more, an aryloxy group having a formula weight of 200 or more, a heterocyclic oxy group having a formula weight of 200 or more, an alkoxycarbonyloxy group having a formula weight of 200 or more, an aryloxycarbonyloxy group having a formula weight of 200 or more, a carbamoyloxy group having a formula weight of 200 or more or a heterocyclic carbonyloxy group having a formula weight of 200 or more. Of these, more preferred are a carbamoyloxy group and an alkoxycarbonyloxy group, and most preferred is an alkoxycarbonyloxy group having a formula weight of 200 or more.

Then, specific examples of the couplers represented by formula (IV) are shown below, but the scope of the invention is not limited thereby.

(51)

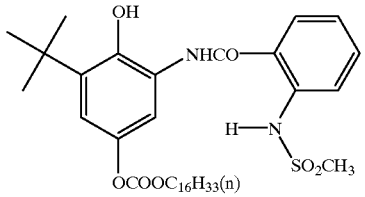

(52)

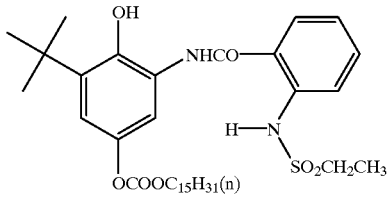

-continued
(53)
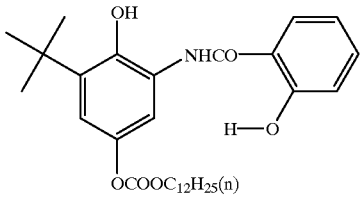
(54)
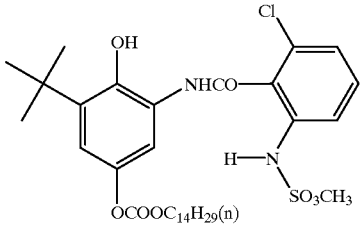
(55)
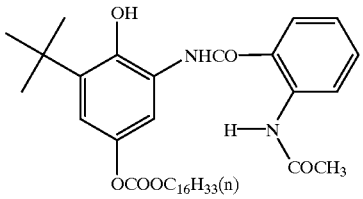
(56)
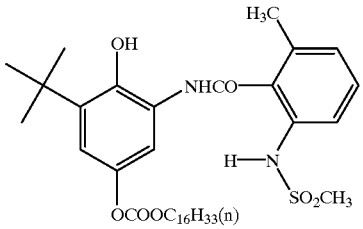
(57)
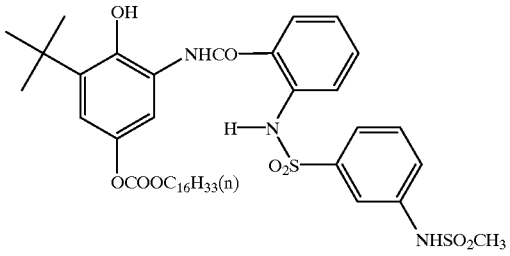
(58)
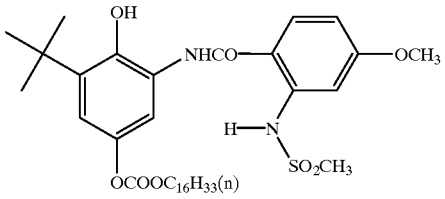
-continued
(59)
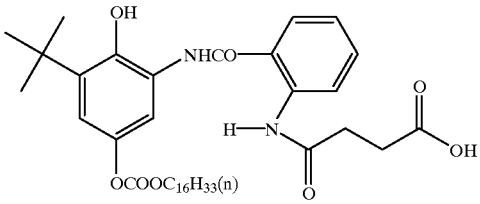
(60)
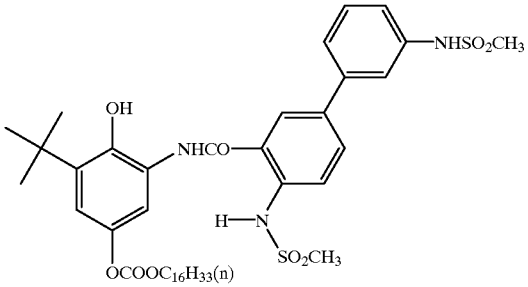
(61)
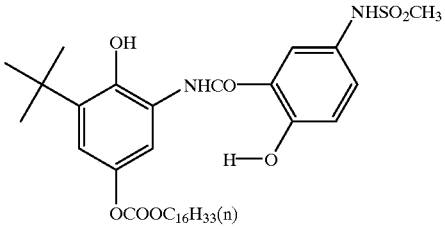
(62)
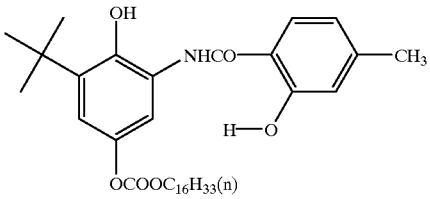
(63)
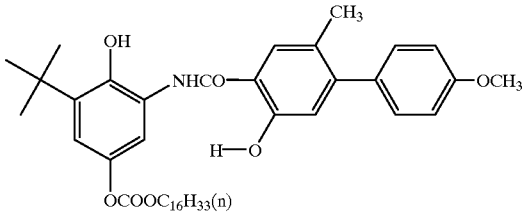
(64)
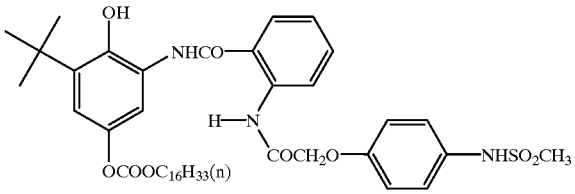

-continued
(65)
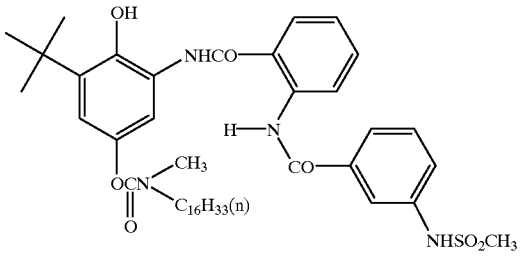
(66)
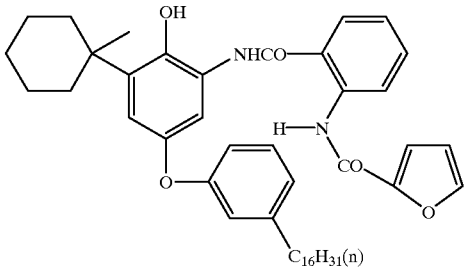
(67)
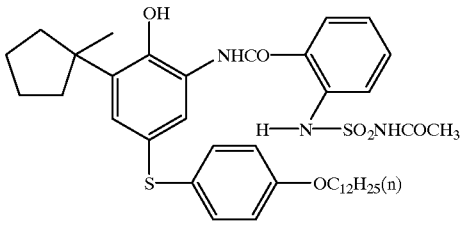
(68)
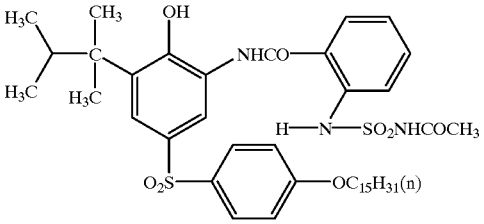
(69)
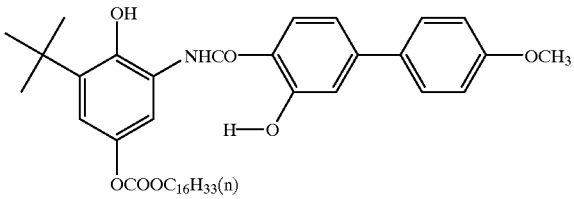
-continued
(70)
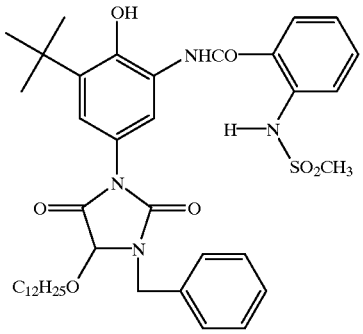
(71)
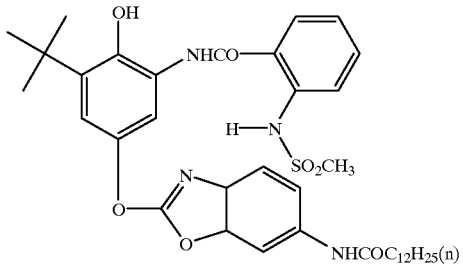
(72)
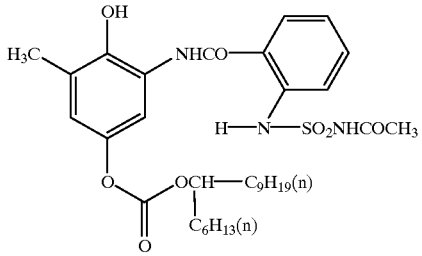
(73)
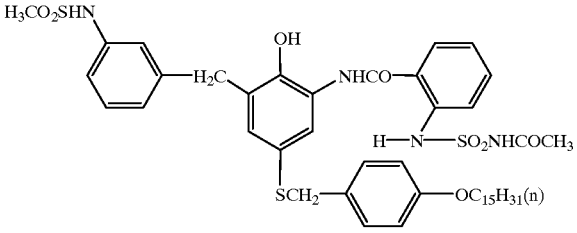
(74)
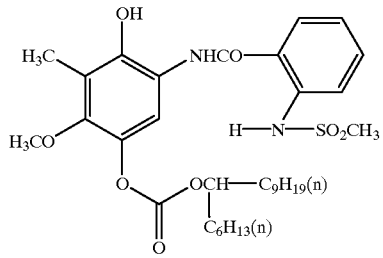

-continued (75)

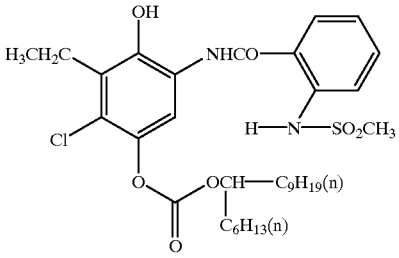

(76)

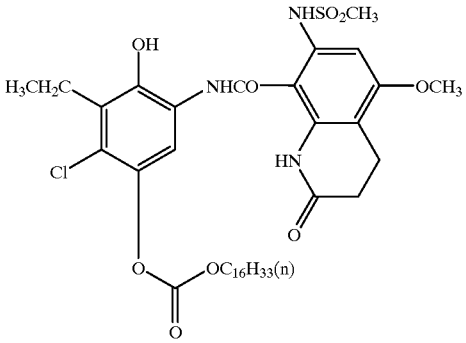

(77)

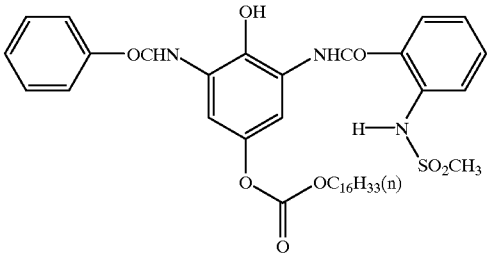

(78)

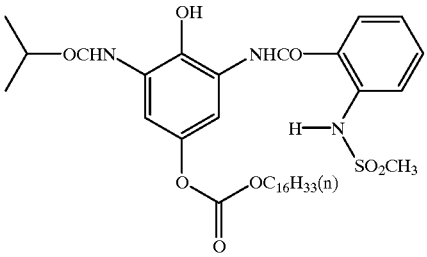

(79)

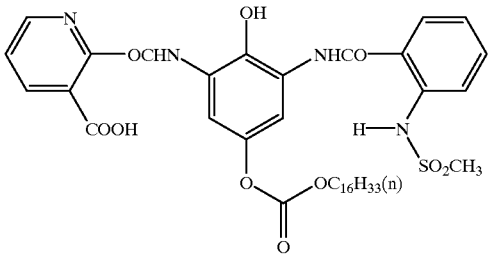

Then, typical synthesis examples of the compounds represented by formula (IV) used in the invention are shown below. Other compounds can also be synthesized by methods similar to those described below.

SYNTHESIS EXAMPLE 3

Synthesis of Example Compound (51)

Example compound (51) was synthesized by the following synthesis route:

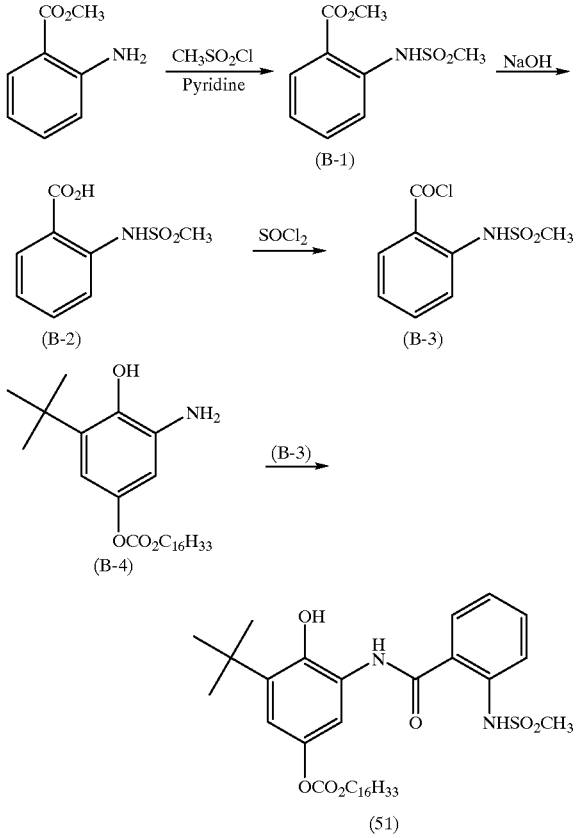

Synthesis of Compound (B-1)

In 71 ml of N,N-dimethylacetamide, 14.1 g (0.093 mol) of methyl o-aminobenzoate, 9.0 ml (0.11 mol) of pyridine were dissolved, and 11.7 g (0.10 mol) of methanesulfonyl chloride was added dropwise thereto at room temperature. After stirring at room temperature for 2 hours, the reaction mixture was poured into a large amount of water, followed by further stirring for 30 minutes. Precipitated crystals were separated by filtration, and washed with water, followed by drying to obtain 15.8 g (yield: 74%) of compound (B-1) as a solid.

Synthesis of Compound (B-2)

In 75 ml of methanol, 15 g (0.65 mol) of compound (B-1) was dissolved, and 26 ml of an aqueous solution containing 7.8 g (0.20 mol) of sodium hydroxide was added thereto at room temperature. After stirring at room temperature for 4 hours, the reaction mixture was poured into an aqueous solution of diluted hydrochloric acid, and stirred under ice cooling for 30 minutes. After the mixed solution was confirmed to be acidic with pH test paper, precipitated crystals were separated by filtration, and washed with water, followed by drying to obtain 13.1 g (yield: 93%) of compound (B-2) as a solid.

Synthesis of Compound (B-3)

In 40 ml of toluene, 12.9 g (0.06 mol) of compound (B-2) was dispersed, and 0.66 ml of N,N-dimethylformamide was added thereto, followed by stirring at 80° C. At that temperature, 6.6 ml (0.09 mol) of thionyl chloride was added dropwise, followed by stirring at 80° C. for 1 hour. Toluene and excess thionyl chloride were removed by distillation under reduced pressure conditions. Then, 60 ml of N,N-dimethylacetamide was added to crude product (B-3) thus obtained. The resulting solution was immediately subjected to the subsequent reaction without further purification.

Synthesis of Compound (51)

In 90 ml of N,N-dimethylacetamide, 18 g (0.04 mol) of compound (B-4) was dissolved. Then, 48 ml (0.048 mol) of a solution of compound (B-3) synthesized by the above-mentioned method in N,N-dimethylacetamide was added dropwise thereto at room temperature, followed by stirring at room temperature for 2 hours. After the reaction mixture was poured into water, precipitated crystals were separated by filtration, and dried. The resulting crude crystals were washed with hexane, and then, recrystallized from acetonitrile to obtain 16.5 g (yield: 63%) of compound (51) as white crystals.

$^1$H NMR (300 MHz, $CDCl_3$) δ=0.88 (t, 3H), 1.20–1.50 (m, 24H) 1.44 (s, 9H), 1.55–1.68 (m, 2H), 3.08 (s, 3H), 4.24 (t, 2H), 7.03 (d, 1H), 7.13 (d, 1H), 7.18–7.38 (m, 2H), 7.57 (t, 1H), 7.68 (d, 1H), 7.78 (d, 1H), 8.39 (s, 1H), 10.1 (s, 1H).

In formula (III), Z represents a carbamoyl group, an acyl group, an alkoxycarbonyl group or an aryloxycarbonyl group. Of these, the carbamoyl group is preferred, and the carbamoyl group having a hydrogen atom on a nitrogen atom is particularly preferred.

The carbamoyl group has preferably from 1 to 50 carbon atoms, and more preferably from 1 to 40 carbon atoms. Specific examples of such groups include carbamoyl, methylcarbamoyl, ethylcarbamoyl, n-propylcarbamoyl, sec-butylcarbamoyl, n-octylcarbamoyl, cyclohexylcarbamoyl, tert-butylcarbamoyl, dodecylcarbamoyl, 3-dodecyloxypropyl-carbamoyl, octadecylcarbamoyl, 3-(2,4-tert-pentylphenoxy)propylcarbamoyl, 2-hexyldecylcarbamoyl, phenylcarbamoyl, 4-dodecyloxyphenylcarbamoyl, 2-chloro-5-dodecyloxycarbonylphenylcarbamoyl, naphthylcarbamoyl, 3-pyridylcarbamoyl, 3,5-bisoctyloxycarbonylphenylcarbamoyl, 3,5-bistetradecyloxyphenylcarbamoyl, benzyloxycarbamoyl and 2,5-dioxo-1-pyrrolidinylcarbamoyl.

The acyl group has preferably from 1 to 50 carbon atoms, and more preferably from 1 to 40 carbon atoms. Specific examples of such groups include formyl, acetyl, 2-methylpropanoyl, cyclohexylcarbonyl, n-octanoyl, 2-hexyldecanoyl, dodecanoyl, chloroacetyl, trifluoroacetyl, benzoyl, 4-dodecyloxybenzoyl, 2-hydroxymethylbenzoyl and 3-(N-hydroxy-N-methylaminocarbonyl)propanoyl.

The alkoxycarbonyl group and the aryloxycarbonyl group each preferably has from 2 to 50 carbon atoms, and more preferably from 2 to 40 carbon atoms. Specific examples thereof include methoxycarbonyl, ethoxycarbonyl, isobutyloxycarbonyl, cyclohexyloxycarbonyl, dodecyloxycarbonyl, benzyloxycarbonyl, phenoxycarbonyl, 4-octyloxyphenoxycarbonyl, 2-hydroxymethylphenoxycarbonyl and 4-dodecyloxy-phenoxycarbonyl.

Q represents an atomic group forming an unsaturated ring together with Cα. The unsaturated ring formed is preferably each of 3- to 8-membered rings, and more preferably a 5- or 6-membered ring. Preferred examples of the rings include benzene, pyridine, pyrazine, pyrimidine, pyridazine, 1,2,4-triazine, 1,3,5-triazine, pyrrole, imidazole, pyrazole, 1,2,3-triazole, 1,2,4-triazole, tetrazole, 1,3,4-thiadiazole, 1,2,4-thiadiazole, 1,2,5-thiadiazole, 1,3,4-oxadiazole, 1,2,4-oxadiazole, 1,2,5-oxadiazole, thiazole, oxazole, isothizole, isoxazole and thiophene rings. Further, condensed rings obtained by condensing these rings with each other are also preferably used.

Further, these rings may have substituents, and examples of the substituents include halogen atoms and ones mentioned above as the examples of the substituents which $R^1$ may have.

The number of carbon atoms of the substituent is preferably 50 or less, and more preferably 42 or less. The total number of carbon atoms of the unsaturated ring formed by 2 and Cα and the substituent(s) thereof is preferably 30 or less, more preferably 24 or less, and most preferably 18 or less.

For all of the substituents of the ring formed by Q and Cα, when the ring is formed by carbon atoms alone (for example, a benzene ring, a naphthalene ring or an anthracene ring), the total of Hammett constituent constants, σ values (σp is used in a relation of 1.2, 1.4 . . . to Cα, and σm is used in a relation of 1.3, 1.5 . . . to Cα) is from 0.8 to 3.5, more preferably from 1.2 to 3.0, and most preferably from 1.5 to 3.0.

When the ring formed by Q and Cα is a heterocycle, one having at least one substituent having a positive σp value is preferred.

Hammett constituent constants σp and σm are explained in detail, for example, in Naoki Inamoto "Hammett Rule -Kozo to Hannosei (Structure and Reactivity)-" (Maruzen), "Shin Jikken Kagaku Koza 14, Yuki Kagobutsu no Gosei to Hanno (Synthesis and Reaction of Organic Compounds) V", page 2605 (edited by Nippon Kagakukai (The Chemical Society of Japan)), Tadao Nakaya, "Riron Yuki Kagaku Kaisetsu (Explanation of Theoretical Organic Chemistry)" page 217 (Tokyo Kagaku Dojin) and Chemical Review (vol. 91), pages 165 to 195 (1991).

Of the color developing agents represented by formula (III), ones represented by the following formula (IV) are particularly preferred in terms of color generation and color image fastness.

(IV)

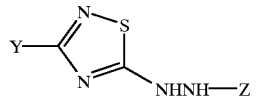

wherein Y represents a halogen atom, an alkyl group, an aryl group, a heterocyclic group, an alkylthio group, an arylthio group, a heterocyclic thio group, an alkylsulfinyl group, an arylsulfinyl group, an alkylsulfonyl group, an arylsulfonyl group or a sulfamoyl group; and Z represents a group having the same meaning as given for Z in the compound represented by formula (III).

The compounds represented by formula (IV) are described in detail.

In formula (IV), Y represents a halogen atom (e.g., fluorine, chlorine or bromine), an alkyl group (preferably a straight-chain, branched or cyclic alkyl group having from 1 to 32 carbon atoms, e.g., methyl, ethyl, propyl, isopropyl, butyl, t-butyl, 1-octyl, tridecyl, cyclopropyl, cyclopentyl, cyclohexyl, 1-norbornyl or 1-adamantyl), an aryl group (preferably an aryl group having from 6 to 32 carbon atoms, e.g., phenyl, 1-naphthyl or 2-naphthyl), a heterocyclic group (preferably a 5- to 8-membered heterocyclic group having from 1 to 32 carbon atoms, e.g., 2-thienyl, 4-pyridyl, 2-furyl, 2-pyrimidinyl, 2-pyridyl, 2-benzothiazolyl, 1-imidazolyl, 1-pyrazolyl or benzotriazole-2-yl), an alkylthio group (preferably an alkylthio group having from 1 to 32 carbon atoms, e.g., methylthio, ethylthio, octylthio, benzylthio or cyclo-hexylthio), an arylthio group (preferably an arylthio group having from 6 to 32 carbon atoms, e.g., phenylthio or 1-naphthylthio), a heterocyclic thio group (preferably a heterocyclic thio group having from 1 to 32 carbon atoms, e.g., 2-benzothiazolylthio, 2-pyridylthio or 1-phenyltetrazolylthio), an alkylsulfinyl group (preferably an alkylsulfinyl group having from 1 to 32 carbon atoms, e.g., methylsulfinyl, benzylsulfinyl or dodecanesulfinyl), an arylsulfinyl group (preferably an arylsulfinyl group having from 6 to 32 carbon atoms, e.g., phenylsulfinyl), an alkylsulfonyl group (preferably an alkylsulfonyl group having from 1 to 32 carbon atoms, e.g., methylsulfonyl, octylsulfonyl, benzylsulfonyl or cyclohexylsulfonyl), an arylslufonyl group (preferably an arylslufonyl group having from 6 to 32 carbon atoms, e.g., phenylsulfonyl or 1-naphthylsulfonyl), or a sulfamoyl group (preferably a sulfamoyl group having 32 or less carbon atoms, e.g. sulfamoyl, N,N-dipropylsulfamoyl or N-ethyl-N-dodecylsulfamoyl).

The group represented by Y may further have a substituent. In that case, preferred examples of the substituents are halogen atoms and ones mentioned in the description of formula (I) as the examples of the substituents which $R^1$ may have.

Preferred examples of the compounds represented by formula (IV) are described below. Y is preferably a halogen atom, an aryl group, a heterocyclic group, an alkylthio group, an arylthio group, an alkylsulfonyl group, an arylsulfonyl group or an arylsulfinyl group, more preferably a chlorine atom, an aryl group or an arylthio group, and most preferably an aryl group. Z is preferably a carbamoyl group, and a carbamoyl group having a hydrogen atom on a nitrogen atom is particularly preferred.

In the compound represented by formula (IV), it is preferred that at least one of the groups represented by Y and Z has at least one group represented by —$CO_2H$, —$NHSO_2Ra$, —$SO_2NHRb$, —$CONHSO_2Rb$, —$SO_2NHCORb$ or —OH, wherein Ra represents an alkyl group, an aryl group or a heterocyclic group, and Rb represents a hydrogen atom, an alkyl group, an aryl group or a heterocyclic group. The preferred number of carbon atoms and preferred specific examples of these alkyl, aryl and heterocyclic groups are the same as mentioned in the description of the substituents which $R^1$ of formula (I) may have. In the compound represented by formula (IV), it is more preferred that the group represented by Y has at least one group represented by —$CO_2H$, —$NHSO_2Ra$, —$SO_2NHRb$, —$CONHSO_2Rb$, —$SO_2NHCORb$ or —OH.

Specific examples of the color developing agents represented by formula (III) are shown below, but the scope of the invention is not limited to these specific examples.

D-(1)

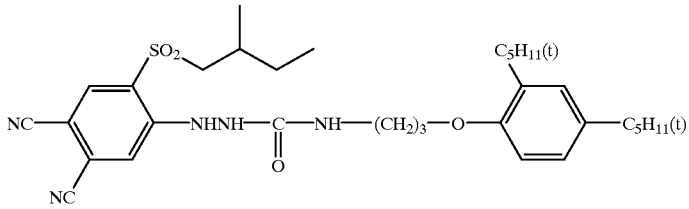

D-(2)

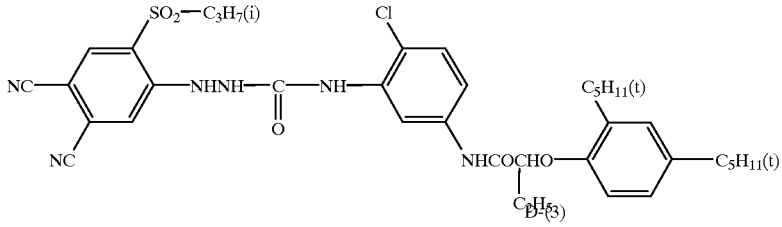

D-(3)

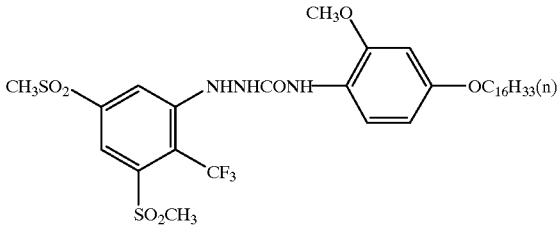

D-(4)

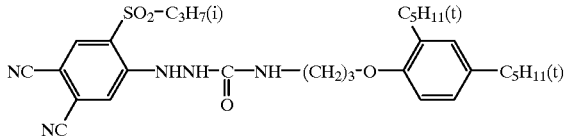

D-(5)

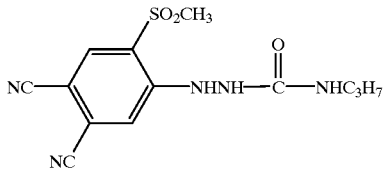

D-(6)

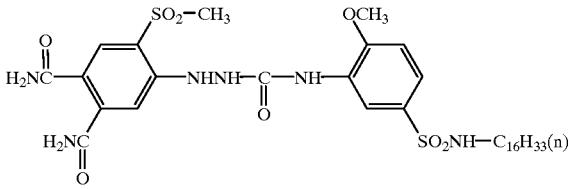

-continued
D-(7)
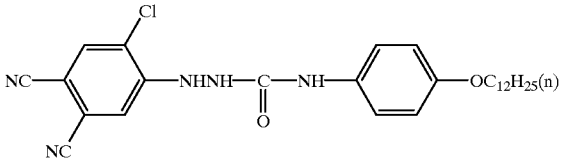
D-(8)
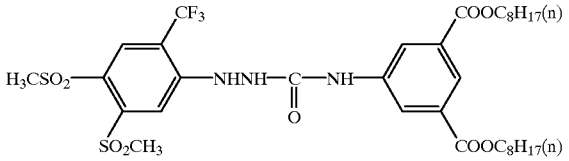
D-(9)
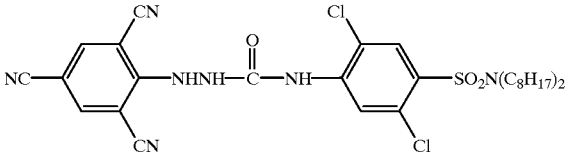
D-(10)
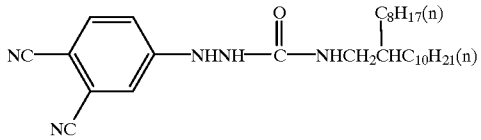
D-(11)
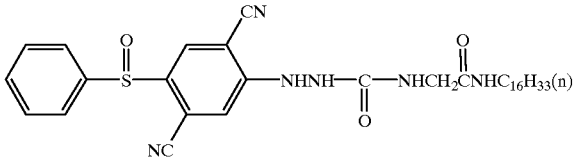
D-(12)
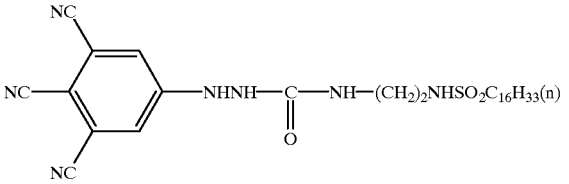
D-(13)
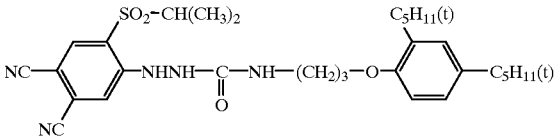
D-(14)
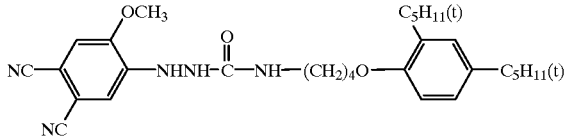
D-(15)
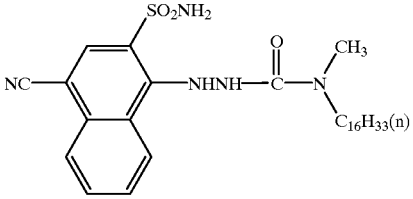
D-(16)
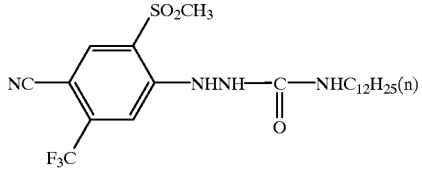
D-(17)
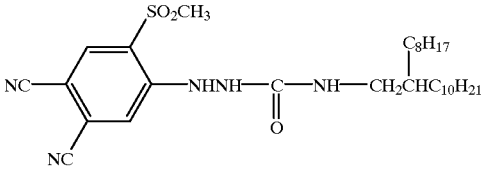
D-(18)
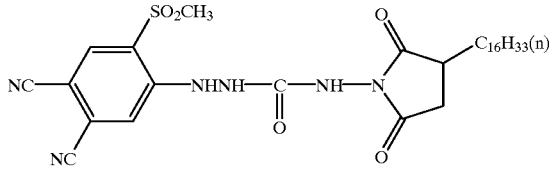
D-(19)
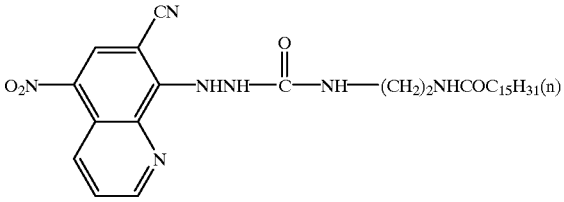
D-(20)
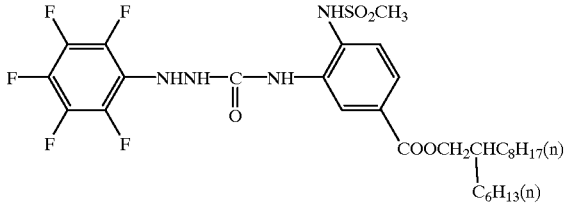

-continued
D-(21)
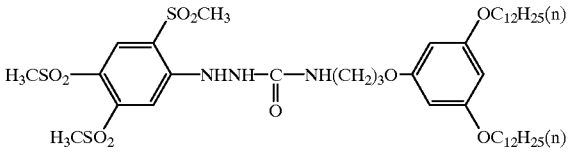
D-(22)
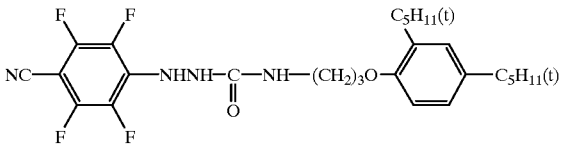
D-(23)
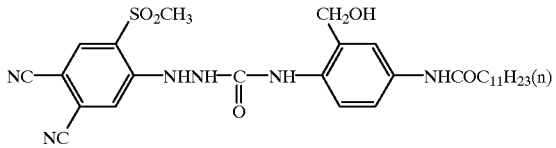
D-(24)
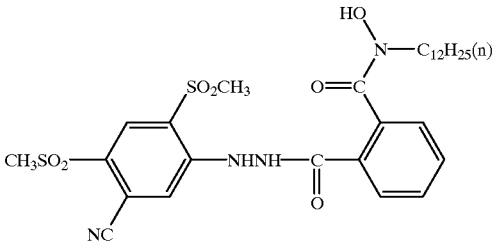
D-(25)
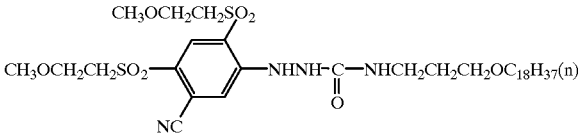
D-(26)
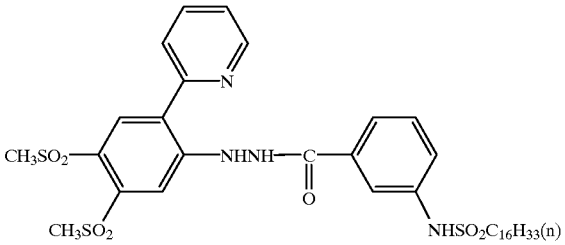
D-(27)
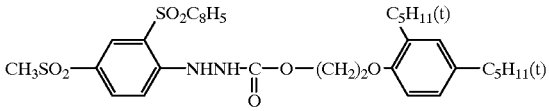
D-(28)
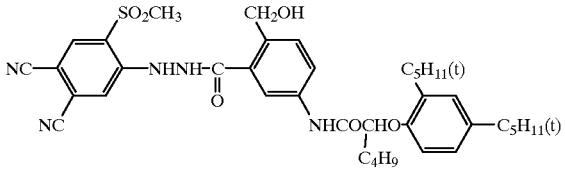
D-(29)
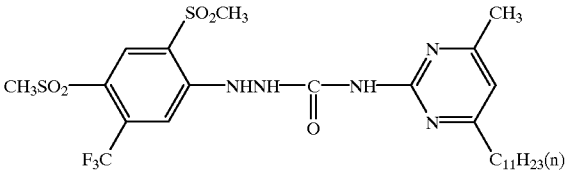
D-(30)
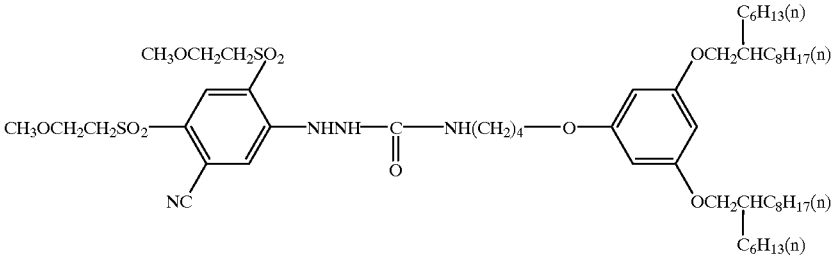

-continued
D-(31)
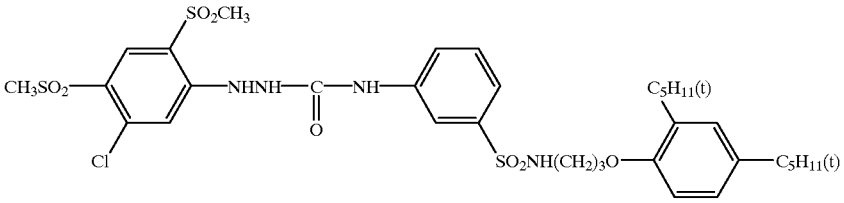
D-(32)
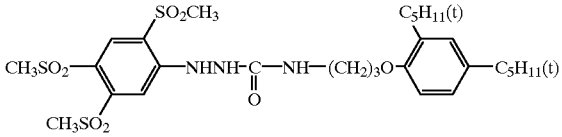
D-(33)
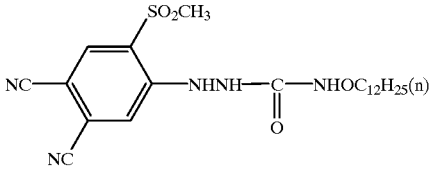
D-(34)
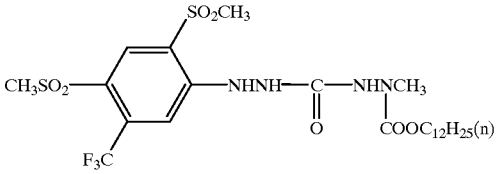
D-(35)
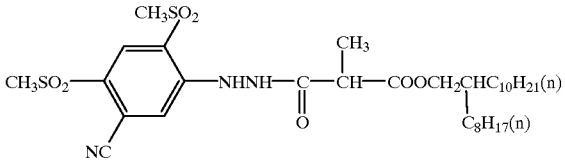
D-(36)
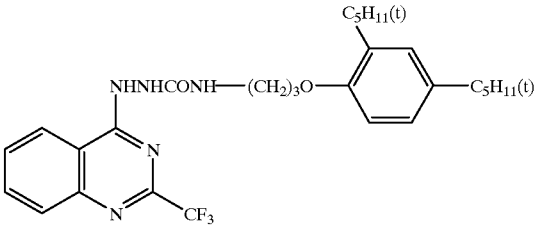
D-(37)
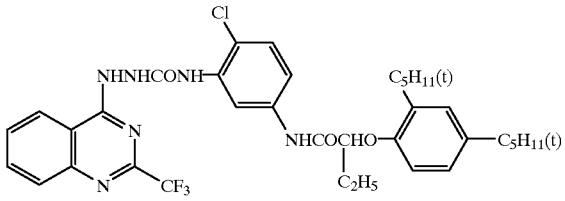
D-(38)
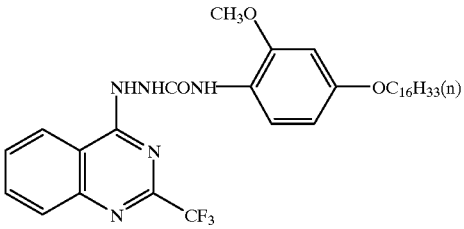
D-(39)
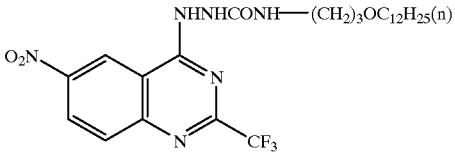
D-(40)
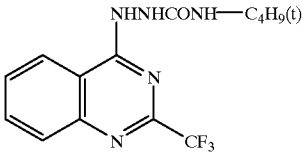
D-(41)
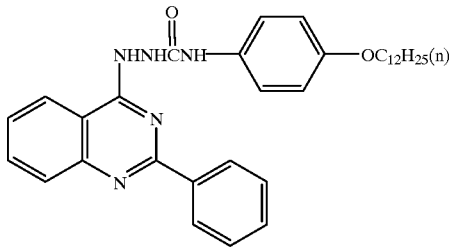

-continued
D-(42)
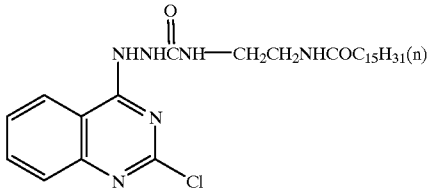
D-(43)
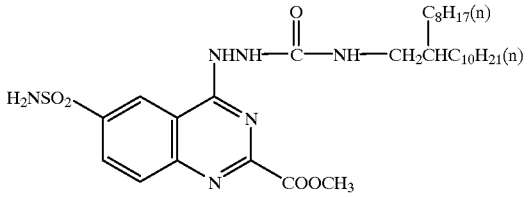
D-(44)
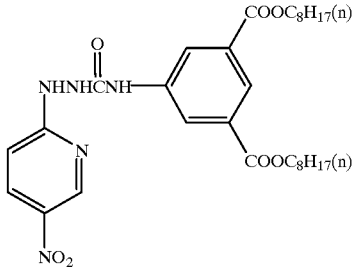
D-(45)
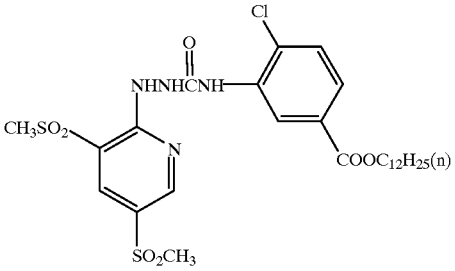
D-(46)
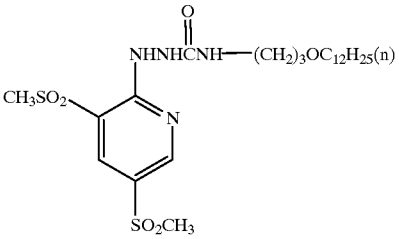
D-(47)
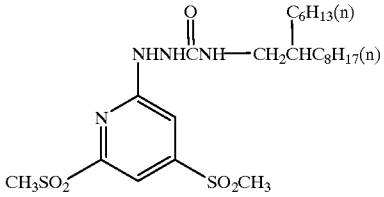
D-(48)
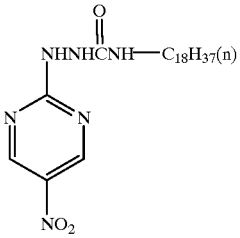
D-(49)
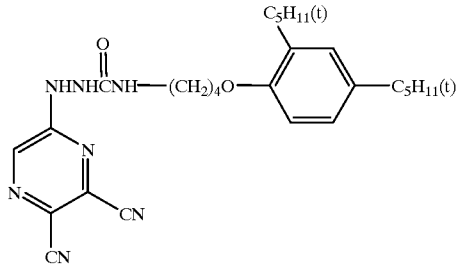
D-(50)
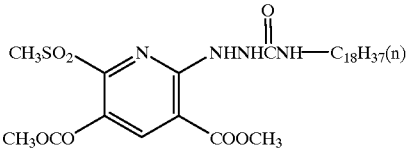
D-(51)
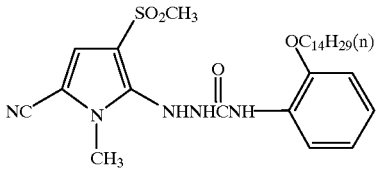
D-(52)
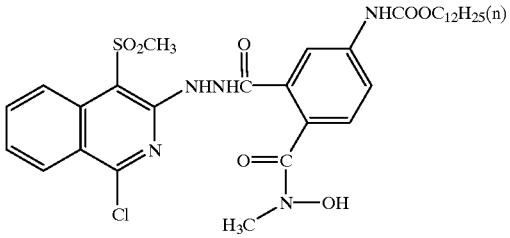
D-(53)
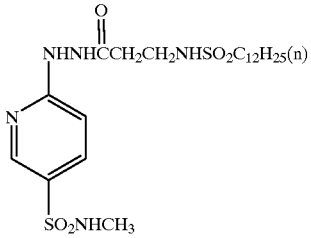

-continued
D-(54)
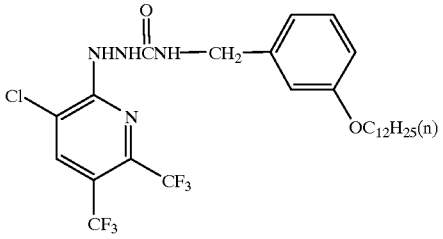
D-(55)
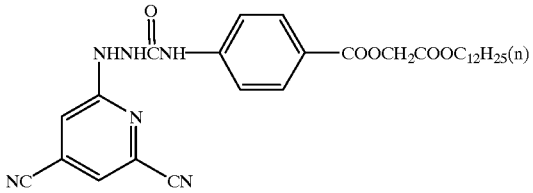
D-(56)
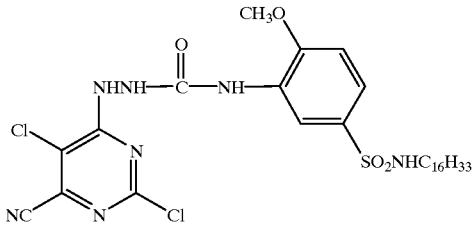
D-(57)
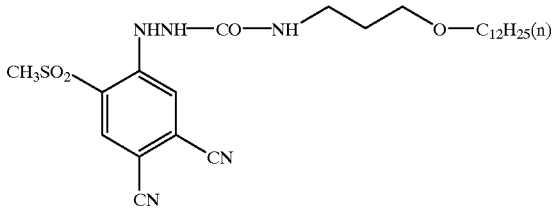
D-(58)
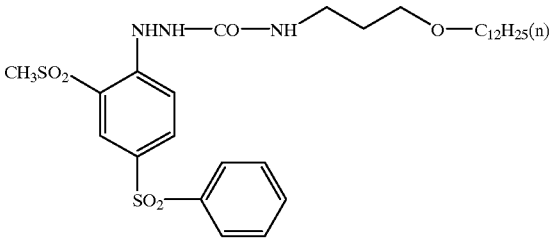
D-(59)
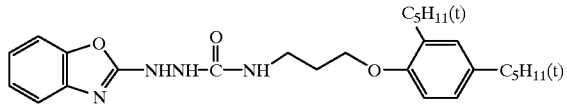
D-(60)
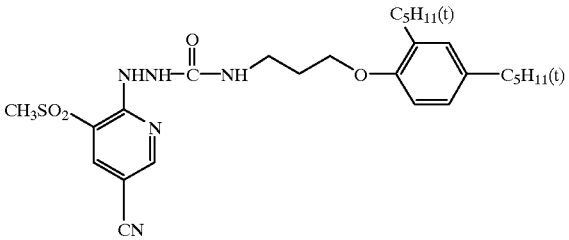
D-(61)
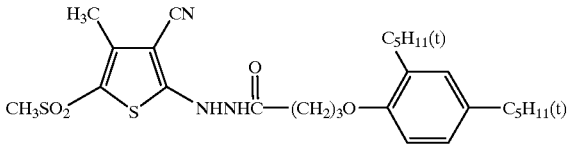
D-(62)
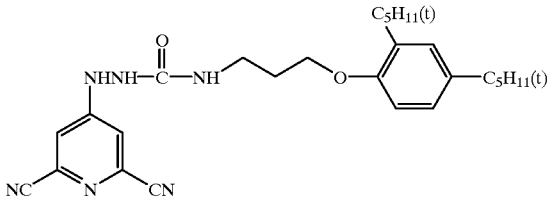
D-(63)
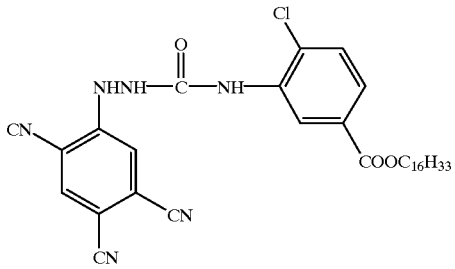

-continued
D-(64)
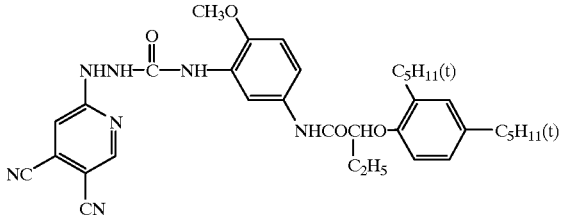
D-(65)
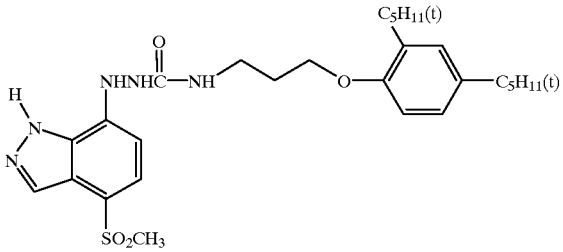
D-(66)
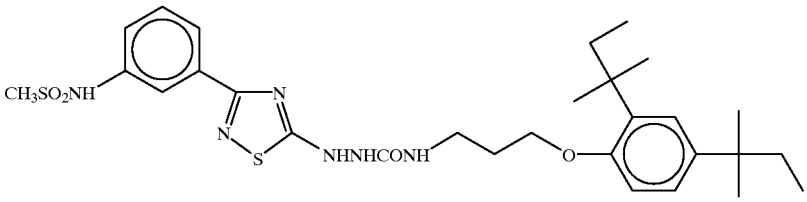
D-(67)
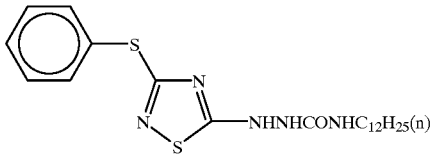
D-(68)
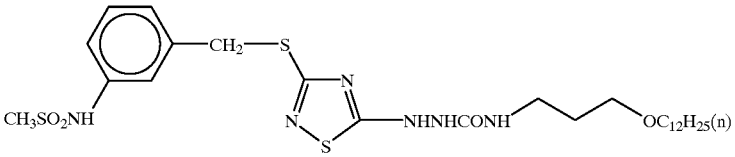
D-(69)
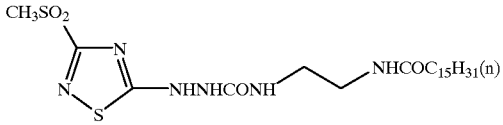
D-(70)
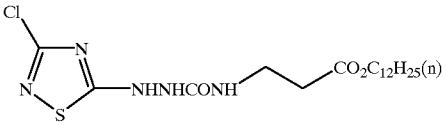
D-(71)
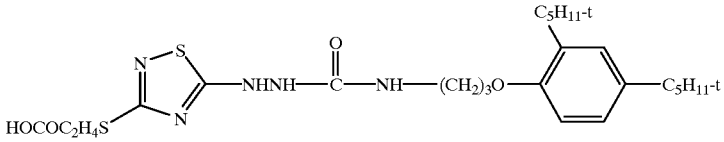
D-(72)
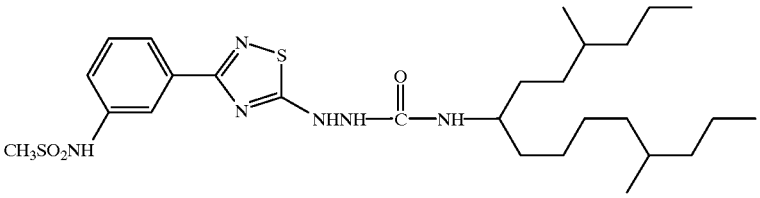
D-(73)
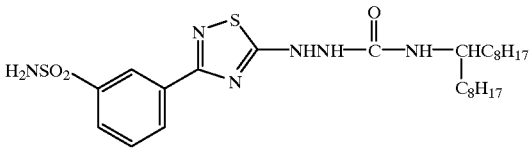
D-(74)
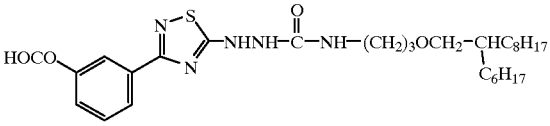

-continued
D-(75)
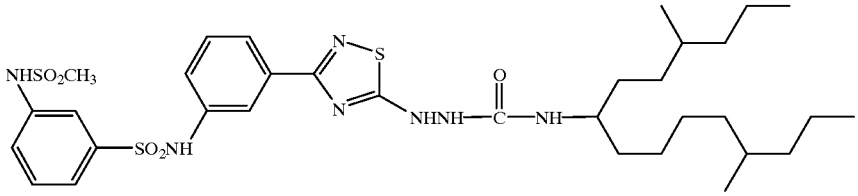
D-(76)
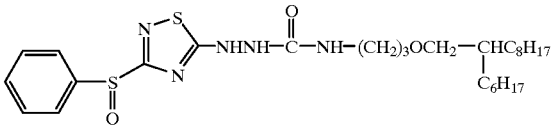
D-(77)
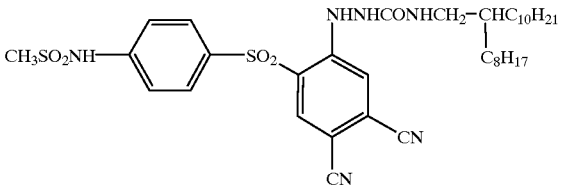
D-(78)
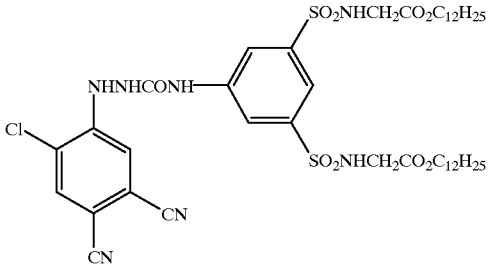
D-(79)
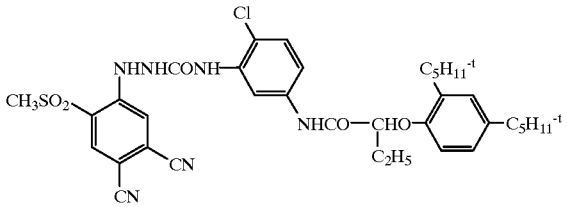
D-(80)
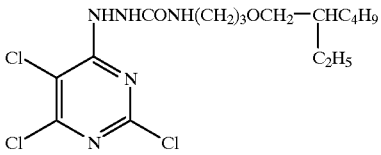
D-(81)
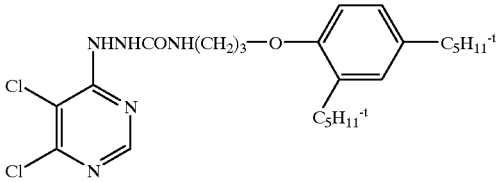
D-(82)
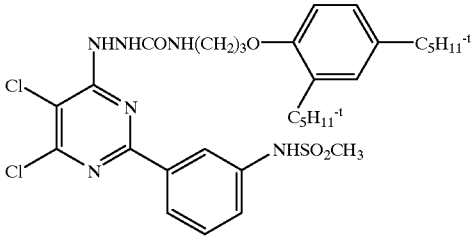
D-(83)
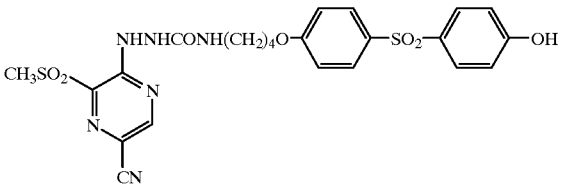
D-(84)
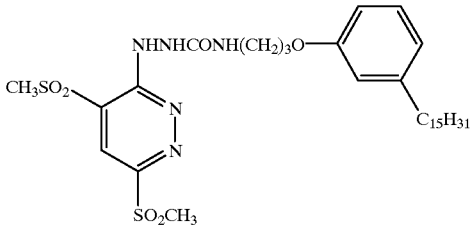
D-(85)
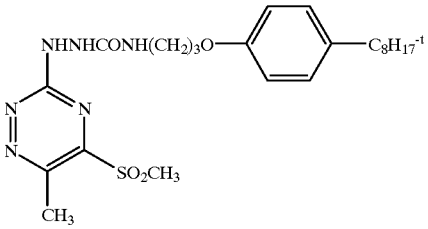

-continued
D-(86)
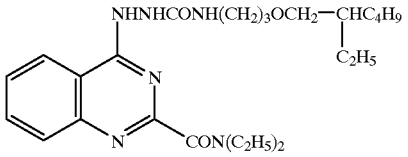
D-(87)
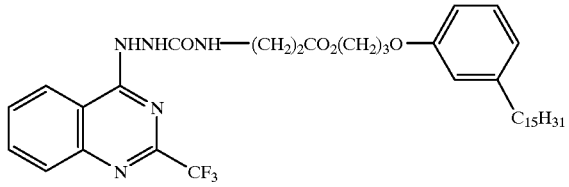
D-(88)
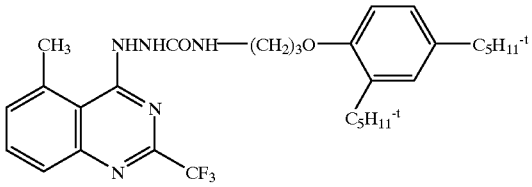
D-(89)
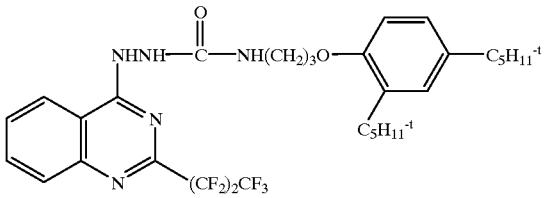
D-(90)
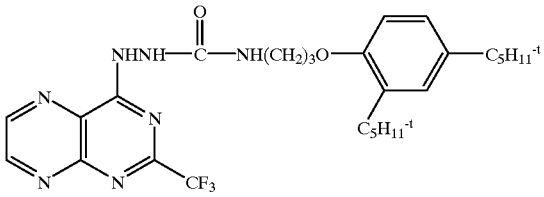
D-(91)
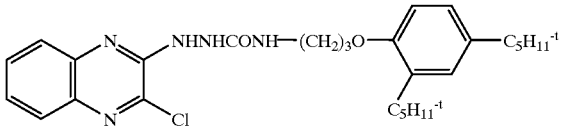
D-(92)
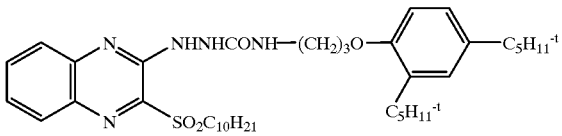
D-(93)
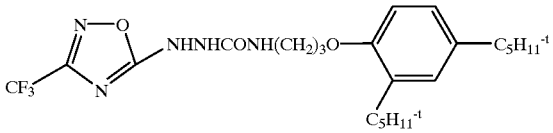
D-(94)
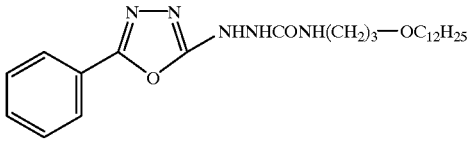
D-(95)
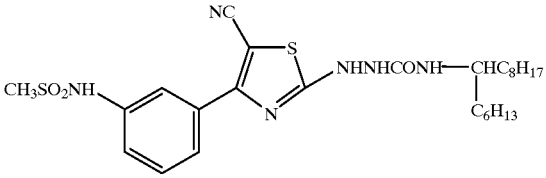
D-(96)
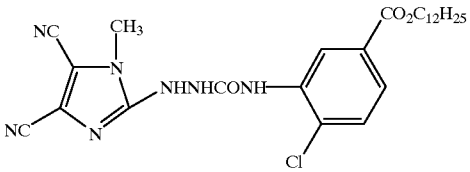
D-(97)
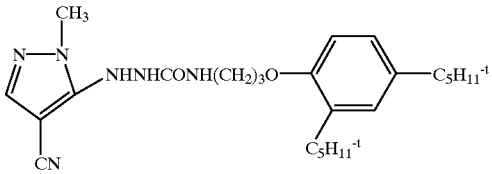
D-(98)
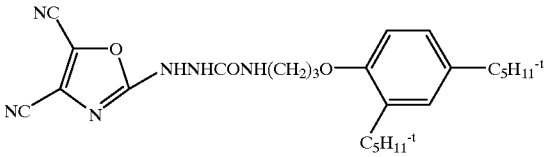
D-(99)
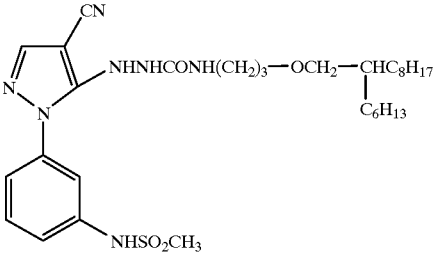

-continued
D-(100)
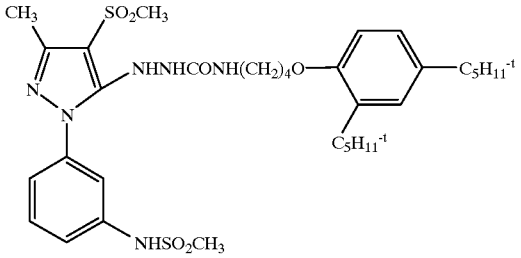
D-(101)
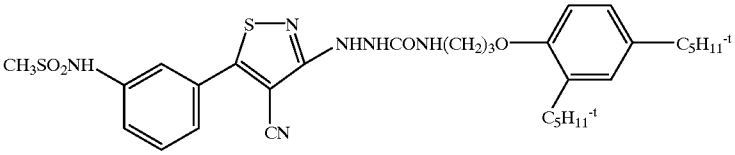
D-(102)
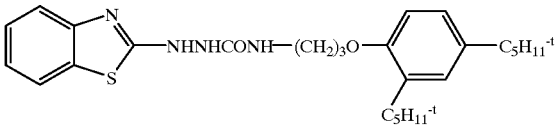
D-(103)
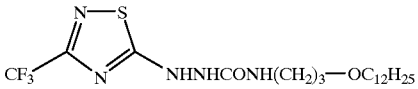
D-(104)
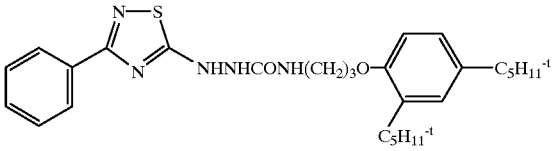
D-(105)
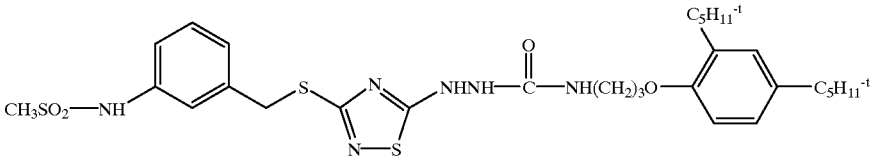
D-(106)
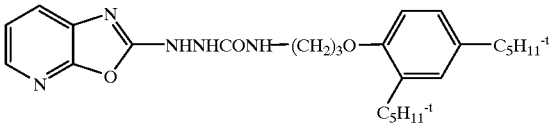
D-(107)
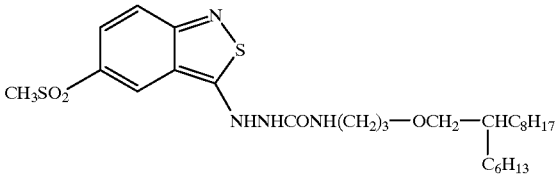
D-(108)
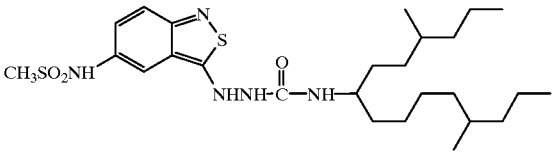
D-(109)
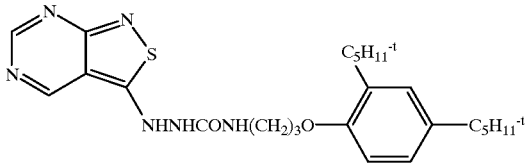
D-(110)
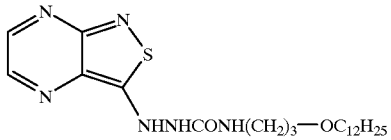
D-(111)
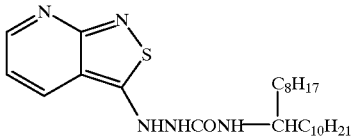

-continued

D-(112)

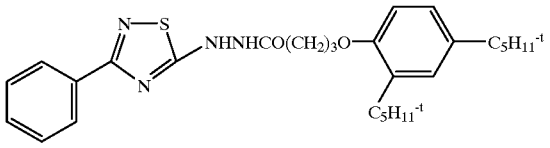

D-(113)

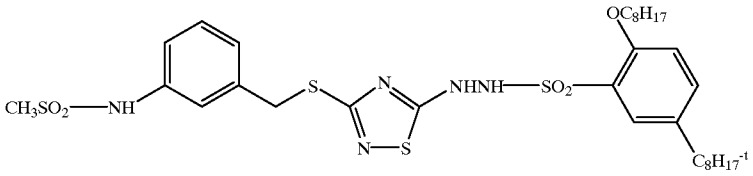

D-(114)

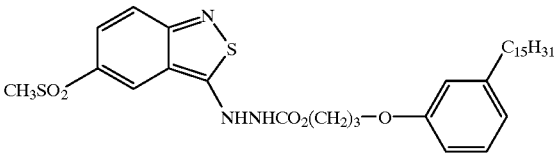

D-(115)

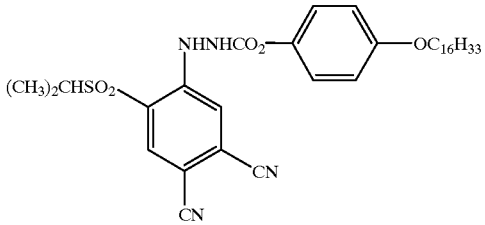

In addition to the above-mentioned specific compounds, compounds (1) to (80) described on pages 7 to 22 of JP-A-8-286340, compounds H-1 to H-72 described on pages 9 to 26 of JP-A-9-152700, compounds D-1 to D-19 described on pages 7 to 11 of JP-A-9-152701, compounds D-1 to D-39 described on pages 6 to 13 of JP-A-9-152702, compounds D-1 to D-49 described on pages 7 to 17 of JP-A-9-152703 and compounds (1) to (45) described on pages 6 to 18 of JP-A-9-152704 are also preferred as the color developing agents used in the invention.

The compounds represented by formula (III) in the invention can be synthesized according to synthesis methods described in JP-A-8-286340, JP-A-9-152700, JP-A-9-152701, JP-A-9-152702, JP-A-9-152703 and JP-A-9-150704.

In the invention, other couplers forming dyes by the oxidation coupling reaction can be used together. The couplers which can be used in the invention include couplers represented by formulas (1) to (12), which are described on pages 20 to 23 of JP-A-9-152705, and preferred specific examples of the couplers include example compounds (C-1) to (C-50) described on pages 24 to 37 thereof.

The amount of the couplers added in the invention depends upon the molar absorption coefficient ($\epsilon$) of the dyes to be formed. However, in order to obtain an image density of 1.0 or more in reflection density, it is suitably from 0.001 mmol/$m^2$ to 100 mmol/$m^2$, preferably from 0.01 mmol/$m^2$ to 10 mmol/$m^2$, and more preferably from 0.05 mmol/$m^2$ to 5.0 mmol/$m^2$ as the amount of the couplers coated, when the couplers produce the dyes having a molar absorption coefficient ($\epsilon$) of about 5,000 to about 500,000 by coupling. Although the color developing agents represented by formula (I) in the invention are added in a wide range of amounts, the amount thereof is preferably from 0.01 time to 100 times, and more preferably from 0.1 time to 10 times, based on the molar quantity of the couplers.

The couplers and the developing agents represented by formula (III) can be added by first mixing the couplers, the developing agents and high boiling organic solvents (e.g., alkyl phosphates and alkyl phthalates), dissolving the resulting mixture in low boiling organic solvents (e.g., ethyl acetate and methyl ethyl ketone), dispersing the solutions in water by the emulsion dispersion methods known in the art, and then adding the dispersions. Further, addition by solid dispersion methods described in JP-A-63-271339 is also possible.

In the invention, it is preferred that auxiliary developing agents are used. The term "auxiliary developing agent" as used herein means a substance having the action of enhancing electron transfer from a color developing agent to a silver halide in the course of silver halide development, and is an electron emission compound following the Kendall-Pertz rule. The auxiliary developing agents used in the invention include compounds represented by formulas (B-1) and (B-2) described in JP-A-9-152705, pages 37 and 38, and sulfonamidophenol compounds represented by formula [1] described in JP-A-9-146248, pages 3 to 6. Specific examples of these auxiliary developing agents include compounds (ETA-1) to (ETA-36) described in JP-A-9-152705, pages 37 to 39, and compounds D-1 to D-35 described in JP-A-9-146248, pages 9 to 15. Compounds particularly preferred as the auxiliary developing agents used in the invention are shown below, but the scope of the invention is not limited thereby.

ETA-1

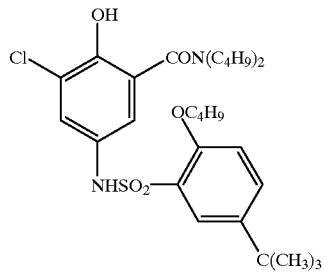

-continued
ETA-2
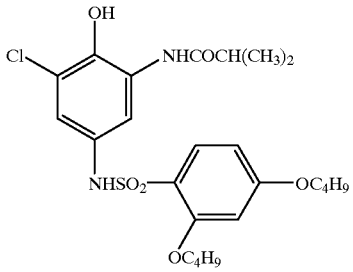
ETA-3
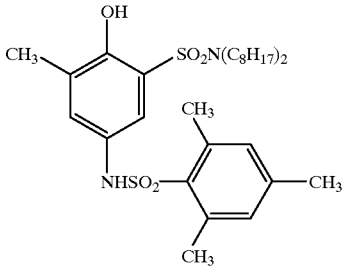
ETA-4
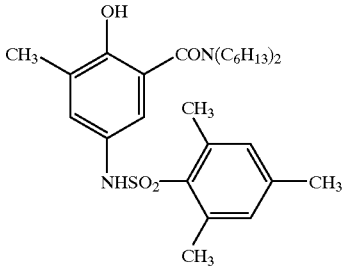
ETA-5
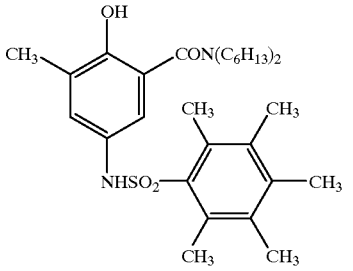
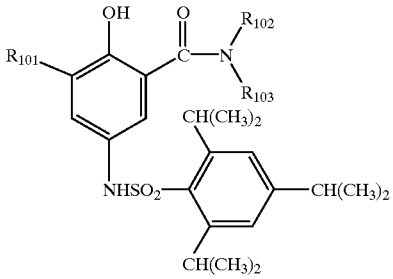
| | $R_{101}$ | $R_{102}$ | $R_{103}$ |
|---|---|---|---|
| ETA-6 | $CH_3$— | —$C_4H_9$ | —$C_4H_9$ |
| ETA-7 | $(CH_3)_3C$— | —$C_4H_9$ | —$C_4H_9$ |
| ETA-8 | $(CH_3)_2CH$— | —$C_4H_9$ | —$C_4H_9$ |
-continued
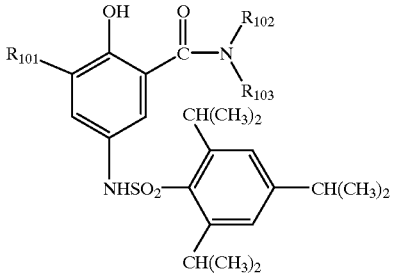
| | $R_{101}$ | $R_{102}$ | $R_{103}$ |
|---|---|---|---|
| ETA-9 | $CH_3$— | —$C_6H_{13}$ | —$C_6H_{13}$ |
| ETA-10 | $CH_3$— | —$C_8H_{17}$ | —$C_8H_{17}$ |
| ETA-11 | $CH_3$— | —$C_8H_{17}$ | —H |
| ETA-12 | $CH_3$— | —$C_{14}H_{29}$ | —H |
| ETA-13 | $CH_3$— | —$C_{18}H_{37}$ | —$CH_3$ |
| ETA-14 | $CH_3$— | —$CH_2CH_2OCH_3$ | —$CH_2CH_2OCH_3$ |
| ETA-15 | $CH_3CONH$— | —$CH_5$ | —$C_2H_5$ |
| ETA-16 | $CH_3CON(CH_3)$— | —$C_2H_5$ | —$C_2H_5$ |
| ETA-17 | $CH_3$— | —$C_6H_{13}$ | —$C_6H_{13}$ |
ETA-18
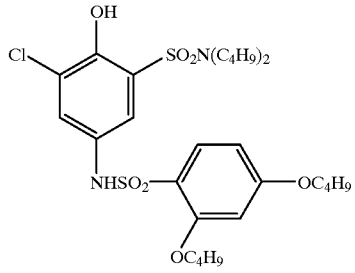
ETA-19
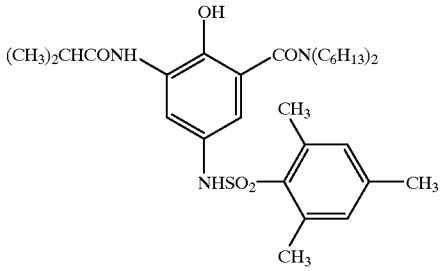
ETA-20
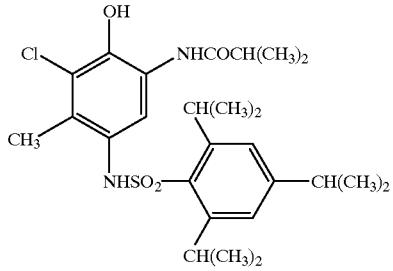

-continued

ETA-21

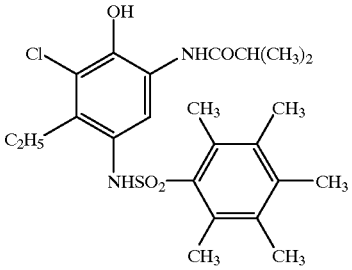

ETA-22

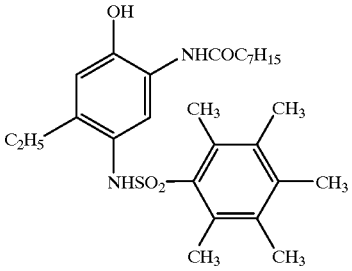

ETA-23

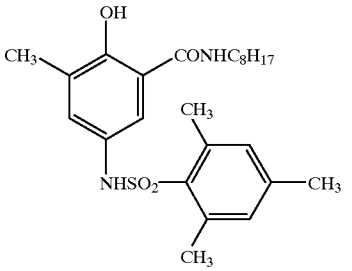

ETA-24

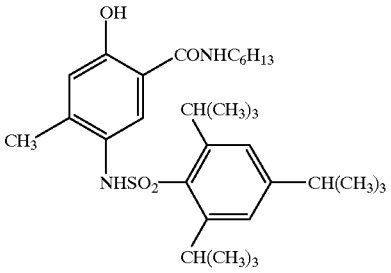

ETA-25

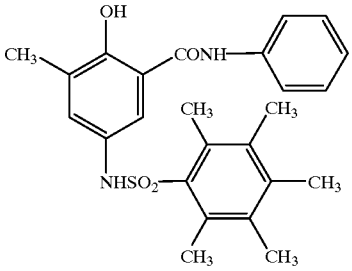

-continued

ETA-26

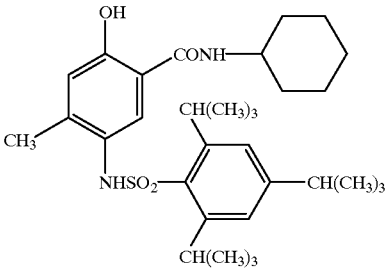

ETA-27

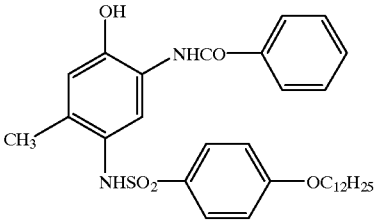

In the invention, blocked photographic reagents represented by formula (A), which leave photographically useful groups in processing, can be used. They are described in JP-A-09-152704, pages 41, paragraph numbers 0074 to 0077.

The heat developable color photographic materials of the invention basically have light-sensitive silver halide emulsions and binders on supports, and can further contain organic metal salt oxidizing agents and dye-donating compounds (reducing agents sometimes serve as them, as given later) as needed.

These components are added to the same layers in many cases, but can also be separately added to different layers. For example, a reduction in sensitivity can be prevented by allowing colored dye-donating compounds to exist in layers under the silver halide emulsion layers.

Although the reducing agents are preferably contained in the heat developable photographic materials, they may be supplied from the outside by methods such as diffusion from dye fixing elements described later.

In order to obtain a wide range of colors on the chromaticity diagram using the three primary colors of yellow, magenta and cyan, at least three silver halide emulsion layers each having light sensitivity in different spectrum regions are used in combination. The combinations include, for example, a combination of a blue-sensitive layer, a green-sensitive layer and a red-sensitive layer, a combination of a green-sensitive layer, a red-sensitive layer and an infrared-sensitive layer, and a combination of a red-sensitive layer, an infrared-sensitive layer (1) and an infrared-sensitive layer (2), as described in JP-A-59-180550, JP-A-64-13546, JP-A-62-253159 and EP-A-479,167. The respective layers can be variously disposed in order as known in the usual color photographic materials. Further, each of these respective light-sensitive layers may be divided into two or more layers as needed, as described in JP-A-1-252954. The heat developable photographic materials may be provided with various light-insensitive layers such as protective layers, undercoat layers, intermediate layers, yellow filter layers and antihalation layers between the above-mentioned silver halide emulsion layers or as uppermost or lowermost layers. Further, they can be provided with various supplementary layers such as back layers on the sides opposite to the supports. Specifically, they can be provided with the layer constitution described in the above-mentioned patents, undercoat layers as described in U.S. Pat. No. 5,051,335, intermediate layers having solid pigments as described in JP-A-1-167838 and JP-A-61-20943, intermediate layers having reducing agents or DIR compounds as described in JP-A-1-129553, JP-A-5-34884 and JP-A-2-64634, intermediates having electron transfer agents as described in U.S. Pat. Nos. 5,017,454 and 5,139,919 and JP-A-2-235044, protective layers having reducing agents as described in JP-A-4-249245, or combined layers thereof. It is preferred that the supports have the antistatic function and are designed so as to have a surface resistivity of $10^{12}$ Ω·cm or less.

The silver halide emulsions used in the heat developable photographic materials are described in detail below. The silver halide emulsion which can be used in the invention may be any of silver chloride, silver bromide, silver iodobromide, silver chlorobromide, silver chloroiodide and silver chloroiodobromide.

The silver halide emulsions used in the invention may be either surface latent image type emulsions or internal latent image type emulsions. The internal latent image type emulsions are used as direct reversal emulsions in combination with nucleating agents or light fogging. When silver halide grains contained in the silver halide emulsions of the invention are formed of mixed crystals comprising different silver halides, grains having uniform composition therein can be used. However, grains having a so-called laminate structure in which a plurality of layers different in composition are contained in the insides of grains can also be preferably used. Examples of the latter grains include so-called core/shell emulsions in which the insides of grains are different from the surfaces thereof in composition. In addition to the layer structure as described above, a structure can also be preferably used in which localized phases different in halogen composition are contained in the insides of grains. Preferred examples of such grains include grains in which silver halides different in composition are connected to faces, edges or vertexes of host silver halide grains by epitaxiar halide grains constituting the silver halide emulsions may be either monodisperse or polydisperse in their grain size distribution, and methods are preferably used in which monodisperse emulsions different in grain size or sensitivity are mixed to adjust gradation as described in JP-A-1-167743 and JP-A-4-223463. The grain size is preferably 0.1 μm to 2 μm, and more prefera tetradecahedral form, an irregular crystal form such as a spherical form or a tabular form high in aspect ratio, a form having a crystal defect such as a twin plane, and a combined form thereof.

Specifically, there can be used any of silver halide emulsions prepared by methods described in U.S. Pat. No. 4,500,626, column 50, U.S. Pat. No. 4,628,021, *Researchid.*, No. 18716, page 648 (November, 1979), ibid., No. 307105, pages 863–865 (November, 1989), JP-A-62-253159, JP-A-64-13546, JP-A-2-236546, JP-A-3-110555, P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

For various purposes such as an increase in sensitivity, hard gradation enhancement, an improvement in reciprocity, an improvement in latent image stability and an improvement in pressure resistance, the light-sensitive silver halide emulsions used in the invention preferably contain transition metal ions such as titanium, iron, cobalt, ruthenium, rhodium, osmium, iridium and platinum ions, or typical metal ions such as zinc, cadminsition metal ions are added, they are preferably used as complexes having ammonia, halogen, cyanogen, thiocyanogen and nitrosyl as ligands, or as complexes having organic ligands such as imidazole, triazole, pyridine and bipyridine. These ligands are used alone or as a combination of a plurality of them. These compounds may also be used alone or as a combination of two or more of them. The amount added is generally about $10^{-9}$ mol to $10^{-3}$ mol per mol of silver halide, although it depends on the purpose of use. They may be uniformly added to grains or localized in the insides or surfaces of grains. Specifically, emulsions described in JP-A-2-236542, JP-A-1-116637 and Japanese Patent Application No. 4-126629 are preferably used.

In the grain formation stage of the light-sensitive silver halide emulsions of the invention, rhodanides, ammonia, 4-substituted thioether compounds, organic thioether derivatives described in JP-B-47-11386 or sulfur-containing compounds described in JP-A-53-144319 can be used as solvents for silver halides.

For other conditions, reference can be made to the descriptions of P. Glafkides, *Chemie et Phisique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964) which are described above. That is to say, any of an acid process, a neutral process and an ammonia process may be used. A soluble silver salt and a soluble halogen salt may be reacted with each other by using any of a single jet process, a double jet process and a combination thereof. In order to obtain monodisperse emulsions, the double jet process is preferably used.

A reverse mixing process in which grains are formed in the presence of excess silver ions can also be used. As a type of double jet process, a so-called controlled double jet process can also be used in which the pAg in a liquid phase in which a silver halide is formed is maintained constant.

Further, for speeding growth of grains, the concentration, the amount and the rate of silver salts and halogen salts added maybe increased (JP-A-55-142329, JP-A-55-158124 and U.S. Pat. No. 3,650,757).

Reaction solutions may be stirred by any of the known stirring methods. The temperature and the pH of the reaction solutions during formation of silver halide grains may be arbitrarily established depending on the purpose. The pH range is preferably from 2.2 to 8.5, and more preferably from 2.5 to 7.5.

In the course of preparation of the light-sensitive silver halide emulsions of the present invention, so-called salt removal for removing excess salts is preferably conducted. As means for this, water washing with noodle may be used which is conducted by gelation of gelatin, and precipitation methods may also be used utilizing multiply charged anionic inorganic salts (for example, sodium sulfate), anionic surfactants, anionic polymers (for example, sodium polystyrenesulfonate) or gelatin derivatives (for example, aliphatic acylated gelatin, aromatic acylated gelatin and aromatic carbamoylated gelatin). The precipitation methods are preferably used.

Light-sensitive silver halide emulsions are usually chemically sensitized. For chemical sensitization of the light-sensitive silver halide emulsions of the invention, chalcogen sensitization such as sulfur sensitization, selenium sensitization or tellurium sensitization, noble metal sensitization using gold, platinum or palladium, and reduction sensitization, which are known in the silver halide emulsions for photographic materials, can be used alone or in combination (for example, JP-A-3-110555 and Japanese Patent Application No. 4-75798). Such chemical sensitization can also be conducted in the presence of a nitrogen-containing heterocyclic compound (JP-A-62-253159). Further, antifoggants set out later can be added after chemical sensitization. Specifically, methods described in JP-A-5-45833 and JP-A-62-40446 can be used.

The pH on chemical sensitization is preferably from 5.3 to 10.5, and more preferably from 5.5 to 8.5, and the pAg is preferably from 6.0 to 10.5, and more preferably from 6.8 to 9.0.

The coated amount of the light-sensitive silver halide emulsions used in the invention is preferably from 1 mg/m$^2$ to 10 g/m$^2$, and preferably from 10 mg/m$^2$ to 10 g/m$^2$ in terms of silver.

In order to give the color sensitivities of green, red and infrared sensitivities to the light-sensitive silver halide emulsions used in the invention, the light-sensitive silver halide emulsions are spectrally sensitized with methine dyes or the like. Further, spectral sensitization of a blue region may be applied to blue-sensitive emulsions as needed.

The dyes used include cyanine dyes, merocyanine dyes, complex cyanine dyes, complex merocyanine dyes, holopolarcyanine dyes, hemicyanine dyes, styryl dyes and hemioxanol dyes.

Specifically, they include sensitizing dyes described in U.S. Pat. No. 4,617,257, JP-A-59-180550, JP-A-64-13546, JP-A-5-45828 and JP-A-5-45834.

These sensitizing dyes may be used alone or in combination. The combinations of the sensitizing dyes are often used, particularly for supersensitization and wavelength adjustment of spectral sensitivity.

The emulsions may contain dyes having no color sensitization themselves or compounds which do not substantially absorb visible light and exhibit supersensitization, in combination with the sensitizing dyes (for example, ones described in U.S. Pat. No. 3,615,641 and JP-A-63-23145).

These sensitizing dyes may be added to the emulsions during, before or after chemical ripening, or before or after nucleation of the silver halide grains according to U.S. Pat. Nos. 4,183,756 and 4,225,666. These sensitizing dyes and supersensitizers may be added as solutions in organic solvents such as methanol, dispersions in gelatin or solutions in surfactants. The sensitizing agents are generally added in an amount of about $10^{-8}$ mol to about $10^{-2}$ mol per mol of silver halide.

Additives used in such processes and known photographic additives which can be used in the heat developable photographic materials of the invention and dye fixing materials are described in *Research Disclosure*, No. 17643, ibid., No. 18716 and ibid., No. 307105 described above and corresponding portions thereof are summarized in the following table.

| Kind of Additive | RD17643 | RD18716 | RD307105 |
|---|---|---|---|
| 1. Chemical Sensitizers | p. 23 | p. 648, right column | p. 866 |
| 2. Sensitivity Increasing Agents | | p. 648, right column | |
| 3. Spectral Sensitizers, Supersensitizers | pp. 23–24 | p. 648, right column to p. 649 | pp. 866–868 |

-continued

| Kind of Additive | RD17643 | RD18716 | RD307105 |
|---|---|---|---|
| 4. Fluorescent Brightening Agents | p. 24 | p. 648, right column | p. 868 |
| 5. Antifoggants, Stabilizers | pp. 24–25 | p. 649, right column | pp. 868–870 |
| 6. Light Absorbers, Filter dyes, UV Absorbers | pp. 25–26 | p. 649, right column to p. 650, left column | p. 873 |
| 7. Dye Image Stabilizers | p. 25 | p. 650, left column | p. 872 |
| 8. Hardeners | p. 26 | p. 651, left column | pp. 874–875 |
| 9. Binders | p. 26 | p. 651, left column | pp. 873–874 |
| 10. Plasticizers, Lubricants | p. 27 | p. 650, right column | p. 876 |
| 11. Coating Aids, Surfactants | pp. 26–27 | p. 650 right column | pp. 875–876 |
| 12. Antistatic Agents | p. 27 | p. 650 right column | pp. 876–877 |
| 13. Matte Agents | | | pp. 878–879 |

As the binders for the layers constituting the heat developable photographic materials and dye fixing materials, hydrophilic binders are preferably used. Examples thereof include binders described in *Research Disclosures* stated above and JP-A-64-13546, pages 71 to 75. Specifically, transparent or translucent hydrophilic binders are preferred, and examples thereof include natural compounds such as proteins (e.g., gelatin and gelatin derivatives) and polysaccharides (e.g., cellulose derivatives, starch, gum arabic, dextran and pullulan), and synthetic polymers such as polyvinyl alcohol, polyvinylpyrrolidone and polyacrylamide. Further, there can also be used high water-absorptive polymers described in U.S. Pat. No. 4,960,681 and JP-A-62-245260, namely homopolymers of vinyl monomers having —COOM or —$SO_3$M (wherein M represents a hydrogen atom or an alkali metal), or copolymers of these vinyl monomers with each other or with other monomers (e.g., sodium methacrylate, ammonium methacrylate and Sumikagel L-5 H manufactured by Sumitomo Chemical Co, Ltd.). These binders can also be used as a combination of two or more of them. In particular, combinations of gelatin and the above-mentioned binders are preferred. Gelatin is selected from lime-treated gelatin, acid-treated gelatin and so-called delimed gelatin reduced in content of calcium, depending on various purposes, and they are also preferably used in combination.

When a system is employed in which heat development is conducted supplying a slight amount of water, the use of the high water-absorptive polymers permits rapid absorption of water. Further, the use of the high water-absorptive polymers in dye fixing layers or protective layers therefor can prevent transferred dyes from being transferred again from the dye fixing elements to the others.

In the invention, the amount of the binders coated is preferably 20 g/m$^2$ or less, more preferably 10 g/m$^2$ or less, and still more preferably from 7 g/m$^2$ to 0.5 g/m$^2$.

In the invention, organic metal salts can also be used as oxidizing agents in combination with the light-sensitive silver halide emulsions. Of these organic metal salts, organic silver salts are particularly preferably used.

Organic compounds which can be used for formation of the above-mentioned organic silver salt oxidizing agents include benzotriazole compounds, fatty acids and other compounds described in U.S. Pat. No. 4,500,626, columns 52 and 53. Silver acetylide described in U.S. Pat. No.

4,775,613 is also useful. The organic silver salts may be used as a combination of two or more of them.

The organic silver salts described above can be used in an amount of 0.01 mol to 10 mol, preferably 0.01 mol to 1 mol, per mol of light-sensitive silver halide.

The total coated amount of the light-sensitive silver halide emulsions and the organic silver salts is suitably from 0.05 $g/m^2$ to 10 $g/m^2$, and preferably from 0.1 $g/m^2$ to 4 $g/m^2$, in terms of silver.

As the reducing agents used in the invention, reducing agents known in the field of heat developable photographic materials can be used. Further, the reducing agents also include reductive dye-donating compounds given later (in this case, they can be used in combination with other reducing agents). Furthermore, precursors of reducing agents can also be used which themselves have no reductive ability, but exhibit reductive ability by action of nucleophilic reagents or heat during the course of development.

Examples of the reducing agents used in the invention include reducing agents and precursors of reducing agents described in U.S. Pat. No. 4,500,626, columns 49 and 50, U.S. Pat. Nos. 4,839,272, 4,330,617, 4,590,152, 5,017,454 and 5,139,919, JP-A-60-140335, pages 17 and 18, JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546, pages 40 to 57, JP-A-1-120553, JP-A-2-32338, JP-A-2-35451, JP-A-2-234158, JP-A-3-160443 and European Patent 220,746, pages 78 to 96.

Combinations of various reducing agents can also be used as disclosed in U.S. Pat. No. 3,039,869.

When nondiffusible reducing agents are used, electron transfer agents and/or precursors thereof can be used in combination to enhance electron transfer between the nondiffusible reducing agents and the silver halides as needed. It is particularly preferred to use ones described in U.S. Pat. No. 5,139,919 described above, EP-A-418,743, JP-A-1-138556 and JP-A-3-102345. Further, methods for stably introducing them into layers as described in JP-A-2-230143 and JP-A-2-235044 are preferably used.

The electron transfer agents or the precursors thereof can be selected from the reducing agents or precursors thereof described above. It is desirable that the electron transfer agents or the precursors thereof are higher in their mobility than the nondiffusible reducing agents (electron donors). Particularly useful electron transfer agents are 1-phenyl-3-pyrazolidone derivatives and aminophenol derivatives.

The nondiffusible reducing agents (electron donors) used in combination with the electron transfer agents may be any of the above-mentioned reducing agents, as long as they do not substantially move in the layers of the photographic materials. Preferred examples thereof include hydroquinone derivatives, sulfonamidophenols, sulfonamidonaphthols, compounds described in JP-A-53-110827, U.S. Pat. Nos. 5,032,487, 5,026,634 and 4,839,272 as electron donors, and nondiffusible, reductive dye-donating compounds described later.

Further, precursors of electron donors as described in JP-A-3-160443 are also preferably used.

Furthermore, for various purposes such as color mixture prevention, an improvement in color reproduction, an improvement in white backgrounds and prevention of silver transfer to the dye fixing materials, the above-mentioned reducing agents can be used in intermediate layers or protective layers. Specifically, reducing agents described in EP-A-524,649 and EP-A-357,040, JP-A-4-249245, JP-A-2-64633, JP-A-2-46450 and JP-A-63-186240 are preferably used. Further, reductive compounds releasing development inhibitors as described in JP-B-3-63733, JP-A-1-150135, JP-A-2-110557, JP-A-2-64634, JP-A-3-43735 and EP-A-451,833 are also used.

In the invention, the total amount of the reducing agents added is preferably from 0.01 mol to 20 mol, and particularly preferably from 0.1 mol to 10 mol, per mol of silver.

For forming color images in the invention, when silver ions are reduced to silver under high-temperature conditions, compounds releasing diffusible dyes corresponding to this reaction, that is to say, the dye-donating compounds, can be used.

Examples of the dye-donating compounds include compounds having the function of releasing diffusible dyes imagewise. The compounds of this type can be represented by the following formula [LI]:

$$((\mathrm{Dye})_m\text{—}\mathrm{Y})_n\text{—}\mathrm{Z} \qquad [\mathrm{LI}]$$

wherein Dye represents a dye group or a dye precursor, or a dye group or a dye precursor temporarily made short in wavelength; Y represents a mere bond or a bonding group; Z represents a group having the property of bringing about the difference in diffusibility of the compound represented by $((\mathrm{Dye})_m\text{—}\mathrm{Y})_n\text{—}\mathrm{Z}$ corresponding to or reversely corresponding to a light-sensitive silver salt having a latent image imagewise, or releasing $(\mathrm{Dye})_m\text{—}\mathrm{Y}$ to produce the difference in diffusibility between $(\mathrm{Dye})_m\text{—}\mathrm{Y}$ released and $((\mathrm{Dye})_m\text{—}\mathrm{Y})_n\text{—}\mathrm{Z}$; m represents an integer of 1 to 5; n represents 1 or 2; and when m or n is not 1, the plurality of "Dye"s may be the same or different. More specifically, the dye-donating compounds are compounds of (1) and (2) described below:

(1) Compounds nondiffusible themselves (DDR couplers) which are couplers having leaving groups and release diffusible dyes by a reaction with oxidation products of reducing agents. Specific examples thereof are described in British Patent 1,330,524, JP-B-48-39165, U.S. Pat. Nos. 3,443,940, 4,474,867 and 4,483,914.

(2) Compounds nondiffusible themselves (DRR compounds) which are reductive to silver halides or organic silver salts, and release diffusible dyes upon their reduction. Specific examples thereof are described in U.S. Pat. Nos. 3,928,312, 4,053,312, 4,055,428 and 4,336,322, JP-A-56-65839, JP-A-59-69839, JP-A-53-3819, JP-A-51-104343, *Research Disclosure*, 17465, U.S. Pat. Nos. 3,725,062, 3,728,113 and 3,443,939, JP-A-58-116537, JP-A-57-179840 and U.S. Pat. No. 4,500,626. Specific examples of the DRR compounds include compounds described in U.S. Pat. No. 4,500,626, columns 22 to 44, and especially, compounds (1) to (3), (10) to (13), (16) to (19), (28) to (30), (33) to (35), (38) to (40) and (42) to (64) described therein are preferred. Compounds described in U.S. Pat. No. 4,639,408, columns 37 to 39 are also useful. In addition, as dye-donating compounds other than the couplers and the compounds represented by formula [LI], azo dyes (U.S. Pat. No. 4,235,957 and *Research Disclosure*, April 1976, pages 30 to 32) and leuco dyes (U.S. Pat. Nos. 3,985,565 and 4,022,617) can also be used.

As other dye formation methods used in the invention, JP-A-8-286340, JP-A-10-142764 and JP-A-10-254111 show methods of forming diffusible dyes by a coupling reaction of contained developing agents with couplers. In the invention, it is particularly preferred that the dye formation system by coupling or according to the DRR compounds is used.

Hydrophobic additives such as the dye-donating compounds and the nondiffusible reducing agents can be introduced into the layers of the heat developable photographic materials by known methods such as methods described in U.S. Pat. No. 2,322,027. In this case, high boiling organic solvents as described in U.S. Pat. Nos. 4,555,470, 4,536,466, 4,536,467, 4,587,206, 4,555,476 and 4,599,296 and JP-B-3-62256 can be used in combination with low boiling organic solvents having a boiling point of 50° C. to 160° C. as needed. Further, these dye-donating compounds, nondiffusible reducing agents and high boiling organic solvents can be used as a combination of two or more of them.

The amount of the high boiling organic solvents is 10 g or less, preferably 5 g or less, and more preferably from 1 g to 0.1 g, per gram of dye-donating compound to be used. Further, it is 1 cc or less, preferably 0.5 cc or less, and more preferably 0.3 cc or less, per gram of binder. Furthermore, dispersing methods according to polymerized products described in JP-B-51-39853 and JP-A-51-59943 and addition as dispersed fine particles described in JP-A-62-30242 can also be used.

The compounds substantially insoluble in water can be dispersed in binders as fine particles to add them to the layers, as well as the above-mentioned methods.

When the hydrophobic compounds are dispersed in hydrophilic colloids, various surfactants can be used. For example, surfactants described in JP-A-59-157636, pages 37 and 38, and *Research Disclosures* stated above can be used.

In the heat developable photographic materials, compounds for activating development and stabilizing images can be used. Specific compounds preferably used are described in U.S. Pat. No. 4,500,626, column 51 and 52.

In the system of forming images by the diffusion transfer of dyes, various compounds can be added for fixing or decoloring dyes or colored materials unnecessary for the layers constituting the heat developable photographic materials of the invention to improve white backgrounds of the images.

Specifically, compounds described in EP-A-353741, EP-A-461416, JP-A-63-163345 and JP-A-62-203158 can be used.

In the layers constituting the heat developable photographic materials of the invention, various pigments and dyes can be used for improving color separation and increasing sensitivity.

Specifically, compounds described in *Research Disclosures* stated above, and compounds and layer constitution described in EP-A-479167, EP-A-502,508, JP-A-1-167838, JP-A-4-343355, JP-A-2-168252 and JP-A-61-20943 can be used.

In the system of forming images by diffusion transfer of dyes, the dye fixing materials are used together with the heat developable photographic materials. The dye fixing material and the photographic material may be either separately formed on different supports, respectively, or formed on the same support. For the mutual relationship between the photographic materials and the dye fixing materials, the relationship with supports and the relationship with white reflection layers, the relationship described in U.S. Pat. No. 4,500,626, column 57, can also be applied to the invention.

The dye fixing material preferably used in the invention has at least one layer containing a mordant and a binder. Mordants known in the field of photography can be used, and specific examples thereof include mordants described in U.S. Pat. No. 4,500,626, columns 58 and 59, JP-A-61-88256 pages 32 to 41, and JP-A-1-161236, pages 4 to 7, and mordants described in U.S. Pat. Nos. 4,774,162, 4,619,883 and 4,594,308. Further, dye acceptable polymers described in U.S. Pat. No. 4,463,079 may also be used.

The binders used in the dye fixing materials of the invention are preferably the above-mentioned hydrophilic binders. Further, carrageenans as described in EP-A-4443529 or latexes having a glass transition temperature of 40° C. or less as described in JP-B-3-74820 are preferably used in combination therewith.

The dye fixing materials can be provided with auxiliary layers such as protective layers, separation layers, undercoat layers, intermediate layers, back layers and anticurling layers. In particular, it is useful to provide the protective layers.

In the layers constituting the heat developable photographic materials and the dye fixing materials, plasticizers, slipping agents or high boiling organic solvents as separation improvers between the photographic materials and the dye fixing materials can be used. Specific examples thereof include agents described in *Research Disclosures* stated above and JP-A-62-245253.

Further, for the above-mentioned purposes, various silicone oils (all silicone oils from dimethyl silicone oil to modified silicone oils in which various organic groups are introduced into dimethylsiloxane) can be used. As examples thereof, various modified silicone oils described in technical data, Modified Silicone Oils, P6 to 18B, published by Shin-Etsu Polymer Co., Ltd. are useful, and carboxy-modified silicone (trade name: X-22-3710) is particularly effective.

Silicone oils described in JP-A-62-215953 and JP-A-63-46449 are also useful.

Antifading agents may be used in the heat developable photographic materials and the dye fixing materials. The antifading agents include, for example, antioxidants, ultraviolet absorbers and some kinds of metal complexes, and dye image stabilizers and ultraviolet absorbers described in *Research Disclosures* stated above are also useful.

The antioxidants include, for example, chroman compounds, coumaran compounds, phenol compounds (e.g., hindered phenols), hydroquinone derivatives, hindered amine derivatives and spiroindene compounds. Compounds described in JP-A-61-159644 are also effective.

The ultraviolet absorbers include benzotriazole compounds (U.S. Pat. No. 3,533,794), 4-thiazolidone compounds (U.S. Pat. No. 3,352,681), benzophenone compounds (JP-A-46-2784) and other compounds described in JP-A-54-48535, JP-A-62-136641 and JP-A-61-88256. Ultraviolet absorbing polymers described in JP-A-62-260152 are also effective.

The metal complexes include compounds described in U.S. Pat. Nos. 4,241,155, 4,245,018, columns 3 to 36, and U.S. Pat. No. 4,254,195, columns 3 to 8, JP-A-62-174741, JP-A-61-88256, pages 27 to 29, JP-A-63-199248, JP-A-1-75568 and JP-A-74272.

The antifading agents for preventing fading of dyes transferred to the dye fixing materials may previously be added to the dye fixing materials, or may be supplied from the outside such as the heat developable photographic materials or transfer solvents described later to the dye fixing materials.

The above-mentioned antioxidants, ultraviolet absorbers and metal complexes may be used in combination with one another.

Fluorescent brighteners may be used in the heat developable photographic materials and the dye fixing materials. In particular, it is preferred that the fluorescent brighteners are contained in the dye fixing materials, or supplied from the outside such as the heat developable photographic materials or the transfer solvents. Examples thereof include compounds described in *The Chemistry of Synthetic Dyes*, edited by K. Veenkataraman, vol. V, chapter 8 and JP-A-61-143752. More specifically, they include stilbene compounds, coumarin compounds, biphenyl compounds, benzoxazolyl compounds, naphthalimide compounds, pyrazoline compounds and carbostylyl compounds.

Specific examples of these antifading agents, ultraviolet absorbers and fluorescent brighteners are described in JP-A-62-215272, pages 125 to 137, and JP-A-1-161236, pages 17 to 43.

Hardeners used in the layers constituting the heat developable photographic materials and the dye fixing materials include hardeners described in Research Disclosures stated above, U.S. Pat. No. 4,678,739, column 41, and U.S. Pat. No. 4,791,042, JP-A-59-116655, JP-A-62-245261, JP-A-61-18942 and JP-A-4-218044. More specifically, examples thereof include aldehyde hardeners (such as formaldehyde), aziridine hardeners, epoxy hardeners, vinylsulfone hardeners (such as N,N'-ethylenebis(vinylsulfonylacetamido) ethane), N-methylol hardeners (dimethylolurea) and polymer hardeners (compounds described in JP-A-62-234157).

These hardeners are used in an amount of 0.001 g to 1 g, and preferably 0.005 g to 0.5 g, per gram of gelatin coated. They may be added to any of the layers constituting the photographic materials and dye fixing materials, and each of them may be divided into two or more parts, which are added to two or more layers, respectively.

In the layers constituting the heat developable photographic materials and the dye fixing materials, various antifoggants or photographic stabilizers and precursors thereof can be used. Specific examples thereof include compounds described in *Research Disclosures* stated above, U.S. Pat. Nos. 5,089,378, 4,500,627 and 4,614,702, JP-A-62-13546, pages 7 to 9, 57 to 71 and 81 to 97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650 and *Research Disclosure*, 17643 (1978), pages 24 and 25.

These compounds are preferably used in an amount of $5\times10^{-6}$ mol to $1\times10^{-1}$ mol, more preferably $1\times10^{-5}$ mol to $1\times10^{-2}$ mol, per mol of silver.

In the layers constituting the heat developable photographic materials and the dye fixing materials, various surfactants can be used for assisting coating, improving separation, improving slipperiness, preventing electric charge and accelerating development. Specific examples of the surfactants are described in *Research Disclosures* stated above, JP-A-62-173463 and JP-A-62-183457.

In the layers constituting the heat developable photographic materials and the dye fixing materials, organic fluoro compounds may be contained for improving slipperiness, preventing electric charge and improving separation. Typical examples of the organic fluoro compounds include fluorine surfactants described in JP-B-57-9053, columns 8 to 17, JP-A-61-20944 and JP-A-62-135826, and hydrophobic fluorine compounds such as oily fluorine compounds (for example, fluorine oil) and solid fluorine compounds (for example, ethylene tetrafluoride resins).

In the heat developable photographic materials and the dye fixing materials, matte agents can be used for preventing adhesion, improving slipperiness and delustering surfaces of the materials. The matte agents include compounds described in JP-A-63-274944 and JP-A-63-274952, such as benzoguanamine resin beads, polycarbonate resin beads and AS resin beads, as well as compounds described in JP-A-61-88256, page 29, such as silicon dioxide, polyolefins and polymethacrylates. In addition, compounds described in *Research Disclosures* stated above can be used. These matte agents can be added not only to the uppermost layers (protective layers), but also to lower layers as needed.

Besides, the layers constituting the heat developable photographic materials and the dye fixing materials may contain heat solvents, defoaming agents, bactericides, antifungal agents and colloidal silica. Specific examples of these additives are described in JP-A-61-88256, pages 26 to 32, JP-A-3-11338 and JP-B-2-51496.

In the invention, image formation accelerating agents can be used in the heat developable photographic materials and/or the dye fixing materials. The image formation accelerating agents have the functions of accelerating the oxidation-reduction reaction of silver salt oxidizing agents with reducing agents, accelerating reactions such as formation of dyes from the dye-donating compounds, decomposition of dyes and release of diffusible dyes, and accelerating transfer of dyes from heat developable photographic material layers to dye fixing layers. They can be classified into bases or base precursors, nucleophilic compounds, high boiling organic solvents (oils), heat solvents, surfactants and compounds having the mutual interaction with silver or silver ions, according to physicochemical functions. However, these substances generally have combined functions, and usually have some of the above-mentioned accelerating effects in combination. Details thereof are described in U.S. Pat. No. 4,678,739, columns 38 to 40.

The base precursors include salts of organic acids and bases which are decarboxylated by heat and compounds releasing amines by the intramolecular nucleophilic displacement reaction, the Lossen rearrangement or the Beckmann rearrangement. Specific examples are described in U.S. Pat. Nos. 4,514,493 and 4,657,848.

In a system in which heat development and dye transfer are concurrently performed in the presence of a small amount of water, the bases and/or base precursors are preferably contained in the dye fixing materials in terms of enhanced keeping quality of the heat developable photographic materials.

In addition to the above, slightly soluble metal compounds described in EP-A-210660 and U.S. Pat. No. 4,740,445, combinations of compounds which can form complexes with metal ions constituting the slightly soluble metal compounds (hereinafter referred to as complex formation compounds), and compounds generating bases by electrolysis described in JP-A-61-232451 can also be used as the base precursors. In particular, the former method is effective. It is advantageous that the slightly soluble metal compounds and the complex formation compounds are separately added to the heat developable photographic materials and the dye fixing materials, respectively.

In the invention, various development stoppers can be used in the heat developable photographic materials and/or the dye fixing materials for always obtaining constant images against fluctuations in processing temperature and processing time on development.

The development stopper as used herein is a compound which, after normal development, rapidly neutralizes or reacts with a base to reduce the concentration of the base contained in a film, thereby stopping the development, or a compound which interacts with silver and a silver salt to inhibit the development. Specific examples thereof include acid precursors releasing acids by heating, electrophilic compounds which conduct the replacement reaction with coexisting bases by heating, nitrogen-containing heterocyclic compounds, mercapto compounds and precursors thereof. More particularly, they are described in JP-A-62-253159, pages 31 and 32.

In the invention, supports which can endure processing temperatures are used as the supports for the heat developable photographic materials and the dye fixing materials. In general, the supports include photographic supports such as paper and synthetic polymers (films) described in Shashin Kogaku no Kiso (Ginen Shashin) (The Fundamentals of Photographic Engineering (Silver Photograph), pages 223 to 240 (1979), Corona Publishing Co., Ltd. Specific examples thereof include polyethylene terephthalate, polyethylene naphthalate, polycarbonates, polyvinyl chloride, polystyrene, polypropylene, polyimides, cellulose derivatives (e.g., cellulose triacetate), films thereof containing pigments such as titanium oxide, synthetic paper produced from propylene by film methods, mixed paper produced from pulp of synthetic resins such as polyethylene and natural pulp, Yankee paper, baryta paper, coated paper (particularly, cast-coated paper), metals, cloth and glass.

They can be used alone or as supports laminated with synthetic polymers such as polyethylene on one side or both sides. The laminate layers can contain pigments or dyes such as titanium oxide, ultramarine and carbon black as needed.

In addition, supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can be used.

Back faces of these supports may be coated with hydrophilic binders and semiconductive metal oxides such as alumina sols and tin oxide or antistatic agents such as carbon black. Specifically, supports described in JP-A-63-220246 can be used.

Further, surfaces of these supports may be subjected to various surface treatments or undercoating for improving adhesion between the supports and the hydrophilic binders.

The heat developable photographic materials and/or dye fixing materials of the invention may have conductive exothermic layers as heating means for heat development and diffusion transfer of dyes. In this case, heating elements described in JP-A-61-145544 can be utilized.

The heating temperature in the heat development stage is from about 50° C. to about 250° C., and particularly usefully from about 60° C. to about 180° C. The diffusion transfer stage of dyes may be conducted either simultaneously with heat development or after termination of the heat development stage. In the latter case, the heating temperature in the transfer stage ranges from the temperature employed in the heat development stage to room temperature. In particular, it is preferably from 50° C. to a temperature about 10° C. lower than the temperature in the heat development stage.

Although the transfer of dyes occurs only by heat, solvents may be used for accelerating the transfer of dyes. It is also useful that heating is carried out in the presence of a trace amount of water to conduct development and transfer at the same time or continuously as described in U.S. Pat. Nos. 4,704,345 and 4,740,445 and JP-A-61-238056. In this system, the heating temperature is preferably from 50° C. to the boiling point of the solvent. For example, the solvent is water, it is preferably from 50° C. to 100° C.

Examples of the solvents used for the promotion of development and/or the diffusion transfer of dyes include water, basic aqueous solutions containing inorganic alkali metal salts or organic bases (as these bases, ones described above for the image formation accelerating agents are used), and mixed solutions of low boiling solvents or high boiling solvents and water or the above-mentioned basic aqueous solutions. Further, the solvents may contain surfactants, antifoggants, compounds forming complexes with slightly soluble metal salts, antifungal agents and bactericides.

In these heat development and diffusion transfer stages, water is preferably used as the solvent. Any water may be used as long as it is generally used. Specifically, distilled water, tap water, well water and mineral water can be used. In heat developing equipment in which the heat developable photographic materials of the invention and the dye fixing materials are processed, water may be used in the disposable form, or repeatedly circulated. The latter case results in the use of water containing components eluted from the materials. Further, equipment and water described in JP-A-63-144354, JP-A-63-144355, JP-A-62-38460 and JP-A-3-210555 may be used.

The solvents can be given to the heat developable photographic materials, the dye fixing materials or both. The amount of the solvents used is adequately equal to or less than the weight thereof corresponding to the maximum swelled volume of the whole coated films.

Water is preferably given by methods described in JP-A-62-253159, page 5, and JP-A-63-85544. Further, solvents enclosed in microcapsules or hydrated can also be previously contained in the heat developable photographic materials, the dye fixing elements or both.

The temperature of water to be given is adequately from 30° C. to 60° C. as described in JP-A-63-85544. In particular, for preventing bacteria in water from propagating, it is useful to keep the temperature of water at 45° C. or more.

Further, for accelerating the transfer of dyes, hydrophilic heat solvents which are solid at ordinary temperature and soluble at high temperatures can also be contained in the heat developable photographic materials and/or the dye fixing materials. Although the solvents may be contained in any of the light-sensitive silver halide emulsion layers, the intermediate layers, the protective layers and the dye fixing layers, they are preferably contained in the dye fixing layers and/or layers adjacent thereto.

Examples of the hydrophilic heat solvents include urea derivatives, pyridine derivatives, amides, sulfonamides, imides, alcohols, oximes and other heterocyclic compounds.

Heating methods in the development and/or the transfer stage include methods of bringing the materials into contact with heated blocks, heated plates, hot pressers, heat rolls, heat drums, halogen lamp heaters, infrared or far infrared lamp heaters, and methods of passing them through atmospheres of high temperatures.

The heat developable photographic materials and the dye fixing materials can be placed one over the other by methods described in JP-A-62-253159 and JP-A-61-147244, page 27.

EXAMPLE 1

Receiving element R101 having the constitution shown in Tables 1 and 2 was prepared.

TABLE 1

CONSTITUTION OF RECEIVING ELEMENT R101

| Layer Number | Additive | Amount Coated ($mg/m^2$) |
|---|---|---|
| 6th Layer | Water-Soluble Polymer (1) | 130 |
| | Water-Soluble Polymer (2) | 35 |
| | Water-Soluble Polymer (3) | 45 |
| | Potassium Nitrate | 20 |
| | Anionic Surfactant (1) | 6 |
| | Anionic Surfactant (2) | 6 |
| | Amphoteric Surfactant (1) | 50 |

TABLE 1-continued

CONSTITUTION OF RECEIVING ELEMENT R101

| Layer Number | Additive | Amount Coated ($mg/m^2$) |
|---|---|---|
| | Stain Inhibitor (1) | 8 |
| | Stain Inhibitor (2) | 11 |
| | Matte Agent (1) | 7 |
| 5th Layer | Gelatin | 250 |
| | Water-Soluble Polymer (1) | 25 |
| | Anionic Surfactant (3) | 9 |
| | Hardener (1) | 185 |
| 4th Layer | Mordant (1) | 1850 |
| | Water-Soluble Polymer (2) | 260 |
| | Water-Soluble Polymer (4) | 1400 |
| | Latex Dispersion (1) | 600 |
| | Anionic Surfactant (3) | 25 |
| | Nonionic Surfactant (1) | 18 |
| | Guanidine Picolinate | 2550 |
| | Sodium Quinolinate | 350 |
| 3rd Layer | Gelatin | 370 |
| | Mordant (1) | 300 |
| | Anionic Surfactant (3) | 12 |
| 2nd Layer | Gelatin | 700 |
| | Mordant (1) | 290 |
| | Water-Soluble Polymer (1) | 55 |
| | Water-Soluble Polymer (2) | 320 |
| | Anionic Surfactant (3) | 30 |
| | Anionic Surfactant (4) | 7 |
| | High Boiling Organic Solvent (1) | 690 |
| | Fluorescent Brightener (1) | 30 |
| | Stain Inhibitor (3) | 32 |
| | Guanidine Picolinate | 360 |
| | Potassium Quinolinate | 45 |
| 1st Layer | Gelatin | 280 |
| | Water-Soluble Polymer (1) | 12 |
| | Anionic Surfactant (1) | 14 |
| | Sodium Metaborate | 35 |
| | Hardener (1) | 185 |

Support (1) Paper Support Laminated with Polyethylene (thickness: 215 $\mu$m)

The amount of the latex dispersion coated is the amount of latex solid matter coated.

TABLE 2

CONSTITUTION OF SUPPORT

| Layer Name | Composition | Film Thickness ($\mu$m) |
|---|---|---|
| Surface Undercoat Layer | Gelatin | 0.1 |
| Surface PE Layer (Glossy) | Low Density Polyethylene (density: 0.923): 90.2 parts | |
| | Surface-Treated Titanium Oxide: 9.8 parts Ultramarine: 0.001 part | 36.0 |
| Pulp Layer | Woodfree Paper (LBKP/NBSP = 6/4, density: 1.053) | 152.0 |
| Back Face PE Layer (Matte) | High Density Polyethylene (density: 0.955) | 27.0 |
| Back Face Undercoat Layer | Styrene/Acrylate Copolymer Colloidal Silica Polysodium Styrenesulfonate | 0.1 |
| | | 215.2 |

Anionic Surfactant (1)

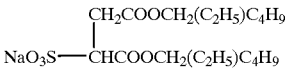

TABLE 2-continued

CONSTITUTION OF SUPPORT

| Layer Name | Composition | Film Thickness ($\mu$m) |
|---|---|---|

Anionic Surfactant (2)

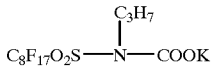

Anionic Surfactant (3)

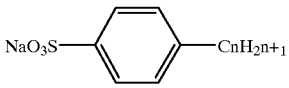

n = 12.6

Anionic Surfactant (4)

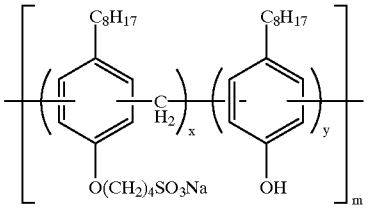

x:y = 4:6 m = 6.8

Nonionic Surfactant (1)

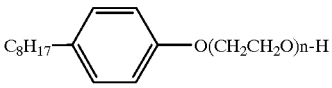

n = 8.5

Amphoteric Surfactant (1)

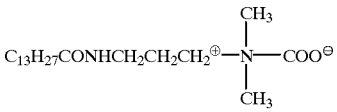

Fluorescent Brightener (1)

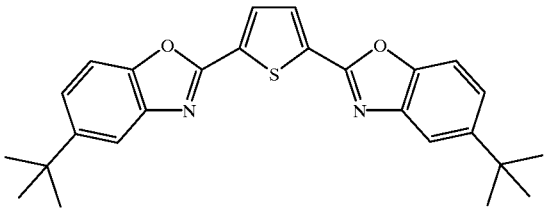

TABLE 2-continued

| CONSTITUTION OF SUPPORT | | |
|---|---|---|
| Layer Name | Composition | Film Thickness (μm) |
| Mordant (1) | 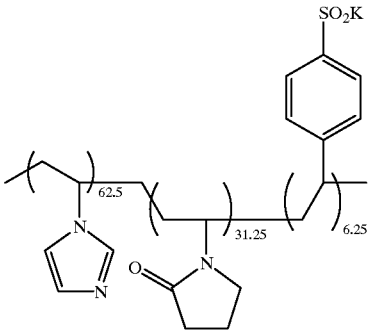 | |

High Boiling Organic Solvent (1)

$C_{26}H_{46.9}Cl_{7.1}$ (Empara 40 (manufactured by Ajinomoto Co., Inc.))

Stain Inhibitor (1)

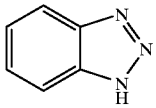

Stain Inhibitor (2)

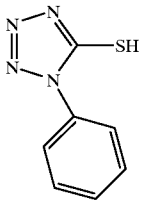

Stain Inhibitor (3)

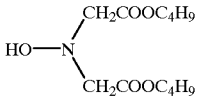

Water-Soluble Polymer (1):

Sumikagel L5-H (manufactured by Sumitomo Chemical Co, Ltd.)

Water-Soluble Polymer (2):

Dextran (molecular weight: 70,000)

Water-Soluble Polymer (3):

Kappa Carrageenan (manufactured by Taito Co., Ltd.)

Water-Soluble Polymer (4):

MP Polymer MP-102 (manufactured by Kuraray Co., Ltd.)

Water-Soluble POlymer (5):

Acrylic Modified Copolymer of Polyvinyl Alcohol (degree of modification: 17%)

Latex Dispersion (1):

LX-438 (manufactured by Nippon Zeon Co., Ltd.)

Matte Agent (1)

SYLOID 79 (manufactured by Fuji Devison Kagaku Co., Ltd.)

Hardener (1)

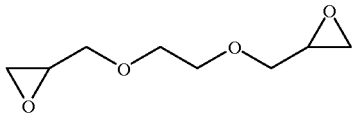

A method for preparing a light-sensitive element is described below.

First, methods for preparing light-sensitive silver halide emulsions are described.

Light-Sensitive Silver Halide Emulsion (1) (for Red-Sensitive Emulsion Layer):

Solution (I) having composition shown in Table 4 was added to a well-stirred aqueous solution having composition shown in Table 3 at a constant flow rate for 9 minutes. From 10 minutes before addition of solution (I), solution (II) was added at a constant flow rate for 9 minutes and 10 seconds. After 36 minutes, solution (III) having composition shown in Table 4 was added at a constant flow rate for 24 minutes, and solution (IV) was added concurrently with addition of solution of (III) at a constant flow rate for 25 minutes.

After washing and salt removal (conducted using sedimenting agent a at pH 4.0) by a conventional method, 880 g of lime-treated ossein gelatin was added to adjust the pH to 6.0. Then, 12.8 g of a decomposed product of ribonucleic acid and 32 mg of trimethylthiourea were added, followed by optimum chemical sensitization at 60° C. for 71 minutes. Thereafter, 2.6 g of 4-hydroxy-6-methyl-1,3,3a,7-tetraazainedene, 3.2 g of dye (a), 5.1 g of KBr and 2.6 g of a stabilizer described later were in turn added, followed by cooling. Thus, 28.1 kg of a monodisperse cubic silver chlorobromide emulsion having a mean grain size of 0.35 μm was obtained.

TABLE 3

| Composition | |
|---|---|
| $H_2O$ | 26300 cc |
| Lime-Treated Gelatin | 800 g |
| KBr | 12 g |
| NaCl | 80 g |
| Compound (a) | 1.2 g |
| Temperature | 53° C. |

TABLE 4

| | Solution (I) | Solution (II) | Solution (III) | Solution (IV) |
|---|---|---|---|---|
| $AgNO_3$ | 1200 g | — | 2800 g | — |
| KBr | — | 540 g | — | 1766 g |
| NaC1 | — | 144 g | — | 96 g |
| $K_2IrCl_6$ | — | 3.6 mg | — | |
| Total Amount | Water to make 6.5 liters | Water to make 6.5 liters | Water to make 10 liters | Water to make 10 liters |

Compount (a)

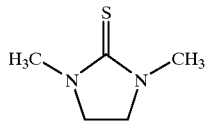

TABLE 4-continued

| | Solution (I) | Solution (II) | Solution (III) | Solution (IV) |
|---|---|---|---|---|
| Dye (a) | 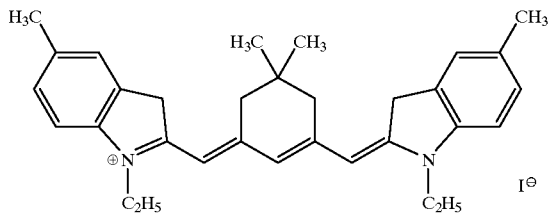 | | | |

Light-Sensitive Silver Halide Emulsion (2) (for Green-Sensitive Emulsion Layer):

Solution (I) and solution (II) each having composition shown in Table 6 were concurrently added to a well-stirred aqueous solution having composition shown in Table 5 at a constant flow rate for 9 minutes. After 5 minutes, solution (III) and solution (IV) each having composition shown in Table 6 were further concurrently added thereto at a constant flow rate for 32 minutes. After termination of addition of solutions (III) and (IV), 60 ml of a solution of sensitizing dyes in methanol (containing 360 mg of dye (b-1) and 73.4 mg of dye (b-2)) was added.

After washing and salt removal (conducted using sedimenting agent a at pH 4.0) by a conventional method, 22 g of lime-treated ossein gelatin was added to adjust the pH and the pAg to 6.0 and 7.6, respectively. Then, 1.8 mg of sodium thiosulfate and 180 mg of 4-hydroxy-6-methyl-1,3,3a,7-tetraazainedene were added, followed by optimum chemical sensitization at 60° C. Thereafter, 90 mg of antifoggant (1) was added, followed by cooling. Thus, 635 g of a monodisperse cubic silver chlorobromide emulsion having a mean grain size of 0.30 μm was obtained.

TABLE 5

| Composition | |
|---|---|
| $H_2O$ | 600 cc |
| Lime-Treated Gelatin | 20 g |
| KBr | 0.3 g |
| NaCl | 2 g |
| Compound (a) | 0.03 g |
| Sulfuric Acid (1 N) | 16 cc |
| Temperature | 46° C. |

TABLE 6

| | Solution (I) | Solution (II) | Solution (III) | Solution (IV) |
|---|---|---|---|---|
| $AgNO_3$ | 10.0 g | — | 90.0 g | — |
| KBr | — | 3.50 g | — | 57.1 g |
| NaCl | — | 1.72 g | — | 3.13 g |
| $K_2IrCl_6$ | — | — | — | 0.03 mg |
| Total Amount | Water to make 126 ml | Water to make 131 ml | Water to make 280 ml | Water to make 289 ml |

TABLE 6-continued

| | Solution (I) | Solution (II) | Solution (III) | Solution (IV) |
|---|---|---|---|---|
| Dye (b-1) | 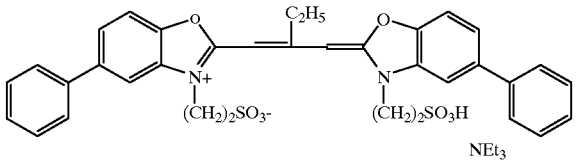 | | | |
| Dye (b-2) | 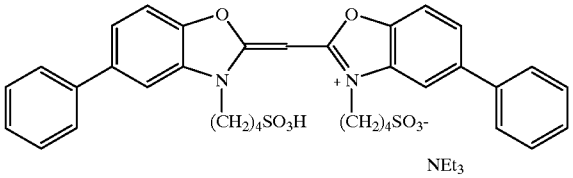 | | | |
| Sedimenting Agent a | 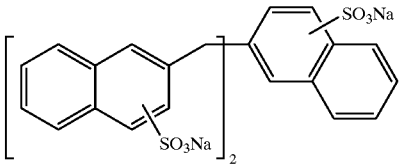 | | | |
| Antifoggant (1) | 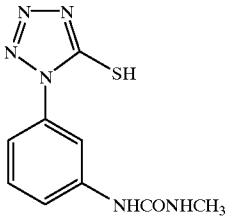 | | | |

Light-Sensitive Silver Halide Emulsion (3) (for Blue-Sensitive Emulsion Layer):

Solution (II) having composition shown in Table 8 was added to a well-stirred aqueous solution having composition shown in Table 7 for 30 minutes. After 10 seconds, solution (I) having composition shown in Table 8 was added thereto for 30 minutes. Further, 2 minutes after addition of solution (I), solution (V) was added, and 5 minutes after addition of solution (II), solution (IV) was added for 28 minutes. After 10 seconds, solution (III) was added for 27 minutes and 50 seconds.

After washing and salt removal (conducted using sedimenting agent b at pH 3.9) by a conventional method, 1230 g of lime-treated ossein gelatin and 2.8 mg of compound (b) were added to adjust the pH and the pAg to 6.1 and 8.4, respectively. Then, 24.9 mg of sodium thiosulfate was added, followed by optimum chemical sensitization at 60° C. Thereafter, 13.1 g of dye (c) and 118 ml of compound (c) were in turn added, followed by cooling. Silver halide grains of an emulsion thus obtained were potato-like grains. The mean grain size thereof was 0.53 μm, and the yield was 30,700 g.

TABLE 7

| Composition | |
|---|---|
| $H_2O$ | 29200 cc |
| Lime-Treated Gelatin | 1582 g |
| KBr | 127 g |
| Compound (a) | 0.66 g |
| Temperature | 72° C. |

TABLE 8

| | Solution (I) | Solution (II) | Solution (III) | Solution (IV) | Solution (V) |
|---|---|---|---|---|---|
| $AgNO_3$ | 939 g | — | 3461 g | — | — |
| KBr | — | 572 g | — | 2464 g | — |
| KI | — | — | — | — | 22 g |
| Total Amount | Water to make 6690 ml | Water to make 6680 ml | Water to make 9700 ml | Water to make 9740 ml | Water to make 4400 ml |

Sedimenting Agent b

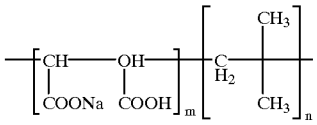

m + n =1

Dye (c)

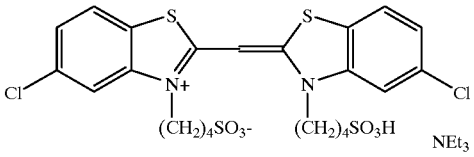

Compound (b)

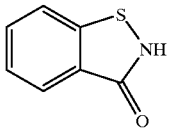

Compound (c)

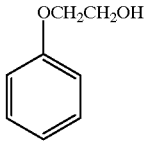

Preparation methods of gelatin dispersions of hydrophobic additives are described below.

Gelatin dispersions of yellow, magenta and cyan couplers and developing agents were each prepared according to formulations shown in Table 9. That is to say, the respective oil phase components were dissolved by heating at about 70° C. to form a homogeneous solution, and the aqueous phase components heated at about 60° C. were added to this solution. After mixing by stirring, the resulting mixture was dispersed in a homogenizer at 10,000 rpm for 10 minutes. Water was added thereto, followed by stirring to obtain a homogeneous dispersion.

TABLE 9

| | | Composition of Dispersion | | |
|---|---|---|---|---|
| | | Yellow | Magenta | Cyan |
| Oil Phase | Cyan Coupler (1) | — | — | 7.0 g |
| | Magenta Coupler (1) | — | 7.0 g | — |
| | Yellow Coupler (1) | 7.0 g | — | — |
| | Developing Agent (1) | — | — | 5.6 g |
| | Developing Agent (2) | — | 5.6 g | — |
| | Developing Agent (3) | 5.6 g | — | — |
| | Auxiliary Developing Agent (1) | 0.51 g | 0.51 g | 0.51 g |
| | Antifoggant (5) | 0.25 g | — | — |
| | Antifoggant (2) | — | 0.25 g | 0.25 g |
| | High Boiling Solvent (4) | 7.4 g | 4.4 g | 7.4 g |
| | Ethyl Acetate | 15 cc | 15 cc | 15 cc |
| Aqueous Phase | Lime-Treated Gelatin | 10.0 g | 10.0 g | 10.0 g |
| | Calcium Nitrate | 0.1 g | 0.1 g | 0.1 g |
| | Surfactant (1) | 0.7 g | 0.7 g | 0.7 g |
| | Water | 110 cc | 110 cc | 110 cc |
| | Water Addition | 110 cc | 110 cc | 110 cc |
| | Preservative (1) | 0.04 g | 0.04 g | 0.04 g |

A gelatin dispersion of antifoggant (4) and reducing agent (3) was prepared according to a formulation shown in Table 10. That is to say, the respective oil phase components were dissolved by heating at about 60° C. to form a homogeneous solution, and the aqueous phase components heated at about 60° C. were added to this solution. After mixing by stirring, the resulting mixture was dispersed in a homogenizer at 10,000 rpm for 10 minutes to obtain a homogeneous dispersion.

TABLE 10

| | | Composition of Dispersion |
|---|---|---|
| Oil Phase | Antifoggant (4) | 0.14 g |
| | Reducing Agent (1) | 1.3 g |
| | High Boiling Solvent (2) | 2.3 g |
| | High Boiling Solvent (5) | 0.2 g |
| | Surfactant (1) | 0.5 g |
| | Surfactant (4) | 0.5 g |
| | Ethyl Acetate | 10.0 ml |
| Aqueous Phase | Acid-Treated Gelatin | 10.0 g |
| | Preservative (1) | 0.004 g |
| | Calcium Nitrate | 0.1 g |
| | Water | 35.0 ml |
| | Water Addition | 104.4 ml |

A dispersion of polymer latex (a) was prepared according to a formulation shown in Table 11. That is to say, anionic surfactant (6) was added to a mixture of polymer latex (a), surfactant (5) and water with stirring for 10 minutes to obtain a homogeneous dispersion. Further, dilution with water and concentration were repeated to the resulting dispersion, using an ultrafiltration module (ACV-3050 manufactured by Asahi Chemical Industry Co., Ltd.), so as to reduce the salt concentration of the dispersion to 1/9.

TABLE 11

| | Composition of Dispersion |
|---|---|
| Aqueous Solution of Polymer Latex (a) (solid content: 13%) | 108 ml |
| Surfactant (5) | 20 g |
| Surfactant (6) | 600 ml |
| Water | 1232 ml |

A gelatin dispersion of zinc hydroxide was prepared as shown in Table 12. That is to say, the respective components were dissolved by mixing, followed by dispersion in a mill using glass beads having a mean particle size of 0.75 mm for 30 minutes. The glass beads were further removed by separation to obtain a homogeneous dispersion.

TABLE 12

| | Composition of Dispersion |
|---|---|
| Zinc Hydroxide | 15.9 g |
| Carboxymethyl Cellulose | 0.7 g |
| Polysodium Acrylate | 0.07 g |
| Lime-Treated Gelatin | 4.2 g |
| Water | 100 ml |
| Preservative (2) | 0.4 g |

Then, a preparation method of a gelatin dispersion of a matte agent to be added to a protective layer is described. A solution of PMMA in methylene chloride was added to gelatin together with a small amount of surfactant to obtain a homogeneous dispersion having a mean particle size of 4.3 μm.

Using the above, light-sensitive element 101 shown in Tables 13 and 14 was prepared.

TABLE 13

MAIN MATERIAL CONSTITUTION OF LIGHT-SENSITIVE ELEMENT 101

| Layer No. | Layer Name | Additive | Amount Added (mg/m$^2$) |
|---|---|---|---|
| 7th Layer | Protective Layer | Acid-Treated Gelatin | 387 |
| | | Matte Agent (PMMA Resin) | 17 |
| | | Surfactant (2) | 6 |
| | | Surfactant (3) | 20 |
| | | Dispersion of Polymer Latex (a) | 10 |
| 6th Layer | Intermediate Layer | Lime-Treated Gelatin | 862 |
| | | Antifoggant (4) | 6 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (1) | 5 |
| | | Zinc Hydroxide | 558 |
| | | Calcium Nitrate | 6 |
| 5th Layer | Blue-Sensitive Layer | Lime-Treated Gelatin | 587 |
| | | Light-Sensitive Silver Halide Emulsion (3) | 399 |
| | | Yellow Coupler (1) | 410 |
| | | Developing Agent (3) | 328 |
| | | Antifoggant (5) | 15 |
| | | High Boiling Solvent (4) | 433 |
| | | Surfactant (1) | 12 |
| | | Water-Soluble Polymer (1) | 40 |
| | | Auxiliary Developing Agent (1) | 30 |
| 4th Layer | Intermediate layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (1) | 4 |
| | | Zinc Hydroxide | 341 |
| | | Calcium Nitrate | 8 |

TABLE 14

(cont'd from Table 13)
MAIN MATERIAL CONSTITUTION OF LIGHT-SENSITIVE ELEMENT 101

| Layer No. | Layer Name | Additive | Amount Added (mg/m$^2$) |
|---|---|---|---|
| 3rd Layer | Green-Sensitive Layer | Lime-Treated Gelatin | 452 |
| | | Light-Sensitive Silver Halide Emulsion (2) | 234 |
| | | Magenta Coupler (1) | 420 |
| | | Developing Agent (2) | 336 |
| | | Antifoggant (2) | 15 |
| | | High Boiling Solvent (4) | 444 |
| | | Surfactant (1) | 12 |
| | | Water-Soluble Polymer (1) | 10 |
| | | Auxiliary Developing Agent (1) | 30 |
| 2nd Layer | Intermediate layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (1) | 10 |
| | | Calcium Nitrate | 6 |
| 1st Layer | Red-Sensitive Layer | Lime-Treated Gelatin | 373 |
| | | Light-Sensitive Silver Halide Emulsion (1) | 160 |
| | | Cyan Coupler (1) | 390 |
| | | Developing Agent (1) | 312 |
| | | Antifoggant (2) | 14 |
| | | High Boiling Solvent (4) | 412 |
| | | Surfactant (1) | 11 |
| | | Water-Soluble Polymer (2) | 25 |
| | | Hardener (1) | 45 |
| | | Auxiliary Developing Agent (1) | 30 |

Support (a support in which a 20 μm-thick PET film was vapor-deposited with aluminum and further surface under-coated with gelatin)

Sedimenting Agent b

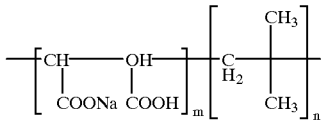

m + n =1

Dye (c)

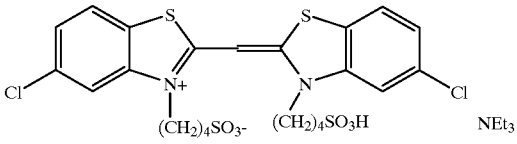

Compound (b)

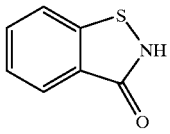

-continued

Compound (c)

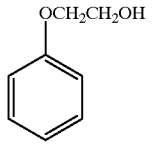

Antifoggant (4)

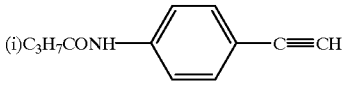

Antifoggant (5)

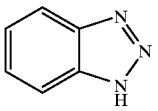

Antifoggant (2)

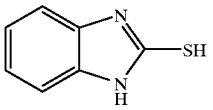

High Boiling Organic Solvent (4)

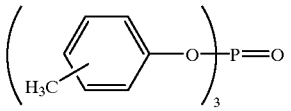

Preservative (1)

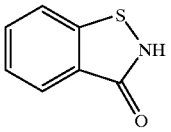

Polymer Latex (a)

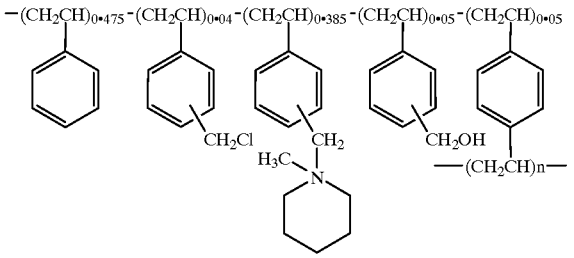

Surfactant (5)

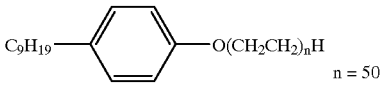

n = 50

Surfactant (6)

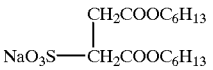

Surfactant (1)

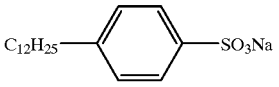

-continued

High Boiling Organic Solvent (1)

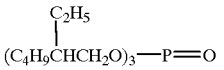

High Boiling Organic Solvent (2)

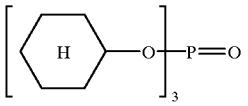

Preservative (2)

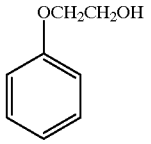

Surfactant (2)

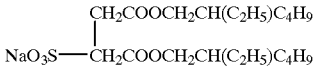

Surfactant (3)

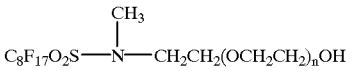

Water-Soluble Polymer (1)

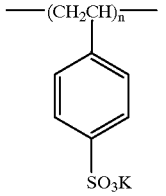

0.1 N NaCl, 30° C.
intrinsic viscosity: 1.6
molecular weight: 1,000,000

Water-Soluble Polymer (1)

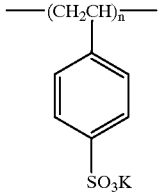

0.1 N NaCl, 30° C.
intrinsic viscosity: 0.8
molecular weight: 1,000,000

Hardener (1)

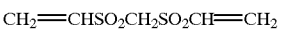

Auxiliary Developing Agent (1)

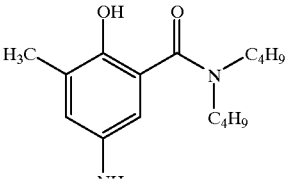

-continued

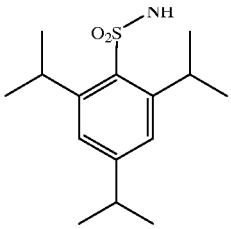

Developing Agent (1)

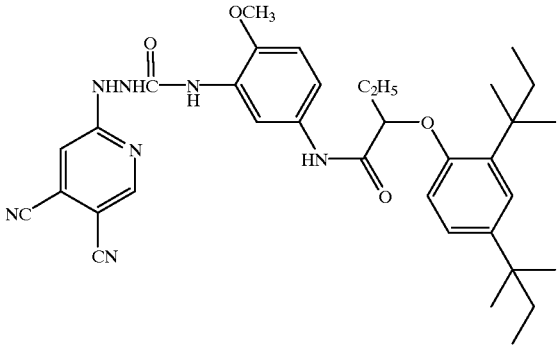

Developing Agent (2)

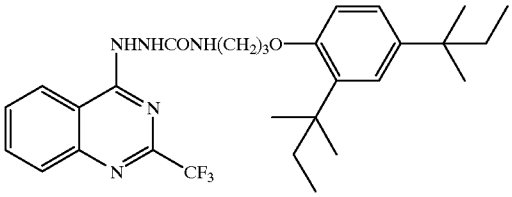

Compound (36) described in JP-A-9-152705

Developing Agent (3)

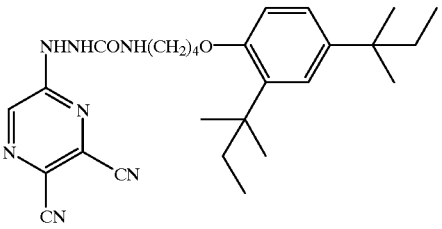

Compound (49) described in JP-A-9-152705

Yellow Coupler (1)

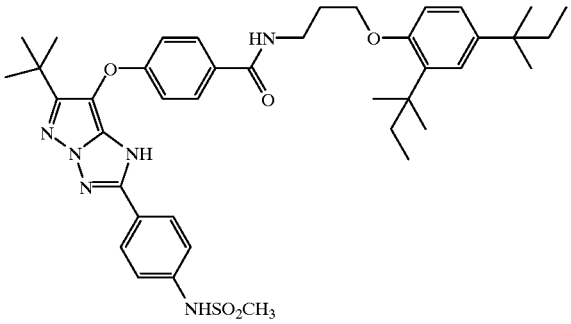

Compound (C-17) described in JP-A-9-152705

-continued

Magenta Coupler (1)

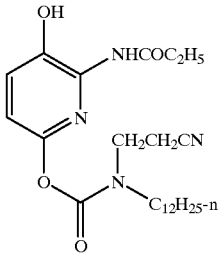

Compound (C-43) described in JP-A-9-152705

Cyan Coupler (1)

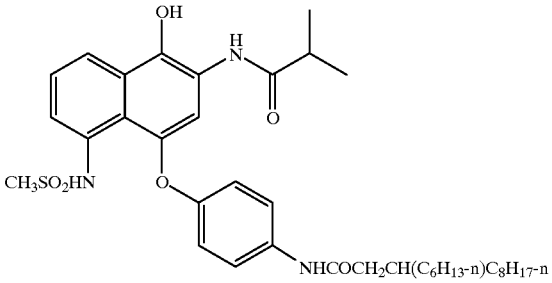

Compound (C-37) described in JP-A-9-152705

Then, light-sensitive elements 102 to 108 were prepared using the couplers of the invention represented by formula (I) or (II) and the developing agents represented by formula (III) in the third layer of the above-mentioned light-sensitive element. The developing agents and couplers used herein are shown in Table 15.

Then, the above-mentioned light-sensitive elements were processed with a PICTROSTAT 330 processor (manufactured by Fuji Photo Film Co. Ltd.) at 82° C. for 15 seconds to output images.

Images outputted from light-sensitive elements 102 to 108 were sharp color images, and when the compounds of the invention were used, the images were excellent in sharpness.

The maximum magenta density and the minimum magenta density of these resulting images were measured with an X-rite 304 reflection densitometer manufactured by X-rite Co. Results thereof are shown in Table 16.

As apparent from the table, the use of the compounds of the invention can provide good color generation even for a short development time. Further, the resulting images were stable under the conditions of light, heat and humidity.

TABLE 15

| Light-Sensitive Element | Developing Agent | Coupler | Remark |
|---|---|---|---|
| 101 | Compound (36) described in cited patent | Compound (C-43) described in cited patent | Comparison |
| 102 | Compound (36) described in cited patent | (11) | Invention |
| 103 | Compound (36) described in cited patent | (5) | Invention |
| 104 | D-(70) | (1) | Invention |
| 105 | D-(68) | (5) | Invention |
| 106 | D-(68) | (2) | Invention |

TABLE 15-continued

| Light-Sensitive Element | Developing Agent | Coupler | Remark |
|---|---|---|---|
| 107 | D-(72) | (2) | Invention |
| 108 | D-(75) | (4) | Invention |

TABLE 16

| Light-Sensitive Element | Maximum Magenta Density | Minimum Magenta Density | Remark |
|---|---|---|---|
| 101 | 1.28 | 0.15 | Comparison |
| 102 | 1.64 | 0.14 | Invention |
| 103 | 1.78 | 0.12 | Invention |
| 104 | 1.91 | 0.13 | Invention |
| 105 | 2.07 | 0.15 | Invention |
| 106 | 2.18 | 0.14 | Invention |
| 107 | 2.38 | 0.12 | Invention |
| 108 | 2.33 | 0.14 | Invention |

EXAMPLE 2

Light-sensitive element 201 was prepared by the following method.

First, methods for preparing light-sensitive silver halide emulsions are described.

Light-Sensitive Silver Halide Emulsion (4) (for Fifth Layer (680-nm Light-Sensitive Layer))

Solution (I) and solution (II) each having composition shown in Table 18 were concurrently added dropwise to a well-stirred aqueous solution having composition shown in Table 17 for 13 minutes. After 10 minutes, solution (III) and solution (IV) each having composition shown in Table 18 were added for 33 minutes.

TABLE 17

| Composition | |
|---|---|
| $H_2O$ | 620 cc |
| Lime-Treated Gelatin | 20 g |
| KBr | 0.3 g |
| NaCl | 2 g |
| Solvent for Silver Halide (1) | 0.03 g |
| Sulfuric Acid (1 N) | 16 cc |
| Temperature | 45° C/ |

TABLE 18

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_2IrCl_3$ | — | — | — | 0.039 mg |
| Total Amount | Water to make 126 ml | Water to make 132 ml | Water to make 254 ml | Water to make 252 ml |

Solvent for Silver Halide (1)

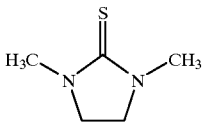

TABLE 18-continued

| | Solution (I) | Solution (II) | Solution (III) | Solution (IV) |
|---|---|---|---|---|

Sensitizing Dye (1)

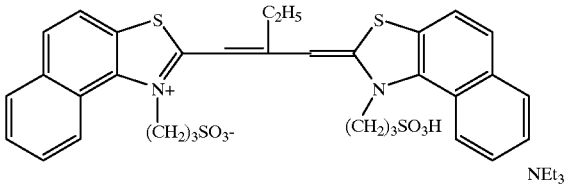

From 13 minutes after initiation of addition of solution (III), 150 cc of an aqueous solution containing 0.35% of sensitizing dye (1) was further added for 27 minutes.

After washing and salt removal (conducted using sedimenting agent a at pH 4.1) by a conventional method, 22 g of lime-treated ossein gelatin was added to adjust the pH and the pAg to 6.0 and 7.9, respectively, followed by chemical sensitization at 60° C. Compounds used in the chemical sensitization were as shown in Table 19. Thus, 630 g of a monodisperse cubic silver chlorobromide emulsion having a mean grain size of 0.20 $\mu$m and a coefficient of variation of 10.2% was obtained.

TABLE 19

Sedimenting Agent a

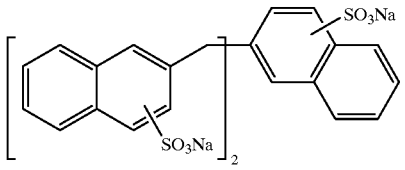

| Chemicals Used in Chemical Sensitization | Amount Added |
|---|---|
| 4-Hydroxy-6-methyl-1,3,3a,7-tetraazainedene | 0.36 g |
| Sodium Thiosulfate | 6.75 mg |
| Antifoggant (1) | 0.11 g |
| Preservative (1) | 0.07 g |
| Preservative (2) | 3.31 g |

Antifoggant (1)

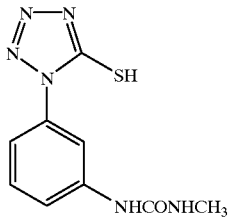

Preservative (1)

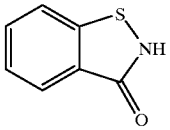

TABLE 19-continued

Sedimenting Agent a

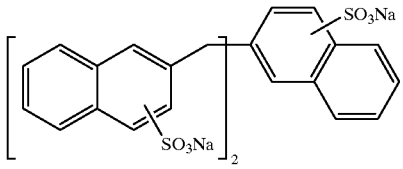

| Chemicals Used in Chemical Sensitization | Amount Added |
|---|---|
| Preservative (2) 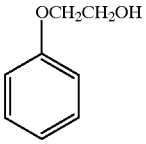 | |

TABLE 19

| Chemicals Used in Chemical Sensitization | Amount Added |
|---|---|
| 4-Hydroxy-6-methyl-1,3,3a,7-tetraazainedene | 0.36 g |
| Sodium Thiosulfate | 6.75 mg |
| Antifoggant (1) | 0.11 g |
| Preservative (1) | 0.07 g |
| Preservative (2) | 3.31 g |
| Antifoggant (1) 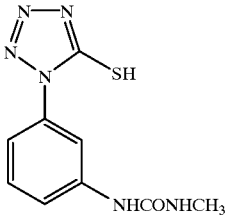 | |
| Preservative (1) 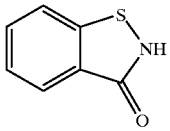 | |
| Preservative (2) 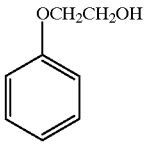 | |

Light-Sensitive Silver Halide Emulsion (5) (for Third Layer (750-nm Light-Sensitive Layer))

Solution (I) and solution (II) each having composition shown in Table 21 were concurrently added to a well-stirred aqueous solution having composition shown in Table 20 for 18 minutes. After 10 minutes, solution (III) and solution (IV) each having composition shown in Table 21 were concurrently added for 24 minutes.

TABLE 20

| Composition | |
|---|---|
| $H_2O$ | 620 cc |
| Lime-Treated Gelatin | 20 g |
| KBr | 0.3 g |
| NaCl | 2 g |

TABLE 20-continued

| Composition | |
|---|---|
| Solvent for Silver Halide (1) | 0.03 g |
| Sulfuric Acid (1 N) | 16 cc |
| Temperature | 45° C. |

TABLE 21

| | Solution (I) | Solution (II) | Solution (III) | Solution (IV) |
|---|---|---|---|---|
| $AgNO_3$ | 30.0 g | — | 70.0 g | — |
| KBr | 13.7 g | — | 44.2 | g |
| NaCl | 3.62 g | — | 2.4 | g |
| $K_4[Fe(CN)_6] \cdot H_2O$ | — | — | — | 0.07 mg |
| $K_2IrCl_6$ | — | — | — | 0.04 mg |
| Total Amount | Water to make 188 ml | Water to make 188 ml | Water to make 250 ml | Water to make 250 ml |

After washing and salt removal (conducted using sedimenting agent b at pH 3.9) by a conventional method, 22 g of lime-treated ossein gelatin subjected to decalcification treatment (having a calcium content of 150 ppm or less) was added and redispersion was carried out at 40° C. Then, 0.39 g of 4-hydroxy-6-methyl-1,3,3a,7-tetraazainedene was added to adjust the pH and the pAg to 6.9 and 7.8, respectively. Then, chemical sensitization was conducted at 70° C. using chemicals shown in Table 22. Further, sensitizing dye (2) was added as a methanol solution (a solution having composition shown in Table 23) at the end of the chemical sensitization. Furthermore, after the chemical sensitization, the temperature was lowered to 40° C., and 200 g of a gelatin dispersion of stabilizer (1) described later was added. The resulting mixture was sufficiently stirred, followed by storing. Thus, 938 g of a monodisperse cubic silver chlorobromide emulsion having a mean grain size of 0.25 μm and a coefficient of variation of 12.6% was obtained. The emulsion for a 750 nm light-sensitive layer was an emulsion having J-band type spectral sensitivity.

TABLE 22

| Chemicals Used in Chemical Sensitization | Amount Added |
|---|---|
| 4-Hydroxy-6-methyl-1,3,3a,7-tetraazainedene | 0.39 g |
| Triethylthiourea | 3.3 mg |
| Decomposed Product of Nucleic Acid | 0.39 g |
| NaCl | 0.15 g |
| KI | 0.12 g |
| Antifoggant (2) | 0.10 g |
| Preservative (1) | 0.07 g |

TABLE 23

| Composition of Dye Solution | Amount Added |
|---|---|
| Sensitizing Dye (2) | 0.19 g |
| Methanol | 18.7 cc |
| Sedimenting Agent b | |

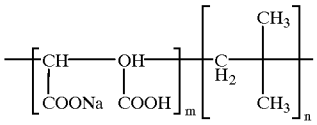

m + n = 1

TABLE 23-continued

| Composition of Dye Solution | Amount Added |
|---|---|
| Stabilizer (1) 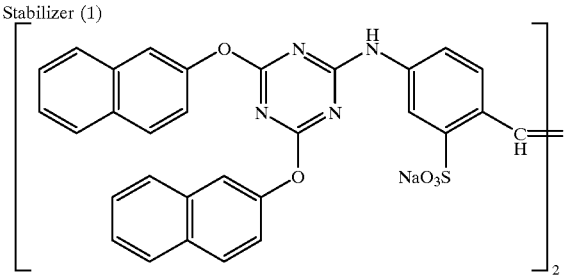 | |
| Sensitizing Dye (2) 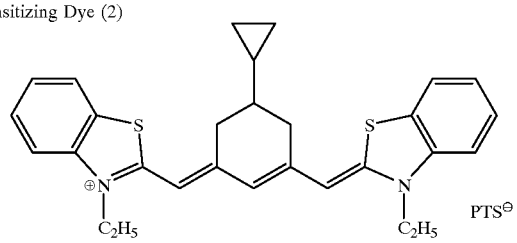 | |
| Antifoggant (2) 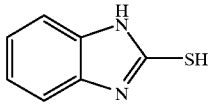 | |

TABLE 24

| Composition | |
|---|---|
| $H_2O$ | 620 cc |
| Lime-Treated Gelatin | 20 g |
| KBr | 0.3 g |
| NaCl | 2 g |
| Solvent for Silver Halide (1) | 0.03 g |
| Sulfuric Acid (1 N) | 16 cc |
| Temperature | 50° C. |

TABLE 25

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.02 mg |
| Total Amount | Water to make 180 ml | Water to make 181 ml | Water to make 242 ml | Water to make 250 ml |

After washing and salt removal (conducted using sedimenting agent a at pH 3.8) by a conventional method, 22 g of lime-treated ossein gelatin was added to adjust the pH and the pAg to 7.4 and 7.8, respectively, followed by chemical sensitization. Compounds used in the chemical sensitization were as shown in Table 26. Further, sensitizing dye (3) was added as a methanol solution (similarly to sensitizing dye (2) shown in Table 23) at the end of the chemical sensitization. Thus, 680 g of a monodisperse cubic silver chlorobromide emulsion having a mean grain size of 0.32 μm and a coefficient of variation of 9.7% was obtained.

TABLE 26

| Chemicals Used in Chemical Sensitization | Amount Added |
|---|---|
| 4-Hydroxy-6-methyl-1,3,3a,7-tetraazainedene | 0.38 g |
| Triethylthiourea | 3.1 mg |
| Antifoggant (2) | 0.19 g |
| Preservative (1) | 0.07 g |
| Preservative (2) | 3.13 g |
| Sensitizing Dye (3) 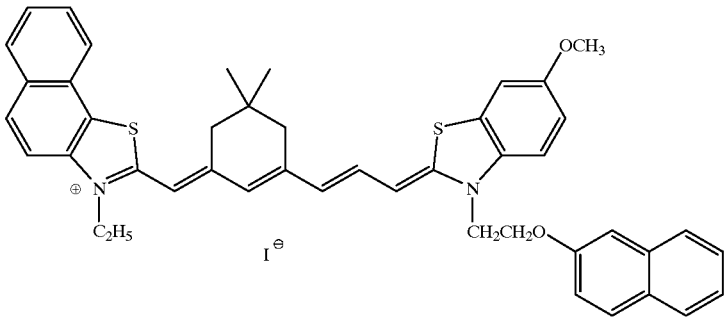 | |

Light-Sensitive Silver Halide Emulsion (6) (for First Layer (810-nm Light-Sensitive Layer)):

Solution (I) and solution (II) each having composition shown in Table 25 were concurrently added to a well-stirred aqueous solution having composition shown in Table 24 for 18 minutes. After 10 minutes, solution (III) and solution (IV) each having composition shown in Table 25 were added for 24 minutes.

A preparation method of a gelatin dispersion of colloidal silver is described below.

A solution having composition shown in Table 28 was added to a well-stirred aqueous solution having composition shown in Table 27 for 24 minutes. Then, after washing with sedimenting agent a, 43 g of lime-treated ossein gelatin was added to adjust the pH to 6.3. Thus, 512 g of a dispersion containing 2% of silver having a mean grain size of 0.02 μm and 6.8% of gelatin was obtained.

TABLE 27

| Composition | |
|---|---|
| $H_2O$ | 620 cc |
| Dextrin | 16 g |
| NaOH (5 N) | 41 cc |
| Temperature | 30° C. |

TABLE 28

| Composition | |
|---|---|
| $H_2O$ | 135 cc |
| $AgNO_3$ | 17 g |

Preparation methods of gelatin dispersions of hydrophobic additives are described below.

Gelatin dispersions of yellow, magenta and cyan couplers, each containing a developing agent, were each prepared according to formulations shown in Table 29. That is to say, the respective oil phase components were dissolved by heating at about 70° C. to form a homogeneous solution, and the aqueous phase components heated at about 60° C. were added to this solution. After mixing by stirring, the resulting mixture was dispersed in a homogenizer at 10,000 rpm for 10 minutes. Water was added thereto, followed by stirring to obtain a homogeneous dispersion.

TABLE 29

| | | Composition of Dispersion | | |
|---|---|---|---|---|
| | | Yellow | Magenta | Cyan |
| Oil Phase | Cyan Coupler (2) | — | — | 7.0 g |
| | Magenta Coupler (2) | — | 7.0 g | — |
| | Yellow Coupler (2) | 7.0 g | — | — |
| | Developing Agent (4) | — | — | 5.6 g |
| | Developing Agent (4) | — | 5.6 g | — |
| | Developing Agent (4) | 5.6 g | — | — |
| | Auxiliary Developing Agent (1) | 0.51 g | 0.51 g | 0.51 g |
| | Antifoggant (5) | 0.25 g | — | — |
| | Antifoggant (2) | — | 0.25 g | 0.25 g |
| | High Boiling Solvent (4) | 7.4 g | 7.4 g | 7.4 g |
| | Dye (a) | 1.1 g | — | — |
| | Ethyl Acetate | 15 cc | 15 cc | 15 cc |
| Aqueous Phase | Lime-Treated Gelatin | 10.0 g | 10.0 g | 10.0 g |
| | Calcium Nitrate | 0.1 g | 0.1 g | 0.1 g |
| | Surfactant (1) | 0.2 g | 0.2 g | 0.2 g |
| | Water | 110 cc | 110 cc | 110 cc |
| | Water Addition | 110 cc | 110 cc | 110 cc |
| | Preservative (1) | 0.04 g | 0.04 g | 0.04 g |

A gelatin dispersion of antifoggant (4) and reducing agent (1) was prepared according to a formulation shown in Table 30. That is to say, the respective oil phase components were dissolved by heating at about 60° C. to form a homogeneous solution, and the aqueous phase components heated at about 60° C. were added to this solution. After mixing by stirring, the resulting mixture was dispersed in a homogenizer at 10,000 rpm for 10 minutes to obtain a homogeneous dispersion.

TABLE 30

| | | Composition of Dispersion |
|---|---|---|
| Oil Phase | Antifoggant (4) | 0.14 g |
| | Reducing Agent (1) | 1.3 g |
| | High Boiling Solvent (2) | 2.3 g |

TABLE 30-continued

| | | Composition of Dispersion |
|---|---|---|
| | High Boiling Solvent (5) | 0.2 g |
| | Surfactant (1) | 0.5 g |
| | Surfactant (4) | 0.5 g |
| | Ethyl Acetate | 10.0 ml |
| Aqueous Phase | Acid-Treated Gelatin | 10.0 g |
| | Preservative (1) | 0.004 g |
| | Calcium Nitrate | 0.1 g |
| | Water | 35.0 ml |
| | Water Addition | 104.4 ml |

A gelatin dispersion of reducing agent (2) was prepared according to a formulation shown in Table 31. That is to say, the respective oil phase components were dissolved by heating at about 60° C. to form a homogeneous solution, and the aqueous phase components heated at about 60° C. were added to this solution. After mixing by stirring, the resulting mixture was dispersed in a homogenizer at 10,000 rpm for 10 minutes to obtain a homogeneous dispersion. Further, ethyl acetate was removed from the resulting dispersion using an apparatus for removing organic solvents under reduced pressure.

TABLE 31

| | | Composition of Dispersion |
|---|---|---|
| Oil Phase | Reducing Agent (2) | 7.5 g |
| | High Boiling Solvent (1) | 4.7 g |
| | Surfactant (1) | 1.9 g |
| | Ethyl Acetate | 14.4 ml |
| Aqueous Phase | Acid-Treated Gelatin | 10.0 g |
| | Preservative (1) | 0.02 g |
| | Gentamicin | 0.04 g |
| | Sodium Hydrogensulfite | 0.1 g |
| | Water | 136.7 ml |

A dispersion of polymer latex (a) was prepared according to a formulation shown in Table 32. That is to say, anionic surfactant (6) was added to a mixture of polymer latex (a), surfactant (5) and water in amounts shown in Table 32 with stirring for 10 minutes to obtain a homogeneous dispersion. Further, dilution with water and concentration were repeated to the resulting dispersion, using an ultrafiltration module (ACV-3050 manufactured by Asahi Chemical Industry Co., Ltd.), so as to reduce the salt concentration of the dispersion to 1/9.

TABLE 32

| | Composition of Dispersion |
|---|---|
| Aqueous Solution of Polymer Latex (a) (solid content: 13%) | 108 ml |
| Surfactant (5) | 20 g |
| Surfactant (6) | 600 ml |
| Water | 1232 ml |

A gelatin dispersion of stabilizer (1) was prepared according to a formulation shown in Table 33. That is to say, the oil phase components were dissolved at room temperature to form a homogeneous solution, and the aqueous phase components heated at about 40° C. were added to this solution. After mixing by stirring, the resulting mixture was dispersed in a homogenizer at 10,000 rpm for 10 minutes. Water was added thereto to obtain a homogeneous dispersion.

TABLE 33

| | | Composition of Dispersion |
|---|---|---|
| Oil Phase | Stabilizer (1) | 4.0 g |
| | Sodium Hydroxide | 0.3 g |
| | Methanol | 62.8 g |
| | Preservative (2) | 0.8 g |
| Aqueous Phase | Decalcified Celatin (Ca content: 100 ppm or less) | 10.0 g |
| | Preservative (1) | 0.04 g |
| | Water | 320 ml |

A gelatin dispersion of zinc hydroxide was prepared as shown in Table 34. That is to say, the respective components were dissolved by mixing, followed by dispersion in a mill using glass beads having a mean particle size of 0.75 mm for 30 minutes. The glass beads were further removed by separation to obtain a homogeneous dispersion.

TABLE 34

| | Composition of Dispersion |
|---|---|
| Zinc Hydroxide | 15.9 g |
| Carboxymethyl Cellulose | 0.7 g |
| Polysodium Acrylate | 0.07 g |
| Lime-Treated Gelatin | 4.2 g |
| Water | 100 ml |
| Preservative (2) | 0.4 g |

Then, a preparation method of a gelatin dispersion of a matte agent to be added to a protective layer is described. A solution of PMMA in methylene chloride was added to gelatin together with a small amount of surfactant to obtain a homogeneous dispersion having a mean particle size of 4.3 μm.

Using the above, light-sensitive element 201 shown in Tables 35 and 36 was obtained.

TABLE 35

MAIN MATERIAL CONSTITUTION OF LIGHT-SENSITIVE ELEMENT 201

| Layer No. | Layer Name | Additive | Amount Added (mg/m$^2$) |
|---|---|---|---|
| 7th Layer | Protective Layer | Acid-Treated Gelatin | 442 |
| | | Reducing Agent (2) | 47 |
| | | High Boiling Solvent (1) | 30 |
| | | Colloidal Silver Grains | 2 |
| | | Matte Agent (PMMA Resin) | 17 |
| | | Surfactant (1) | 16 |
| | | Surfactant (2) | 9 |
| | | Surfactant (3) | 2 |
| 6th Layer | Intermediate Layer | Lime-Treated Gelatin | 862 |
| | | Antifoggant (4) | 6 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Dispersion of Polymer Latex (a) | 5 |
| | | Water-Soluble Polymer (1) | 4 |
| | | Calcium Nitrate | 6 |
| 5th Layer | Red-Sensitive Layer | Lime-Treated Gelatin | 452 |
| | | Light-Sensitive Silver Halide Emulsion (4) | 301 |
| | | Magenta Coupler (2) | 420 |
| | | Developing Agent (3) | 336 |
| | | Antifoggant (2) | 15 |

TABLE 35-continued

MAIN MATERIAL CONSTITUTION OF LIGHT-SENSITIVE ELEMENT 201

| Layer No. | Layer Name | Additive | Amount Added (mg/m$^2$) |
|---|---|---|---|
| | | High Boiling Solvent (4) | 444 |
| | | Surfactant (1) | 12 |
| | | Water-Soluble Polymer (1) | 10 |
| | | Auxiliary Developing Agent (1) | 30 |
| 4th Layer | Intermediate layer | Lime-Treated Gelatin | 862 |
| | | Antifoggant (4) | 6 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Dispersion of Polymer Latex (a) | 5 |
| | | Water-Soluble Polymer (1) | 4 |
| | | Calcium Nitrate | 6 |

TABLE 36

(cont'd from Table 35)
MAIN MATERIAL CONSTITUTION OF LIGHT-SENSITIVE ELEMENT 201

| Layer No. | Layer Name | Additive | Amount Added (mg/m$^2$) |
|---|---|---|---|
| 3rd Layer | Second Infrared-Sensitive Layer | Lime-Treated Gelatin | 373 |
| | | Light-Sensitive Silver Halide Emulsion (5) | 106 |
| | | Cyan Coupler (2) | 390 |
| | | Developing Agent (4) | 312 |
| | | Antifoggant (2) | 14 |
| | | High Boiling Solvent (4) | 412 |
| | | Surfactant (1) | 11 |
| | | Water-Soluble Polymer (1) | 11 |
| | | Auxiliary Developing Agent (1) | 30 |
| 2nd Layer | Intermediate layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (2) | 25 |
| | | Zinc Hydroxide | 750 |
| | | Calcium Nitrate | 6 |
| 1st Layer | First Infrared-Sensitive Layer | Lime-Treated Gelatin | 587 |
| | | Light-Sensitive Silver Halide Emulsion (6) | 311 |
| | | Yellow Coupler (2) | 410 |
| | | Developing Agent (4) | 328 |
| | | Antifoggant (5) | 15 |
| | | High Boiling Solvent (4) | 433 |
| | | Surfactant (1) | 12 |
| | | Water-Soluble Polymer (2) | 40 |
| | | Hardener (1) | 45 |
| | | Auxiliary Developing Agent (1) | 30 |

Support (a support in which a 20 μm-thick PET film was vapor-deposited with aluminum and further surface under-coated with gelatin)

Dye (a)

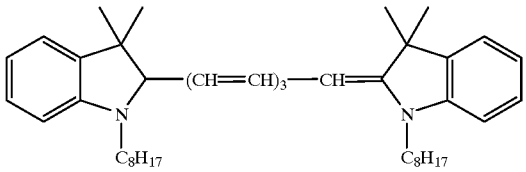

Antifoggant (4)

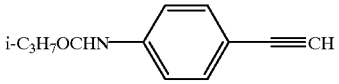

Antifoggant (5)

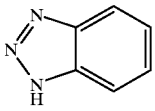

lp;1p

Reducing Agent (1)

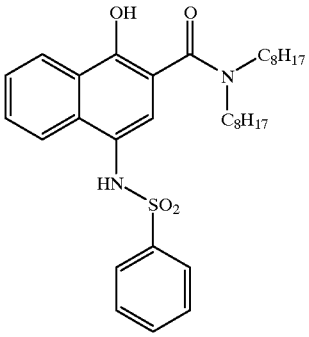

Reducing Agent (2)

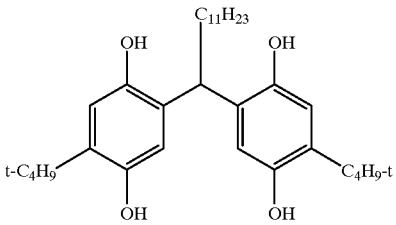

Water-Soluble Polymer (1)

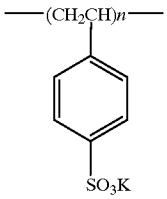

0.1 N NaCl, 30° C.
intrinsic viscosity: 0.8
molecular weight: 1,000,000

-continued

Water-Soluble Polymer (2)

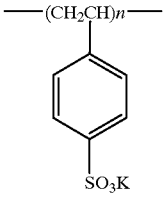

0.1 N NaCl, 30° C.
intrinsic viscosity: 1.6
molecular weight: 1,000,000

Auxiliary Developing Agent (1)

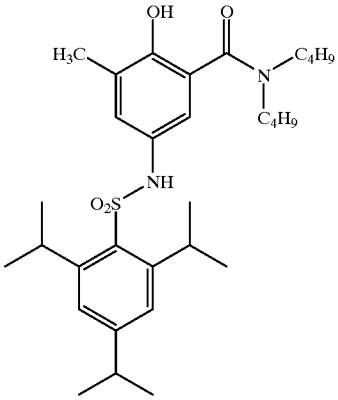

Surfactant (1)

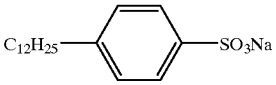

Surfactant (2)

$CH_2COOCH_2(C_2H_5)C_4H_9$
$NaO_3S—CHCOOCH_2(C_2H_5)C_4H_9$

Surfactant (3)

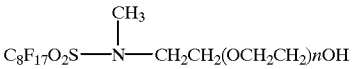

Surfactant (4)

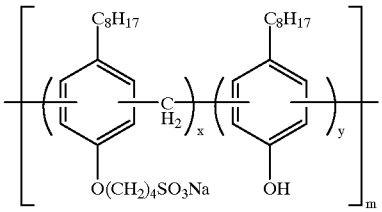

x:y = 4:6
m = 6.8

Surfactant (5)

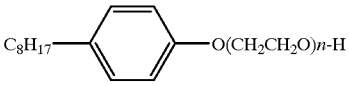

n = 85

Surfactant (6)

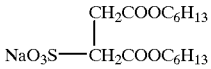

-continued

High Boiling Organic Solvent (1)

$(C_4H_9CH(C_2H_5)C_2H_5)CH_2O)_3—P═O$

High Boiling Organic Solvent (2)

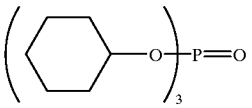

High Boiling Organic Solvent (4)

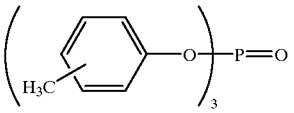

High Boiling Organic Solvent (5)

$C_{26}H_{46.9}Cl_{7.1}$ (Empara 40 (manufactured by Ajinomoto Co,. Inc.))

Hardener (1)

$CH_2═CHSO_2CH_2SO_2CH═CH_2$ (1)

Hardener $CH_2═CHSO_2CH_2SO_2CH═CH_2$

Polymer Latex (a)

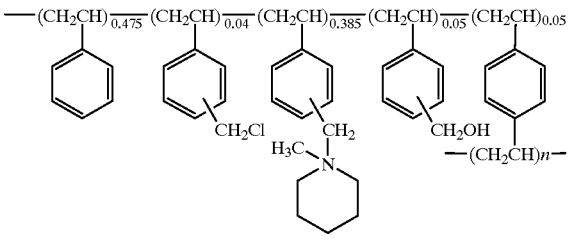

Developing Agent (4)

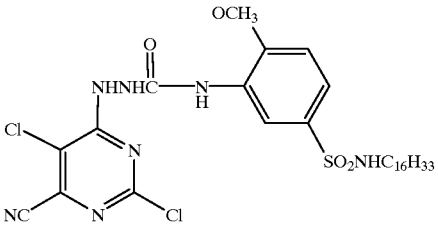

Compound (56) described in JP-A-9-152705

Yellow Coupler (2)

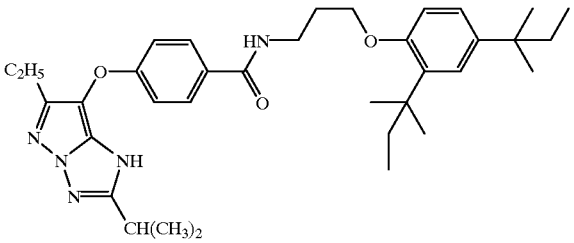

Compound (C-14) described in JP-A-9-152705

-continued

Magenta Coupler (2)

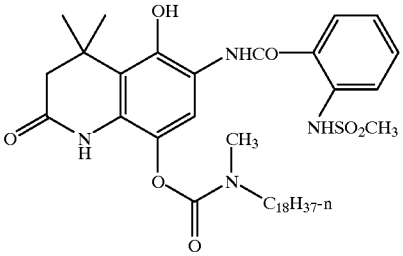

Compound (C-38) described in JP-A-9-152705

Cyan Coupler (2)

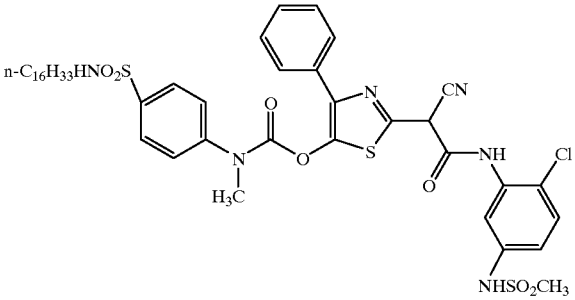

Compound (C-45) described in JP-A-9-152705

Then, light-sensitive elements 202 to 208 were prepared using the couplers of the invention represented by formula (I) or (II) and the developing agents represented by formula (III) in the fifth layer of the above-mentioned light-sensitive element. The developing agents and couplers used herein are shown in Table 37.

Then, the above-mentioned light-sensitive elements were processed with a PG-3000 processor (manufactured by Fuji Photo Film Co. Ltd.) at 82° C. for 28 seconds to output images.

Images outputted from light-sensitive elements 202 to 208 were sharp color images, and when the compounds of the invention were used, the images were excellent in sharpness.

The maximum magenta density and the minimum magenta density of these resulting images were measured with an X-rite 304 reflection densitometer manufactured by X-rite Co. Results thereof are shown in Table 38.

As apparent from the table, the use of the compounds of the invention can provide good color generation even for a short development time. Further, the resulting images were stable under the conditions of light, heat and humidity.

TABLE 37

| Light-Sensitive Element | Developing Agent | Coupler | Remark |
|---|---|---|---|
| 201 | Compound (56) described in cited patent | Compound (C-38) described in cited patent | Comparison |
| 202 | Compound (56) described in cited patent | (11) | Invention |
| 203 | Compound (56) described in cited patent | (5) | Invention |
| 204 | D-(70) | (1) | Invention |
| 205 | D-(68) | (5) | Invention |
| 206 | D-(68) | (2) | Invention |
| 207 | D-(72) | (2) | Invention |
| 208 | D-(75) | (4) | Invention |

TABLE 38

| Light-Sensitive Element | Maximum Magenta Density | Minimum Magenta Density | Remark |
|---|---|---|---|
| 201 | 1.23 | 0.15 | Comparison |
| 202 | 1.62 | 0.14 | Invention |
| 203 | 1.79 | 0.15 | Invention |
| 204 | 1.92 | 0.13 | Invention |
| 205 | 2.07 | 0.14 | Invention |
| 206 | 2.15 | 0.15 | Invention |
| 207 | 2.39 | 0.13 | Invention |
| 208 | 2.31 | 0.14 | Invention |

EXAMPLE 3

Receiving element 201 was prepared in the same manner as with receiving element $R^{101}$ of Example 1.

The following were changed from receiving element R101:

The amount of stain inhibitor (1) coated in the sixth layer was changed from 8 mg/m$^2$ to 7 mg/m$^2$.

The amount of stain inhibitor (2) coated in the sixth layer was changed from 11 mg/m$^2$ to 12 mg/m$^2$.

Mordant (1) in the fourth layer was changed to the following mordant (2).

The amount of high boiling organic solvent (1) coated in the second layer was changed from 690 mg/m$^2$ to 700 mg/m$^2$.

The thickness of the back face undercoat layer was changed from 0.1 $\mu$m to 0.5 $\mu$m.

Mordant (2)

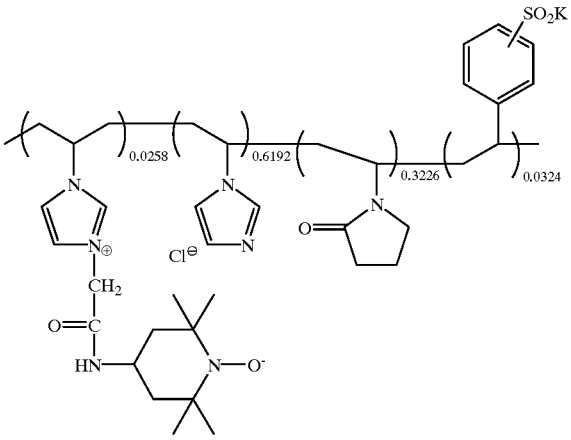

A method for preparing a light-sensitive element is described below.

First, methods for preparing light-sensitive silver halide emulsions are described.

Light-Sensitive Silver Halide Emulsion (1) (for Green-Sensitive Emulsion Layer):

Solution (I) and solution (II) each having composition shown in Table 40 were concurrently added to a well-stirred aqueous solution having composition shown in Table 39 for 19 minutes. After 5 minutes, solution (III) having composition shown in Table 40 was added thereto at a constant flow rate for 33 minutes, and solution (IV) was added for 33 minutes and 30 seconds. Fifteen minutes after initiation of addition of solutions (III), 150 ml of an aqueous solution containing 0.350% of sensitizing dye (1) was further added for 27 minutes.

After washing and salt removal (conducted using sedimenting agent a at pH 3.7 to 4.1) by a conventional method, 22 g of lime-treated ossein gelatin was added to adjust the pH and the pAg to 6.0 and 7.6, respectively, followed by optimum chemical sensitization at 60° C. Compounds used in the chemical sensitization are as shown in Table 41. Thus, 630 g of a monodisperse cubic silver chlorobromide emulsion having a mean grain size of 0.20 $\mu$m and a coefficient of variation of 10.2% was obtained.

TABLE 39

| Composition | |
|---|---|
| $H_2O$ | 620 cc |
| Lime-Treated Gelatin | 20 g |
| KBr | 0.3 g |
| NaCl | 2 g |
| Solvent for Silver Halide (1) | 0.03 g |
| Sulfuric Acid (1 N) | 16 ml |
| Temperature | 45° C. |

TABLE 40

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_2IrCl_6$ | — | — | — | 0.039 mg |
| Total Amount | Water to make 126 ml | Water to make 132 ml | Water to make 254 ml | Water to make 252 ml |

TABLE 41

| Chemicals Used in Chemical Sensitization | Amount Added |
|---|---|
| 4-Hydroxy-6-methyl-1,3,3a,7-tetraazainedene | 0.36 g |
| Sodium Thiosulfate | 6.75 mg |
| Antifoggant (1) | 0.11 g |
| Preservative (1) | 0.07 g |
| Preservative (2) | 3.13 g |
| Solvent for Silver Halide (1) | |

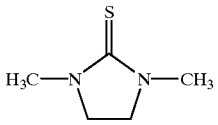

Sensitizing Dye (1)

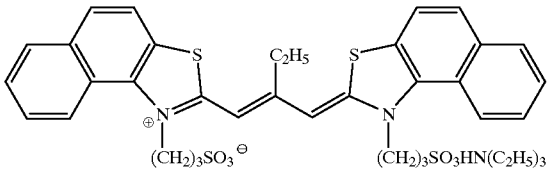

Sedimenting Agent a

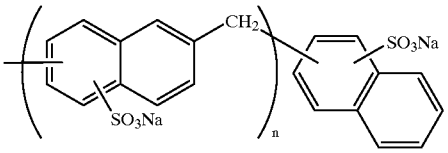

TABLE 41-continued

| Chemicals Used in Chemical Sensitization | Amount Added |
|---|---|
| Antifoggant (1) | |
| 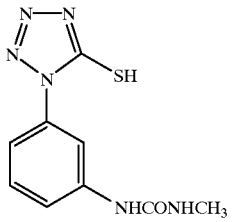 | |
| Preservative (1) | |
| 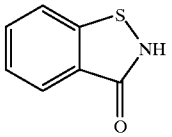 | |
| Preservative (2) | |
| 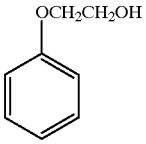 | |

Light-Sensitive Silver Halide Emulsion (2) (for Red-Sensitive Emulsion Layer)

Solution (I) and solution (II) each having composition shown in Table 43 were concurrently added to a well-stirred aqueous solution having composition shown in Table 42 at a constant flow rate for 18 minutes. After 5 minutes, solution (III) having composition shown in Table 43 was added thereto for 24 minutes, and solution (IV) was added for 24 minutes and 30 seconds.

After washing and salt removal (conducted using sedimenting agent a at pH 3.9) by a conventional method, 22 g of lime-treated ossein gelatin was added to adjust the pH and the pAg to 7.4 and 7.8, respectively. Then, chemical sensitization was conducted at 70° C. using chemicals shown in Table 44. Further, sensitizing dye (2) was added as a methanol solution (a solution having composition shown in Table 45) at the end of the chemical sensitization. Furthermore, after the chemical sensitization, the temperature was lowered to 40° C., and 200 g of a gelatin dispersion of stabilizer (1) described later was added. The resulting mixture was sufficiently stirred, followed by storing. The yield of an emulsion thus obtained was 938 g, and the emulsion was a monodisperse cubic silver chlorobromide emulsion having a coefficient of variation of 12.6%. The mean grain size thereof was 0.25 $\mu$m.

TABLE 42

| Composition | |
|---|---|
| $H_2O$ | 620 cc |
| Lime-Treated Gelatin | 20 g |
| KBr | 0.3 g |
| NaCl | 2 g |
| Compound (a) | 0.03 g |

TABLE 42-continued

| Composition | |
|---|---|
| Sulfuric Acid (1 N) | 16 ml |
| Temperature | 45° C. |

TABLE 43

| | Solution (I) | Solution (II) | Solution (III) | Solution (IV) |
|---|---|---|---|---|
| $AgNO_3$ | 30.0 g | — | 70.0 g | — |
| $NH_4NO_3$ | 0.125 g | — | 0.375 g | — |
| KBr | — | 13.7 g | — | 44.1 g |
| NaCl | — | 3.6 g | — | 2.4 g |
| $K_4[Fe(CN)_6] \cdot H_2O$ | — | — | — | 0.065 mg |
| $K_2IrCl_6$ | — | — | — | 0.04 mg |
| Total Amount | Water to make 126 ml | Water to make 131 ml | Water to make 280 ml | Water to make 289 ml |

Sedimenting Agent b

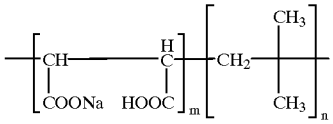

m + n = 1

TABLE 44

| Chemicals Used in Chemical Sensitization | Amount Added |
|---|---|
| 4-Hydroxy-6-methyl-1,3,3a,7-tetraazainedene | 0.39 g |
| Triethylthiourea | 3.3 mg |
| Decomposed Product of Nucleic Acid | 0.39 mg |
| NaCl | 0.15 g |
| KI | 0.12 g |
| Antifoggant (2) | 0.10 g |
| Preservative (1) | 0.07 g |

TABLE 45

| Composition of Dye Solution | Amount Added |
|---|---|
| Sensitizing Dye (2) | 0.19 g |
| Methanol | 18.7 ml |

Stabilizer (1)

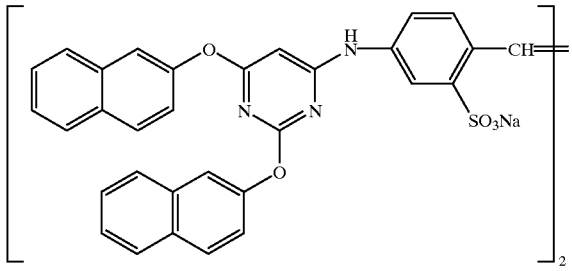

Antifoggant (2)

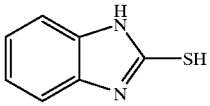

TABLE 45-continued

| Composition of Dye Solution | Amount Added |
|---|---|
| Sensitizing Dye (2) | |

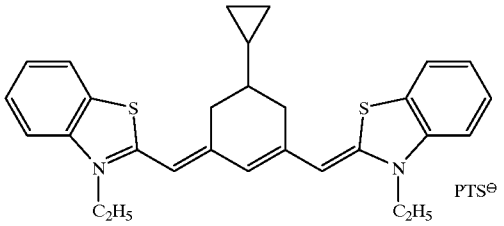

Light-Sensitive Silver Halide Emulsion (3) (for Blue-Sensitive Emulsion Layer)

Solution (I) and solution (II) each having composition shown in Table 47 were concurrently added to a well-stirred aqueous solution having composition shown in Table 46 for 18 minutes. After 5 minutes, solution (III) having composition shown in Table 47 was added thereto for 24 minutes, and solution (IV) was added for 24 minutes and 30 seconds.

After washing and salt removal (conducted using sedimenting agent b at pH 3.9) by a conventional method, 22 g of lime-treated ossein gelatin subjected to decalcification treatment (having a calcium content of 150 ppm or less) was added and redispersion was carried out at 40° C. Then, 0.39 g of 4-hydroxy-6-methyl-1,3,3a,7-tetraazainedene was added to adjust the pH and the pAg to 6.9 and 7.8, respectively, followed by optimum chemical sensitization at 60° C. Compounds used in the chemical sensitization are as shown in Table 48. The yield of a silver halide emulsion thus obtained was 683 g, and the emulsion was a monodisperse cubic silver chlorobromide emulsion having a coefficient of variation of 9.7%. The mean grain size thereof was 0.32 μm.

TABLE 46

| Composition | |
|---|---|
| $H_2O$ | 620 cc |
| Lime-Treated Gelatin | 20 g |
| KBr | 0.3 g |
| NaCl | 2 g |
| Solvent for Silver Halide (1) | 0.03 g |
| Sulfuric Acid (1 N) | 16 ml |
| Temperature | 50° C. |

TABLE 47

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.6 g | — | 2.4 g |
| $K_4[Fe(CN)_6] \cdot H_2O$ | — | — | — | 0.04 mg |
| $K_2IrCl_6$ | — | — | — | 0.02 mg |
| Total Amount | Water to make 180 ml | Water to make 181 ml | Water to make 242 ml | Water to make 250 ml |

TABLE 48

| Chemicals Used in Chemical Sensitization | Amount Added |
|---|---|
| 4-Hydroxy-6-methyl-1,3,3a,7-tetraazainedene | 0.38 g |
| Triethylthiourea | 3.1 mg |
| Antifoggant (2) | 0.19 g |
| Preservative (1) | 0.07 g |
| Preservative (2) | 3.13 g |

Fine Grain Silver Halide Emulsion (Added to Blue-sensitive Layer):

Solution (I) and solution (II) each having composition shown in Table 50 were concurrently added to a well-stirred aqueous solution having composition shown in Table 49 for 4 minutes. After 3 minutes, solution (III) and solution (IV) each having composition shown in Table 50 were added thereto for 8 minutes.

After washing and salt removal (conducted at pH 3.9 using sedimenting agent a represented by the above-mentioned structural formula) by a conventional method, 132 g of lime-treated ossein gelatin was added and redispersion was carried out at 35° C. Then, 0.39 g of 4-hydroxy-6-methyl-1,3,3a,7-tetraazainedene was added to adjust the pH to 5.7, thereby obtaining a fine grain silver halide emulsion. The yield of the resulting silver halide emulsion was 3200 g, and the mean grain size thereof was 0.10 μm.

TABLE 49

| Composition | |
|---|---|
| $H_2O$ | 377 cc |
| Lime-Treated Gelatin | 60 g |
| NaCl | 0.8 g |
| Temperature | 38° C. |

TABLE 50

| | Solution (I) | Solution (II) | Solution (III) | Solution (IV) |
|---|---|---|---|---|
| $AgNO_3$ | 300 g | — | 300 g | — |
| $NH_4NO_3$ | 10 g | — | | |
| NaCl | — | 108 g | — | 104 g |
| Total Amount | Water to make 180 ml | Water to make 181 ml | Water to make 242 ml | Water to make 250 ml |

Then, a preparation method of a dispersion of a colloidal silver emulsion is described. A solution having composition shown in Table 52 was added to a well-stirred aqueous solution having composition shown in Table 51 for 24 minutes. Then, after washing with sedimenting agent a represented by the above-mentioned structural formula, 43 g of lime-treated ossein gelatin was added to adjust the pH to 6.3. A dispersion thus obtained (a dispersion containing 2% of silver and 6.8% of gelatin) has a mean grain size of 0.02 μm and a yield of 512 g.

TABLE 51

| Composition | |
|---|---|
| $H_2O$ | 620 ml |
| Dextrin | 16 g |
| NaOH (5 N) | 41 ml |
| Temperature | 30° C. |

TABLE 52

| Composition | |
|---|---|
| $H_2O$ | 135 ml |
| $AgNO_3$ | 17 g |

Preparation methods of gelatin dispersions of hydrophobic additives are described below.

Gelatin dispersions of yellow, magenta and cyan couplers, each containing a developing agent, were each prepared according to formulations shown in Table 53. That is to say, the respective oil phase components were dissolved by heating at about 70° C. to form a homogeneous solution, and the aqueous phase components heated at about 60° C. were added to this solution. After mixing by stirring, the resulting mixture was dispersed in a homogenizer at 10,000 rpm for 10 minutes. Water was added thereto, followed by stirring to obtain a homogeneous dispersion.

Reducing Agent (1)

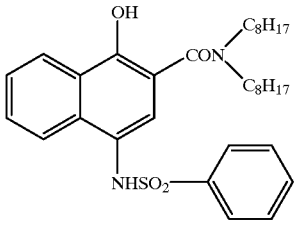

Antifoggant (3)

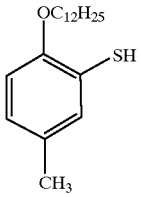

Antifoggant (4)

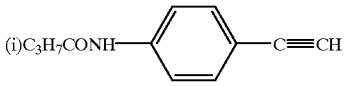

Surfactant (1)

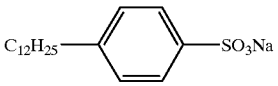

Development Accelerator (1)

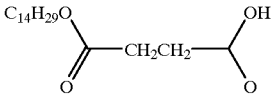

High Boiling Organic Solvent (1)

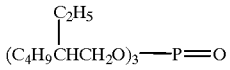

-continued

High Boiling Organic Solvent (2)

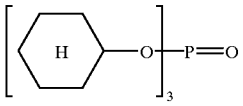

Preservative (1)

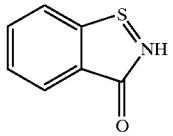

A gelatin dispersion of antifoggant (4) and reducing agent (1) was prepared according to a formulation shown in Table 54. That is to say, the respective oil phase components were dissolved by heating at about 60° C. to form a homogeneous solution, and the aqueous phase components heated at about 60° C. were added to this solution. After mixing by stirring, the resulting mixture was dispersed in a homogenizer at 10,000 rpm for 10 minutes to obtain a homogeneous dispersion.

TABLE 53

| | Composition of Dispersion | | |
|---|---|---|---|
| | Yellow | Magenta | Cyan |
| Oil Phase: | | | |
| Cyan Coupler (1) | — | — | 7.0 g |
| Magenta Coupler (1) | — | 7.0 g | — |
| Yellow Coupler (1) | 7.0 g | — | — |
| Developing Agent (1) | — | — | 5.6 g |
| Developing Agent (2) | — | 5.6 g | — |
| Developing Agent (3) | 5.6 g | — | — |
| Auxiliary Developing Agent (1) | 0.51 g | 0.51 g | 0.51 g |
| Antifoggant (5) | 0.25 g | — | — |
| Antifoggant (2) | — | 0.25 g | 0.25 g |
| High Boiling Solvent (4) | 7.4 g | 7.4 g | 7.4 g |
| Ethyl Acetate | 15 ml | 15 ml | 15 ml |
| Aqueous Phase: | | | |
| Lime-Treated Gelatin | 10.0 g | 10.0 g | 10.0 g |
| Calcium Nitrate | 0.1 g | 0.1 g | 0.1 g |
| Zinc Nitrate | — | 0.2 g | — |
| Carboxymethyl Cellulose | — | — | 0.07 g |
| Water | 110 ml | 110 ml | 110 ml |
| Water Addition | 110 ml | 110 ml | 110 ml |
| Preservative (1) | 0.04 g | 0.04 g | 0.04 g |

Antifoggant (5)

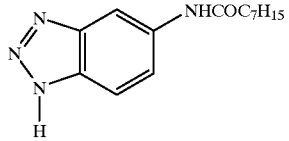

Antifoggant (6)

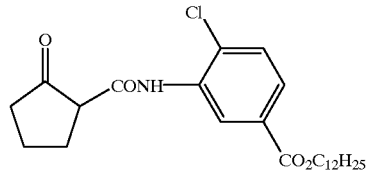

TABLE 53-continued

| | Composition of Dispersion | | |
|---|---|---|---|
| | Yellow | Magenta | Cyan |
| Antifoggant (7) | | | |
| Palmitate Ascorbate | | | |
| Development Accelerator (2) | | | |

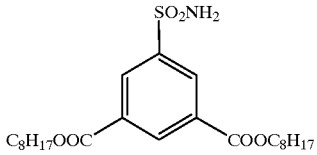

Dye (a)

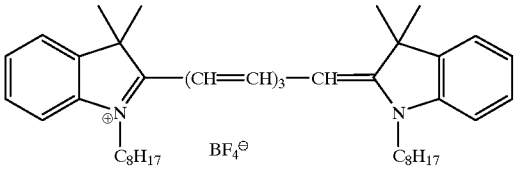

TABLE 54

| | | Composition of Dispersion |
|---|---|---|
| Oil Phase | Antifoggant (4) | 0.8 g |
| | Antifoggant (6) | 1.0 g |
| | Reducing Agent (1) | 0.1 g |
| | High Boiling Solvent (2) | 2.3 g |
| | High Boiling Solvent (5) | 0.2 g |
| | Surfactant (1) | 0.5 g |
| Aqueous Phase | Acid-Treated Gelatin | 10.0 ml |
| | Calcium Nitrate | 0.1 g |
| | Water | 35.0 ml |
| | Water Addition | 46.0 ml |

High Boiling Organic Solvent (5)

$C_{26}H_{46.9}Cl_{7.1}$ (Empara 40, manufactured by Ajinomoto Co., Inc.)

A gelatin dispersion of reducing agent (2) was prepared according to a formulation shown in Table 55. That is to say, the oil phase components were dissolved by heating at about 60° C. to form a homogeneous solution, and the aqueous phase components heated at about 60° C. were added to this solution. After mixing by stirring, the resulting mixture was dispersed in a homogenizer at 10,000 rpm for 10 minutes to obtain a homogeneous dispersion. Further, ethyl acetate was removed from the resulting dispersion using an apparatus for removing organic solvents under reduced pressure.

TABLE 55

| | Composition of Dispersion |
|---|---|
| Oil Phase | |
| Reducing Agent (2) | 7.5 g |
| High Boiling Solvent (2) | 4.7 g |
| Surfactant (1) | 1.9 g |
| Ethyl Acetate | 14.4 ml |
| Aqueous Phase | |
| Acid-Treated Gelatin | 10.0 g |
| Preservative (1) | 0.002 g |
| Preservative (4) | 0.004 g |

TABLE 55-continued

| | Composition of Dispersion |
|---|---|
| Water | 136.7 ml |
| Calcium Nitrate | 0.1 g |

Reducing Agent (2)

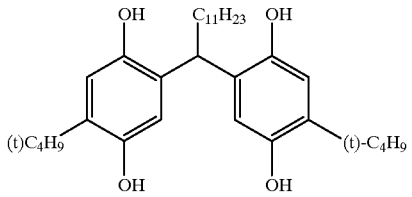

A dispersion of polymer latex (a) was prepared according to a formulation shown in Table 56. That is to say, anionic surfactant (6) was added to a mixture of polymer latex (a), surfactant (4) and water in amounts shown in Table 56 with stirring for 10 minutes to obtain a homogeneous dispersion. Further, dilution with water and concentration were repeated to the resulting dispersion, using an ultrafiltration module (ACV-3050, manufactured by Asahi Chemical Industry Co., Ltd.), so as to reduce the salt concentration of the dispersion to 1/9.

TABLE 56

| | Composition of Dispersion |
|---|---|
| Aqueous Solution of Polymer Latex (a) (solid content: 13%) | 108 ml |
| Surfactant (4) | 20 g |
| Surfactant (6) | 600 ml |
| Water | 1232 ml |

Polymer Latex (a)

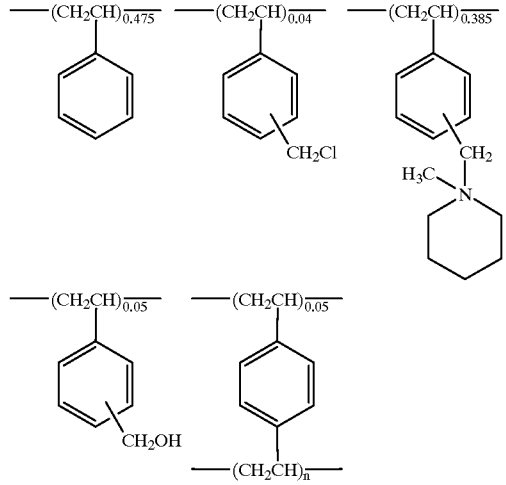

Surfactant (4)

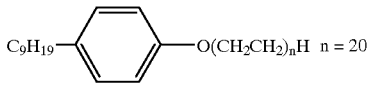

Surfactant (6)

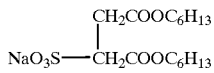

A gelatin dispersion of stabilizer (1) was prepared according to a formulation shown in Table 57. That is to say, the oil phase components were dissolved at room temperature, and the aqueous phase components heated at about 40° C. were added to the solution. After mixing by stirring, the resulting mixture was dispersed in a homogenizer at 10,000 rpm for 10 minutes. Water was added thereto to obtain a homogeneous dispersion.

TABLE 57

| | Composition of Dispersion |
|---|---|
| Oil Phase | |
| Stabilizer (1) | 4.0 g |
| Sodium Hydroxide | 0.3 g |
| Methanol | 62.8 g |
| High Boiling Solvent (6) | 0.9 g |
| Aqueous Phase | |
| Decalcified Gelatin (Ca content: 100 ppm or less) | 10.0 g |
| Preservative (1) | 0.04 g |
| Water | 320.5 ml |

High Boiling Organic Solvent (6)

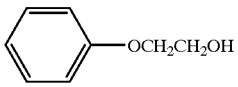

Surfactant (2)

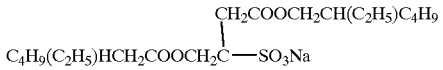

Surfactant (3)

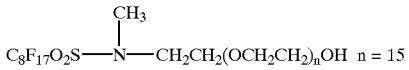

Preservative (4)

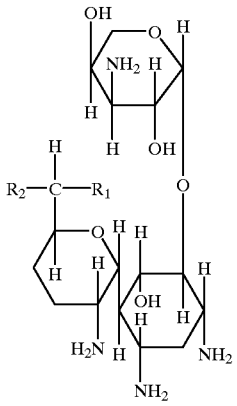

| $R_1$ | $R_2$ |
|---|---|
| $CH_3$ | $NHCH_3$ |
| $CH_3$ | $NH_2$ |
| H | $NH_2$ |
| H | $NHCH_3$ |

A gelatin dispersion of zinc hydroxide was prepared as shown in Table 58. That is to say, the respective components were dissolved by mixing, followed by dispersion in a mill using glass beads having a mean particle size of 0.75 mm for 30 minutes. The glass beads were further removed by separation to obtain a homogeneous dispersion. Zinc hydroxide having a particle size of 0.25 μm was used.

TABLE 58

| | Composition of Dispersion |
|---|---|
| Zinc Hydroxide | 15.9 g |
| Carboxymethyl Cellulose | 0.7 g |
| Polysodium Acrylate | 0.07 g |
| Lime-Treated Gelatin | 4.2 g |
| Water | 100 ml |
| High Boiling Solvent (2) | 0.4 g |

Then, a preparation method of a gelatin dispersion of a matte agent added to a protective layer is described. A solution of PMMA in methylene chloride was added to gelatin together with a small amount of surfactant to obtain a homogeneous dispersion having a mean particle size of 4.3 μm.

Using the above, light-sensitive element 301 shown in Tables 59 and 60 was obtained.

TABLE 59

MAIN MATERIAL CONSTITUTION OF LIGHT-SENSITIVE ELEMENT 301

| Layer No. | Layer Name | Additive | Amount Added ($mg/m^2$) |
|---|---|---|---|
| 7th Layer | Protective Layer | Acid-Treated Gelatin | 378 |
| | | Reducing Agent (2) | 70 |
| | | High Boiling Solvent (1) | 44 |
| | | Colloidal Silver Grains | 2 |
| | | Matte Agent (PMMA Resin) | 17 |
| | | Surfactant (1) | 19 |
| | | Surfactant (2) | 16 |
| | | Surfactant (3) | 2 |
| | | Surfactant (4) | 12 |
| | | Surfactant (6) | 17 |
| | | Polymer Latex a | 14 |
| | | Calcium Nitrate | 5 |
| 6th Layer | Intermediate Layer | Lime-Treated Gelatin | 882 |
| | | Antifoggant (4) | 18 |
| | | Antifoggant (6) | 23 |
| | | Reducing Agent (1) | 2 |
| | | High Boiling Solvent (2) | 54 |
| | | High Boiling Solvent (5) | 6 |
| | | Surfactant (1) | 1 |
| | | Surfactant (2) | 0.5 |
| | | Surfactant (7) | 11 |
| | | Water-Soluble Polymer (1) | 5 |
| | | Zinc Hydroxide | 577 |
| | | Calcium Nitrate | 17 |
| 5th Layer | Blue-Sensitive Layer | Lime-Treated Gelatin | 428 |
| | | Light-Sensitive Silver Halide Emulsion (3) | 287 |
| | | Yellow Coupler (1) | 410 |
| | | Developing Agent (1) | 328 |
| | | Antifoggant (4) | 20 |
| | | Reducing Agent (1) | 6 |
| | | High Boiling Solvent (2) | 433 |
| | | Surfactant (1) | 22 |
| | | Water-Soluble Polymer | 11 |
| | | Auxiliary Developing Agent (1) | 30 |
| 4th Layer | Intermediate Layer | Lime-Treated Gelatin | 862 |
| | | Antifoggant (4) | 6 |
| | | Antifoggant (6) | 10 |
| | | Reducing Agent (1) | 1 |
| | | High Boiling Solvent (2) | 25 |
| | | High Boiling Solvent (5) | 378 |
| | | Surfactant (1) | 5 |
| | | Surfactant (2) | 0.3 |
| | | Surfactant (7) | 5 |
| | | Water-Soluble Polymer (1) | 2 |
| | | Zinc Hydroxide | 271 |
| | | Calcium Nitrate | 8 |

TABLE 60

(cont'd from Table 59)
MAIN MATERIAL CONSTITUTION OF LIGHT-SENSITIVE ELEMENT 301

| Layer No. | Layer Name | Additive | Amount Added ($mg/m^2$) |
|---|---|---|---|
| 3rd Layer | Green-Sensitive Layer | Lime-Treated Gelatin | 404 |
| | | Light-Sensitive Silver Halide Emulsion (1) | 184 |
| | | Magenta Coupler (1) | 373 |
| | | Developing Agent (2) | 383 |
| | | Dye (a) | 13 |
| | | High Boiling Solvent (1) | 128 |
| | | High Boiling Solvent (2) | 429 |
| | | Reducing Agent (1) | 28 |
| | | Antifoggant (3) | 5 |
| | | Surfactant (1) | 43 |
| | | Carboxymethyl Cellulose | 7 |
| | | Water-Soluble Polymer (1) | 9 |
| | | Auxiliary Developing Agent (1) | 30 |
| 2nd Layer | Inter-mediate layer | Lime-Treated Gelatin | 708 |
| | | Antifoggant (5) | 4 |
| | | Reducing Agent (1) | 2 |
| | | High Boiling Solvent (2) | 104 |
| | | High Boiling Solvent (5) | 14 |
| | | Calcium Nitrate | 5 |
| 1st Layer | Red-Sensitive Layer | Lime-Treated Gelatin | 569 |
| | | Light-Sensitive Silver Halide Emulsion (2) | 330 |
| | | Emulsion of Fine Silver Halide | 30 |

TABLE 60-continued (cont'd from Table 59)
MAIN MATERIAL CONSTITUTION OF LIGHT-SENSITIVE ELEMENT 301

| Layer No. | Layer Name | Additive | Amount Added ($mg/m^2$) |
|---|---|---|---|
| | | Grains | |
| | | Cyan Coupler (1) | 390 |
| | | Developing Agent (3) | 312 |
| | | Sensitizing Dye (3) | 0.1 |
| | | Dye (a) | 42 |
| | | High Boiling Solvent (2) | 320 |
| | | Surfactant (1) | 41 |
| | | Reducing Agent (1) | 82 |
| | | Antifoggant (3) | 6 |
| | | Antifoggant (6) | 45 |
| | | Antifoggant (7) | 21 |
| | | Water-Soluble Polymer (2) | 41 |
| | | Hardener (1) | 45 |
| | | Auxiliary Developing Agent (1) | 30 |

Support (a paper support both sides of which were laminated with polyethylene, thickness: 135 $\mu$m)

Water-Soluble Polymer (1)

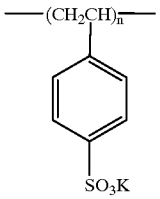

0.1 N NaCl, 30° C.
intrinsic viscosity: 1.6
molecular weight: 1,000,000

Water-Soluble Polymer (2)

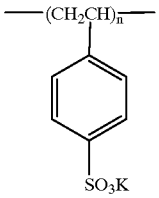

0.1 N NaCl, 30° C.
intrinsic viscosity: 0.8
molecular weight: 400,000

Hardener (1)

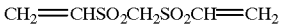

Surfactant (5)

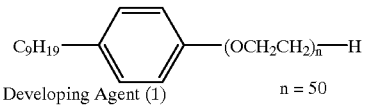

n = 50

Surfactant (7)

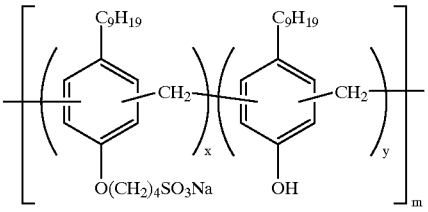

X:y = 4:6 m = 6.8

Auxiliary Developing Agent (1)

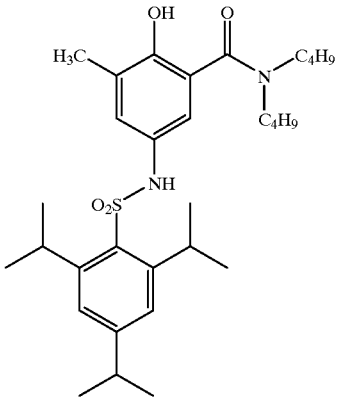

-continued
Sensitizing Dye (3)
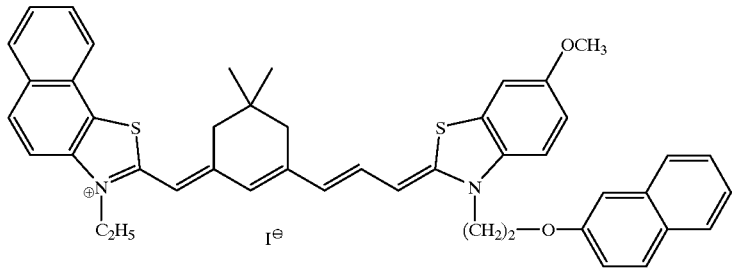
Developing Agent (1)
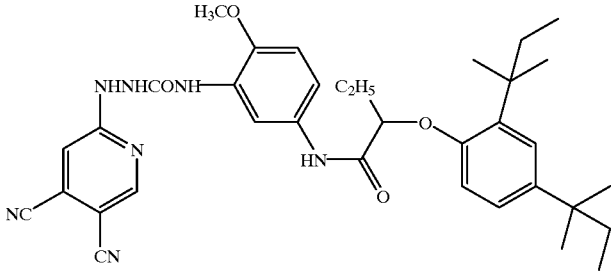
Compound (64) described in JP-A-9-152705
Developing Agent (2)
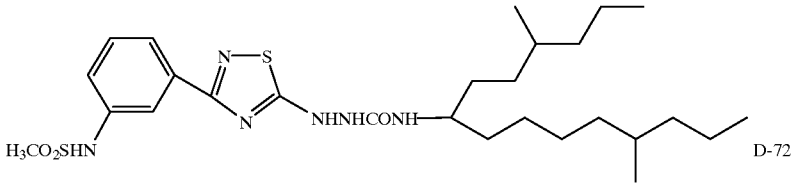
Developing Agent (3)
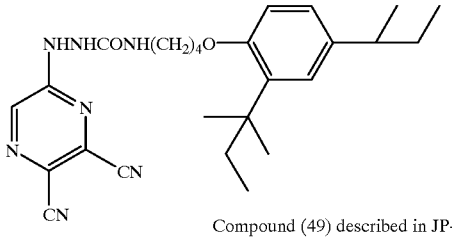
Compound (49) described in JP-A-9-152705
Yellow Coupler (1)
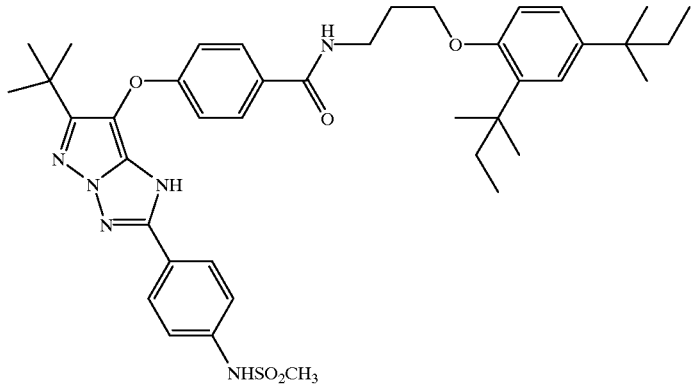
Compound (C-17) described in JP-A-9-152705

-continued

Magenta Coupler (1)

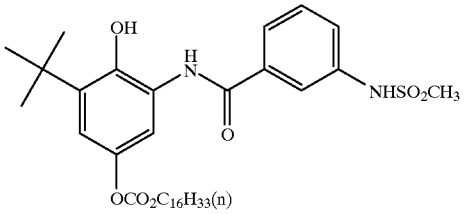

Cyan Coupler (1)

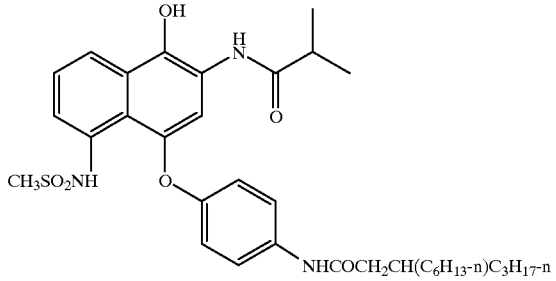

Compound (C-37) described in JP-A-9-152705

Then, light-sensitive elements 302 to 306 were prepared by replacing magenta coupler (1) in the third layer of the above-mentioned material with the couplers of the invention represented by formula (IV). The developing agents represented by formula (III) in the third layer of the above-mentioned light-sensitive element. The developing agents and couplers used herein are shown in Table 61.

These light-sensitive elements obtained as described above were heat developed in combination with image receiving element 201 with a PICTROSTAT 330 processor (manufactured by Fuji Photo Film Co. Ltd.) at 80° C. for 28 seconds to form images.

The maximum magenta absorption density ($\lambda_{max}$) of these resulting images were measured with an X-rite 304 reflection densitometer manufactured by X-rite Co. Further, image receiving elements on which recording was made were irradiated with xenon light of 170,000 luxes to examine light fastness of the images. The residual dye rates at high density areas (D=0.5) and low density areas (D=1.5) were evaluated. Results thereof are shown in Table 62.

As apparent from the table, the compounds of the invention provided favorable hues without increasing the wavelengths of hues, and exhibited the effect of being excellent particularly in the light fastness at low density areas, while being equivalent to the comparative examples in the light fastness at high density areas.

TABLE 61

| Sample Number | Developing Agent | Coupler Number |
|---|---|---|
| 301 (Comparison) | D-(72) | Magenta coupler (1) |
| 302 (Invention) | D-(72) | (51) |
| 303 (Invention) | D-(72) | (55) |
| 304 (Invention) | D-(72) | (57) |
| 305 (Invention) | D-(72) | (59) |
| 306 (Invention) | D-(72) | (64) |

TABLE 62

| Sample Number | $\lambda_{max}$ (nm) | Dye Residual Rate ($D_G$ = 0.5) (%) | Dye Residual Rate ($D_G$ = 1.5) (%) |
|---|---|---|---|
| 301 (Comparison) | 567 | 60.87 | 79.66 |
| 302 (Invention) | 557 | 80.61 | 86.17 |
| 303 (Invention) | 560 | 76.42 | 84.23 |
| 304 (Invention) | 559 | 76.59 | 83.33 |
| 305 (Invention) | 556 | 79.03 | 84.71 |
| 306 (Invention) | 555 | 74.22 | 83.42 |

According to the invention, the above-mentioned various problems can be solved. In particular, the silver halide photographic materials excellent in color generation, color reproduction and image fastness can be provided, and further, the image formation methods using the excellent silver halide photographic materials can be provided. The use of the couplers of the invention represented by formula (IV) decreases the wavelengths of the hues, and can provide the silver halide photographic materials excellent in the light fastness at low density areas and the image formation methods using the same.

The entire disclosure of each and every foreign patent application from which the benefit of foreign priority has been claimed in the present application is incorporated herein by reference, as if fully set forth.

What is claimed is:

1. A silver halide photographic material comprising at least one coupler represented by the following formula (Ia):

(Ia)

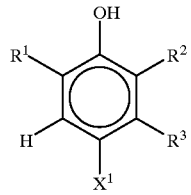

wherein $R^1$ represents an alkyl group which may be optionally substituted, with the proviso that an alkyl group substituted by a halogen atom alone and an alkyl group substituted by a halogen atom and an aryl group are excluded from $R^1$; $R^2$ and $R^3$ are the same or different, and each represents a hydrogen atom or a substituent; and $X^1$ represents a group which can leave by coupling with an oxidation product of a color developing agent.

2. The silver halide photographic material according to claim 1, wherein $R^1$ of formula (Ia) is a tertiary alkyl group.

3. The silver halide photographic material according to claim 1, wherein $R^2$ of formula (Ia) is an acylamino group, an alkoxycarbonylamino group or an ureido group.

4. The silver halide photographic material according to claim 2, wherein $R^2$ of formula (Ia) is an acylamino group, an alkoxycarbonylamino group or an ureido group.

5. A silver halide photographic material comprising at least one coupler represented by the following formula (II):

(II)

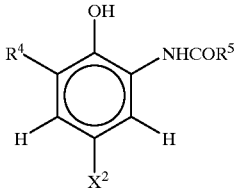

wherein $R^4$ represents a tertiary alkyl group; $R^5$ represents a substituent; and $X^2$ represents a coupling-off group which is linked by an oxygen atom to a mother nucleus of a phenol coupler and has a formula weight of 200 or more.

6. The silver halide photographic material according to claim 5, wherein at least one of $R^4$ and $R^5$ of formula (II) is a group having a dissociative group with a pKa of 1 to 12.

7. A silver halide photographic material comprising a support having provided thereon at least one hydrophilic colloidal layer containing at least one coupler represented by the following formula (Ib) and at least one color developing agent represented by the following formula (III):

(Ib)

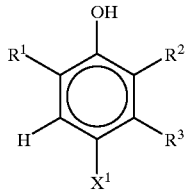

wherein $R^1$ represents an alkyl group which may be optionally substituted; $R^2$ and $R^3$, which may be the same or different, each represents a hydrogen atom or a substituent; and $X^1$ represents a group which can leave by coupling with an oxidation product of a color developing agent (III)

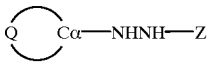

wherein Cα represents a carbon atom; Z represents a carbamoyl group, an acyl group, an alkoxycarbonyl group or an aryloxycarbonyl group; and Q represents an atomic group forming an unsaturated ring together with Cα.

8. An image formation method comprising heat developing the silver halide photographic material according to claim 1.

9. An image formation method comprising developing the silver halide photographic material according to claim 1 by developing an alkali processing solution.

* * * * *